US010759499B1

(12) United States Patent
Henderson, III

(10) Patent No.: US 10,759,499 B1
(45) **Date of Patent: *Sep. 1, 2020**

(54) COCKPIT COVERING SYSTEM AND METHOD FOR SKIFFS

(71) Applicant: William Douglas Henderson, III, Abita Springs, LA (US)

(72) Inventor: William Douglas Henderson, III, Abita Springs, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/247,429

(22) Filed: Jan. 14, 2019

Related U.S. Application Data

(63) Continuation-in-part of application No. 15/625,689, filed on Jun. 16, 2017, now Pat. No. 10,179,629.

(60) Provisional application No. 62/351,013, filed on Jun. 16, 2016.

(51) Int. Cl.

| | |
|---|---|
| ***B63B 17/00*** | (2006.01) |
| ***B63B 17/02*** | (2006.01) |
| ***B63B 19/02*** | (2006.01) |
| ***E04H 15/02*** | (2006.01) |
| *B63B 19/00* | (2006.01) |

(52) U.S. Cl.
CPC ..... *B63B 17/02* (2013.01); *B63B 19/02* (2013.01); *E04H 15/02* (2013.01); *B63B 2019/0092* (2013.01)

(58) Field of Classification Search
CPC ... B63B 17/02; B63B 17/023; B63B 2017/02; B63B 2017/026; B63B 19/00; B63B 19/02; B63B 2019/0092; B63B 2231/16; B63B 2231/40; B63B 2231/42
USPC ..... 114/343, 347, 351, 352, 353, 354, 361, 114/364
See application file for complete search history.

(56) References Cited

U.S. PATENT DOCUMENTS

| | | | |
|---|---|---|---|
| 34,672 | A | 3/1862 | Crane |
| 349,316 | A | 9/1886 | Nye |
| 931,529 | A | 8/1909 | Vaghi |

(Continued)

FOREIGN PATENT DOCUMENTS

| | | |
|---|---|---|
| WO | 1991011360 | 8/1991 |

OTHER PUBLICATIONS

"Installing a Mills Forward Shelter", Bob Kurtz (2006) (available at http://continuouswave.com/whaler/reference/shelter.html).

*Primary Examiner* — Daniel V Venne
(74) *Attorney, Agent, or Firm* — Garvey, Smith & Nehrbass, Patent Attomeys, L.L.C.; Julia M. FitzPatrick; Charles C. Garvey, Jr.

(57) ABSTRACT

A cockpit covering system for a small boat comprises a tent or cover comprising a plurality of wall portions and a base, and wherein the tent is sized to extend over a recessed area of a cockpit and to enclose an interior that extends from above deck height to below the height of a base layer. A compressible gasket is below the base for resting on a deck of the small boat around the cockpit outer perimeter. A plurality of webbing straps extend from the outer perimeter of the boat to the tent. A plurality of webbing straps extend from the cockpit outer perimeter to the tent covering system. Tension applied to the plurality of webbing straps compresses the compressible gasket to form a seal along a cockpit recessed area. Pole housings can be provided on webbing straps or on the tent base to secure tent poles at deck level.

18 Claims, 34 Drawing Sheets

(56) References Cited

U.S. PATENT DOCUMENTS

| | | | | | |
|---|---|---|---|---|---|
| 3,106,218 | A | | 10/1963 | Wright | |
| 3,192,542 | A | | 7/1965 | Mills, II | |
| 3,304,657 | A | | 2/1967 | Singleton | |
| 3,348,874 | A | | 10/1967 | Gorman | |
| 3,354,892 | A | | 11/1967 | Frieder | |
| 3,367,349 | A | | 2/1968 | O'Link | |
| 3,810,267 | A | | 5/1974 | Fussell, Jr. et al. | |
| 3,896,832 | A | | 7/1975 | Montoya | |
| 3,978,535 | A | | 9/1976 | Swan et al. | |
| 4,070,722 | A | | 1/1978 | Sutherland | |
| 4,133,577 | A | | 1/1979 | Pliant | |
| 4,621,587 | A | | 11/1986 | Pool | |
| 5,009,184 | A | | 4/1991 | Voldrich | |
| 5,070,807 | A | * | 12/1991 | Lewis | B63B 17/02 114/345 |
| 5,364,054 | A | | 11/1994 | Miller et al. | |
| 5,511,507 | A | | 4/1996 | Allen | |
| 5,697,320 | A | * | 12/1997 | Murray | B63B 17/02 114/361 |
| 5,706,752 | A | | 1/1998 | Menne, Jr. et al. | |
| 5,839,388 | A | | 11/1998 | Vadney | |
| 5,904,114 | A | * | 5/1999 | Wright | B63B 17/02 114/361 |
| 5,944,039 | A | | 8/1999 | Bergeron | |
| 6,164,238 | A | | 12/2000 | Stokes | |
| 6,223,680 | B1 | * | 5/2001 | Frink | B63B 17/02 114/361 |
| 6,260,505 | B1 | | 7/2001 | Polidan | |
| 6,672,241 | B2 | | 1/2004 | Warfel et al. | |
| 7,013,830 | B1 | | 3/2006 | Willis | |
| 7,032,532 | B2 | | 4/2006 | Brooks et al. | |
| 7,051,669 | B2 | | 5/2006 | Warfel et al. | |
| 7,096,816 | B2 | | 8/2006 | Whited, II et al. | |
| 7,281,486 | B2 | | 10/2007 | Bach et al. | |
| 7,395,775 | B2 | | 7/2008 | LaScala | |
| 7,401,566 | B1 | | 7/2008 | Miknich | |
| 7,418,919 | B2 | * | 9/2008 | Smith | B63B 17/02 114/361 |
| 7,503,275 | B2 | | 3/2009 | Daniels et al. | |
| 7,527,014 | B2 | * | 5/2009 | Hey | B63B 17/02 114/361 |
| 7,784,420 | B2 | | 8/2010 | Tufte | |
| 7,987,807 | B2 | | 8/2011 | Mikacich | |
| 8,757,185 | B1 | * | 6/2014 | Muzzio | B63B 17/02 114/361 |
| 8,950,416 | B1 | | 2/2015 | Spellman | |
| 9,120,539 | B1 | | 9/2015 | Binder | |
| 9,150,283 | B2 | | 10/2015 | Braaten-Boyd | |
| 9,556,640 | B2 | * | 1/2017 | Levin | B63B 17/02 |
| 9,714,068 | B1 | * | 7/2017 | Greer | B63B 17/02 |
| 9,776,687 | B2 | * | 10/2017 | Levin | B63B 17/02 |
| 9,849,940 | B2 | * | 12/2017 | Greer | B63B 17/02 |
| 10,179,629 | B1 | | 1/2019 | Henderson, III | |
| 2007/0137553 | A1 | | 6/2007 | Murray | |
| 2014/0102350 | A1 | | 4/2014 | Marcrum | |

* cited by examiner

COCKPIT COVERING SYSTEM AND METHOD FOR SKIFFS

CROSS-REFERENCE TO RELATED APPLICATIONS

This is a Continuation-in-part of U.S. patent application Ser. No. 15/625,689, filed on Jun. 16, 2017 (issued as U.S. Pat. No. 10,179,629 on Jan. 15, 2019), which claims the benefit of and/or priority to U.S. Provisional Patent Application Ser. No. 62/351,013, filed on Jun. 16, 2016, each of which is hereby incorporated herein by reference.

The benefit of and/or priority to U.S. patent application Ser. No. 15/625,689, filed on Jun. 16, 2017 (issued as U.S. Pat. No. 10,179,629 on Jan. 15, 2019), and U.S. Provisional Patent Application Ser. No. 62/351,013, filed on Jun. 16, 2016, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a cockpit covering system and method for a boat or skiff, e.g., a small hunting or fishing boat or skiff. More particularly, the present invention relates to a cockpit covering system and method for forming an enclosure around an interior for providing shelter to an occupant of the interior. The cockpit covering system comprises a cover or tent with an opening in a tent base, the tent base resting on the boat deck around a cockpit and the base opening extending over the cockpit. The tent or cover encloses the cockpit recess and an interior above a height of the boat deck. A cockpit floor located below the tent base defines a floor for the enclosure. The covering system includes a plurality of webbing straps extending from an outer perimeter of the boat to the cockpit and wherein tension applied to the webbing straps compresses a sealable layer or compressible layer to form a water and/or bug proof seal around the cockpit. A plurality of pole brackets or pole housings can be provided on the webbing straps or tent base for securing poles on the deck of the boat or skiff, wherein said poles can provide support for the tent or cover. The tent covering system can be assembled while the boat is in open water or in a marshy area, a distance away from a launch location. A boat can be operated, e.g., idling from one place to another or using poling techniques, while the tent covering system is in place on the boat.

2. General Background of the Invention

Small hunting and fishing boats, e.g., those manufactured by Hellsbay, Maverick, Chittum, East Cape and Beaver Tail companies are commonly used for day trips for hunting and fishing, e.g., in the Florida Everglades. These boats are commonly referred to as poling skiffs wherein the boats are moved through shallow waters via poling techniques. These boats also generally comprise a motor for moving the boat through water.

Such boats generally have a small deck area wherein a person, e.g., a person five (5) foot tall or taller, generally does not have room to lie down on the deck. There also generally is not room to pitch a tent on the deck area, and no means to secure a standard prior art tent at deck level in a manner so that a water and/or bug proof barrier and/or seal can be provided around a cockpit area.

A cockpit or recessed area of such boats generally comprises a seat or two and a steering column. A person, e.g., a person that is five (5) foot tall or taller can have room to lie down and/or sit down on a floor of a cockpit interior.

Some hunters and fishermen may bring their own tent and pitch it over a cockpit area but such tents are not securable to the boat wherein a water and bug seal is provided at a cockpit outer perimeter. Such tents can be awkwardly placed with a tent floor drooping into the recessed area of a cockpit. Such tents generally are put into use when a boat is off the water, e.g., on a trailer.

In common hunting/fishing areas in which hunting and/or fishing boats or skiffs are used, e.g., the Florida Everglades, fishermen can rent deck/platform space extending over water at certain locations to camp on the deck or platform overnight. Such space is expensive and highly sought after, and it can be difficult to find or rent available space for any given hunting or fishing trip.

Hunting and fishing boats or skiffs at times experience malfunctions and may break down leaving hunters or fishermen or other boat occupants stranded in open water or marsh areas over night. In such situations, the hunters, fishermen and/or other boat occupants are exposed to numerous insects and bugs as well as weather elements without adequate cover. This can be a very dangerous situation.

There is thus a need in the art for an enclosure and tent covering system for small boats or skiffs that will provide protection for boat or skiff occupants from weather elements, bugs and/or insects, and which includes a water and/or bug proof enclosure or a water, wind and/or bug barrier.

There is also a need in the art for a cockpit enclosure and covering system for small boats or skiffs that will provide protection for boat or skiff occupants from weather elements and/or bugs and/or insects, and which includes a water and bug proof seal or at least a barrier around a cockpit area, wherein the occupants can sleep or rest in a prone position within the cockpit interior and within the enclosure and can be protected from insects and bugs swarming at an exterior of the cockpit cover or tent.

There is also a need in the art for a tent covering system that can be assembled while a small boat or skiff is on open water or in marsh areas.

There is also a need in the art for a tent covering system that can be assembled on a small boat or skiff a distance away from a launch point, and which may remain assembled while moving on open water, e.g., idling from one place to another, or while utilizing poling techniques.

There is also a need for a tent covering system for small boats or skiffs wherein occupants, while utilizing the shelter of the tent can easily access hatches or storage areas located on the deck, while maintaining a water and/or bug proof seal or barrier around the cockpit perimeter.

There is also a need in the art for a tent covering system that remains in place over a cockpit area, with a water and/or bug proof seal or a water and/or bug barrier around the cockpit perimeter, while boat occupants can enter and exit the cockpit area to the deck, and perform hunting, fishing or other activities on the deck.

There is also a need in the art wherein a tent covering system can be secured on a deck, at or near deck level, and not just at a boat outer rail or lip.

There is also a need in the art for a tent covering system that can remain in place while a boat is in motion, over a cockpit area during the day and night, including while the deck is utilized for hunting, fishing or other boating activities.

Such a system will enable people to extend their fishing or hunting trips over night and during rainy and/or other bad weather conditions. Such a system will also provide protection from bugs and insects and wind in the event a boat or skiff breaks down leaving occupants stranded in open water or marsh areas overnight.

The following U.S. Patents are incorporated herein by reference: U.S. Pat. Nos. 349,316; 3,192,542; 3,896,832; 5,364,054; 5,511,507; 7,395,775; 8,950,416.

BRIEF SUMMARY OF THE INVENTION

A cockpit covering system and method for small boats or skiffs forms an enclosure around an interior for providing shelter to an occupant of the interior. The cockpit covering system comprises a cover or tent with an opening in a tent base, the tent base resting on the boat deck around a cockpit and the base opening extending over the cockpit. The tent or cover encloses the cockpit recess and an interior above a height of the boat deck. A cockpit floor located below the tent base defines a floor for the enclosure. The covering system includes a plurality of webbing straps, or other tie down straps or ropes or cords (e.g., see webbing straps or tie downs available at Home Depot sold under the trademark Everbilt), preferably extending from an outer perimeter of the boat to the cockpit and wherein tension applied to the webbing straps compresses a sealable layer that can rest on the boat deck surface, e.g., a gasket, to form a water and/or bug proof seal around a cockpit perimeter. Tension applied to the webbing straps can compress or press a tent base, which can include a compressible layer, against the boat deck.

A plurality of pole brackets can be provided on the webbing straps or on the tent base for securing poles at the deck of the boat or skiff, wherein said poles can provide support for the tent or cover.

The tent covering system can be assembled while the boat is in open water or in a marshy area, a distance away from a launch or docking location, e.g., at about ¼, ½, ¾ or 1 mile away from a launch location or docking station, or at least between about ¼ and 1 mile away from a boat launch or dock. In some embodiments, the tent covering system can be assembled while the boat is in open water or in a marshy area, over a mile away from a launch or docking location. In some embodiments, the tent covering system can be assembled while the boat is in open water or in a marshy area, less than about ¼ mile away from a launch or docking location. In some embodiments, the tent covering system can be assembled while the boat is at a dock or launch point, or off the water, e.g., on a trailer.

Preferably a boat can be operated, e.g., idling from one place to another or using poling techniques, while the tent covering system is in place on a boat on the water.

In some embodiments, if a boat is operated while the tent is assembled on the boat, doors and/or windows of the enclosure can be opened and closed. In some embodiments doors or windows can include two layers, a mesh or screen layer and tent fabric layer, e.g., nylon or polyester layer, wherein the tent fabric layer, polyester or nylon layer can be opened, e.g., unzipped, with the screen or mesh layer remaining in place, to help prevent bugs from entering the enclosure, but to allow wind to flow through the enclosure, for example.

In various embodiments a cockpit tent covering system for a small boat or skiff comprises a tent or cover having a plurality of walls, each of the plurality of walls having a lower portion and wherein the tent or cover is sized to cover and enclose a cockpit recessed area and an interior at a height above the deck, and wherein the cover extends over the cockpit recessed area. A tent base includes a base layer that is attached to a lower portion of each of the plurality of walls and positionable on the deck around the cockpit. A sealable water and/or bug proofing layer, which preferably is compressible, is below the base layer for resting on a deck of the small boat around a cockpit. The base of the enclosure comprises an open portion that extends over a cockpit recessed area. A floor of the cockpit preferably defines a floor of the enclosure. A plurality of tension straps, e.g., webbing straps, have first and second ends. The first end of each strap is attachable at an outer perimeter of the boat. The second end of each strap is attachable to the tent covering system and at a cockpit perimeter and/or at a cockpit wall or deck lip. Tension applied to the straps extending from the boat outer perimeter to the cockpit perimeter applies pressure to the sealable layer for compressing the sealable layer to form a water and/or bug proof seal around the cockpit. The amount of pressure and sealing can be adjusted based on tension applied, e.g., tension of one or more webbing tension straps.

In one or more embodiments, a cockpit enclosure system for a small boat comprises:

- a cover comprising a plurality of wall portions, each of the plurality of wall portions having a lower portion and base layer, and wherein the cover is sized to extend over a recessed area of a cockpit and enclose an interior space that extends above deck height and below the base layer;
- the base layer attached to the lower portion of each of the plurality of walls and positionable around an outer perimeter of the cockpit;
- a compressible sealing layer below the base layer for resting on a deck of the small boat around the cockpit outer perimeter, for providing a bug and/or water seal;
- a plurality of straps, each of the plurality of straps comprising first and second end portions;
- the first end portion of each of the plurality of straps attachable to an outer perimeter of the boat;
- the second end portion of each of the plurality of straps attachable to the cockpit enclosure system and to the cockpit;
- wherein tension applied to the plurality of straps extending from the small boat outer perimeter to the cockpit compresses the sealable layer to form a bug and/or water proof seal around the cockpit so that bugs and water cannot enter the interior space.

In one or more embodiments of the system, a floor of the cockpit defines a floor for the enclosure system.

In one or more embodiments of the system, the sealable layer is a neoprene gasket.

In one or more embodiments of the system, the plurality of straps include tension buckles for increasing or reducing tension of the plurality of straps extending from the small boat outer perimeter to the cockpit outer perimeter.

In one or more embodiments, the system, further comprises a second plurality of straps extending from the lower portion of one or more side portions of the cover to the outer perimeter of the small boat, each of the second plurality of straps having a first end attachable to the outer perimeter of the boat and a second end attached to the cockpit enclosure system.

In one or more embodiments the system further comprises a rain fly for covering the tent and deck.

In one or more embodiments of the system, the rain fly extends over the outer perimeter of the boat and is secured underneath the boat to enable rain or water to flow off the boat.

In one or more embodiments of the system, the first ends of each of the plurality of straps are secured to a plurality of brackets positioned along the outer perimeter of the boat.

In one or more embodiments of the system, the rain fly is also secured to the plurality of brackets positioned along the outer perimeter of the boat.

In one or more embodiments of the system, each of the plurality of brackets includes a clamp for loosening or tightening it to the outer perimeter of the boat.

In one or more embodiments of the system, each of the plurality of brackets includes a cushioning layer that is in contact with the boat.

In one or more embodiments of the system, the system further comprises a plurality of poles for providing support to the cover.

In one or more embodiments of the system, plurality of poles are attachable to a housing on one or more of the plurality of straps.

In one or more embodiments of the system, the housing is movable between one or more positions, enabling tension of the poles to be increased or decreased.

In one or more embodiments of the system, at least two of the plurality of poles is securable to a bracket positioned on an outer perimeter of the boat.

In one or more embodiments of the system, the plurality of straps are attached to the cockpit enclosure system at cover corners between the lower portion of each of the walls and the base layer.

In one or more embodiments of the system, the plurality of straps are threaded through a sealed opening in the lower portion of one of the plurality of the cover wall portions and attached to the cockpit enclosure system on an interior side of one of the plurality of wall portions.

In one or more embodiments of the system, each of the plurality of straps is attached to the cockpit enclosure system between the base layer and the compressible sealable layer.

In one or more embodiments, a tent covering system for a cockpit of a small boat comprises:

- a tent comprising four side portions, each of the tent side portions having a lower portion and wherein the tent is sized to cover the opening of a cockpit;
- a base layer attached to the lower portion of each of the tent side portions and positionable on a deck surface of the boat around the cockpit, the base layer not extending over the cockpit opening;
- a compressible sealable layer below the base layer on at least three sides of the tent;
- a plurality of straps, each of the plurality of straps comprising first and second ends;
- the first end of each of the plurality of straps attachable to an outer perimeter of the boat;
- the second end of each of the plurality of straps attached to the tent covering system and attachable to a cockpit coupler;
- wherein tension applied to the plurality of straps extending from the small boat outer perimeter to the cockpit coupler compresses the compressible sealable layer to form a seal around the cockpit.

In one or more embodiments of the system, a flange is attachable to the base layer on any side that does not comprise the compressible sealable layer and wherein at least a portion of said flange is positionable under a seat of the small boat.

In one or more embodiments of the system, the flange provides a water and/or bug proof seal along the any of said sides of the cockpit outer perimeter where a said flange is positioned.

In one or more embodiments of the system, the compressible sealable layer is a neoprene gasket.

In one or more embodiments of the system, the straps include tension buckles.

In one or more embodiments of the system, the system further comprises a second plurality of straps extending from the bottom portion of one or more sides of the tent to the outer perimeter of the boat, each of the second plurality of straps having a first end securable to the outer perimeter of the boat and a second end securable to the tent covering system.

In one or more embodiments of the system, the system further comprises a rain fly for covering the tent and deck of the boat.

In one or more embodiments of the system, the rain fly extends over the outer perimeter of the boat and is secured underneath the boat to enable rain or water to flow off the boat.

In one or more embodiments of the system, the first ends of each of the plurality of straps are secured to a plurality of brackets positioned along the outer perimeter of the boat.

In one or more embodiments of the system, a rain fly for covering the tent and deck of the boat is also secured to one or more of the plurality of brackets positioned along the outer perimeter of the boat.

In one or more embodiments of the system, the bracket includes a clamp for loosening or tightening it to a rail of the boat.

In one or more embodiments of the system, the bracket includes a cushioning layer that is in contact with the boat.

In one or more embodiments of the system, the compressible sealable layer is removably attachable to the tent covering system.

In one or more embodiments of the system, the plurality of straps are removably attachable to the tent covering system.

In one or more embodiments of the system, the compressible sealable layer is attached to the base layer and also attached the straps positioned between the base layer and compressible sealable layer.

In one or more embodiments of the system, the base layer extends a first distance away from an exterior side of each of the plurality of walls to a second distance away from an interior side of each of the plurality of walls.

In one or more embodiments of the system, at least a portion of the base layer is wrapped in a water proof or water resistant material.

In various embodiments the tent or cover of the cockpit covering system is made from a continuous piece of material, e.g., nylon or polyester, and said continuous tent or cover has four wall portions for enclosing each side of a cockpit.

In various embodiments the sealable layer has a perimeter that is closed.

In various embodiments the sealable layer surrounds an entire circumference or perimeter of a cockpit.

In various embodiments the sealable layer comprises more than one component that establishes the closed perimeter.

In various embodiments the sealable layer comprises a compressible material for sealing a portion of the cockpit perimeter and a flange, e.g., a metal or plastic flange, for providing a seal along one or more sides of the cockpit.

In various embodiments the sealable layer seals around a rotation of about 360 degrees, if an occupant turns a full circle within an interior of the enclosure created by the covering system.

In various embodiments the sealable layer seals an interior from an exterior.

In various embodiments the sealable layer comprises a material that is not penetrable by water.

In various embodiments the sealable layer comprises a material that is not penetrable by bugs.

In various embodiments the sealable layer comprises a material that is not penetrable by bugs or water.

In various embodiments a tent base has a perimeter that is closed.

In various embodiments a tent base surrounds an entire circumference or perimeter of a cockpit.

In various embodiments a tent base comprises more than one component that establishes a closed perimeter.

In various embodiments a tent base comprises a compressible material for sealing a portion of the cockpit perimeter and a flange, e.g., a metal or plastic flange, for providing a seal along one or more sides of the cockpit.

In various embodiments a tent base seals around a rotation of about 360 degrees, if an occupant turns a full circle within an interior of the enclosure created by the covering system.

In various embodiments a tent base can seal around less than a rotation of about 360 degrees, if an occupant turns a full circle within an interior of the enclosure created by the covering system.

In various embodiments a tent base seals an interior from an exterior.

In various embodiments a tent base seals a least a portion of an interior from an exterior.

In various embodiments a tent base provides a barrier for an interior from an exterior.

In various embodiments a tent base is formed from a material that is not penetrable by water.

In various embodiments a tent base is formed from a material that is not penetrable by bugs.

In a tent base is formed from a material that is not penetrable by bugs or water.

In a tent base is formed from a material that is at least resistant to bugs and/or water and/or wind.

In various embodiments tension can be applied to the straps extending from the boat outer perimeter to the cockpit via one or more tension buckles positioned on the straps.

In various embodiments one or more pole bracket housings may also be provided on the webbing tension straps, or other tension tie down, that extend from the boat outer perimeter to the cockpit. Preferably tension can be applied to the straps so that the tension straps cannot move or have very restricted movement in any direction. When a tent pole is secured in a bracket housing on the webbing tension straps, with desired tension applied, the tent pole can be secured at or near deck level for supporting the enclosure over the cockpit. Said poles can be selected so as to provide a desired height for the cockpit enclosure.

Preferably a tent pole housing bracket assembly for coupling to a webbing tension strap includes a housing bracket coupled to a pole housing tension strap, said pole housing tension strap coupled to the webbing tension strap that can extend from the boat outer perimeter to the cockpit. Preferably the tent pole housing bracket is movable or slidable between one or more positions on the pole housing tension strap of the pole housing bracket assembly, enabling tension or slack to be applied to the poles, as necessary or desired.

Preferably a pole can be moveable in forward and reverse directions within a bracket housing on the pole bracket tension strap, while the bracket housing itself, coupled to the pole bracket tension strap with tension applied, will have no or limited movement in any direction.

In various embodiments poles are provided on an exterior of the tent or cover for nesting within pole housings on pole housing tension straps, on boat deck webbing tension straps.

In various embodiments poles can also be provided on an interior of the tent or cover.

In various embodiments a pole system can be provided for both an exterior and interior of the tent or cover.

If included, an interior pole system can run along interior sides of a tent base portion at or near deck level. Preferably, the said interior poles can extend a distance along all four sides of the tent or cover, e.g., corner to corner. Preferably the said interior poles can have clips or pole housings spaced a distance apart, e.g., about a foot apart, to hold the interior poles in place at or near a lower most portion of the tent cover wall portions or at or near the base portion of the tent that can rest on the boat deck. Pockets or sleeves for receiving one or more pole end portions can be placed at or near corners at the tent cover base.

Alternatively, a tent base portion can be made to include sleeves that can extend along on an interior of the tent for receiving interior poles to be threaded through the sleeves. Including interior poles can add additional protection and support for the tent covering system, e.g., for protection against high winds.

In various embodiments, support stakes or poles are provided inside the tent along a base layer or over a base layer, attached between four corners of the tent. In between webbing tension straps, preferably a clip will be placed to clip poles along the run.

In various embodiments a compressible water and/or bug proofing layer is not provided on all sides of the tent or cockpit, for example, for skiffs that include one or more seats along a rear side of a cockpit. For such skiffs with one or more seats at or near a cockpit edge, a flange can be provided as part of a tent base portion for any tent side or sides that does not include the compressible water and/or bug proofing layer. A lower portion of a tent rear wall, for example, can be coupled to the flange, e.g., via an adhesive. A tent base webbing layer that extends on other sides of the tent base, e.g., above the gasket or sealable layer, can also be coupled to at least an end portion of the flange. Preferably the tent walls and base layer are coupled to the flange so that bugs or water cannot enter a tent interior at the couplings. The flange preferably is configured so that at least a portion of the flange can be pushed or slid under a seat, for example, and wherein the boat seat can help hold the tent side with the flange in place.

In various embodiments, a flange can be provided with one or more openings to enable a tent wall portion or a tent base portion to be threaded therethrough to enable attachment of a tent wall portion or tent base portion to the flange. The tent wall portion or base portion can be sewn back on itself, for example, after being threaded through the opening in the flange. In some embodiments, a tent wall portion or tent base portion could be sewn to a flange, e.g., if sew holes are included in the flange. In some embodiments a tent wall portion or tent base portion could be coupled to a flange via staples, e.g., heavy duty staples when a flange comprises a thin metal or plastic material.

In various embodiments, a tent covering system with a compressible sealable layer on all sides of the tent cover can be used on boats that do include a seat at or near a cockpit edge, wherein the tent base portion with a compressible sealable layer is slid under the seats, or wherein the tent base portion with a compressible sealable layer is attached to a horizontal member of a flange on a seat side of the cockpit and the compressible sealable layer on the flange is slid under the seat portion.

Preferably a tent enclosure and covering system does not comprise a floor layer that extends over and covers a cockpit recessed area. Preferably the floor of the cockpit defines a floor for the enclosure formed by the tent covering system.

In various embodiments the sealable layer can be a neoprene gasket.

In various embodiments the sealable layer can be a foam material.

In various embodiments the sealable layer can be a foam material that is water proof.

In various embodiments the sealable layer can be a foam material that has been sealed with a water proofing material to prevent the foam material from absorbing water.

In various embodiments the sealable layer can be any desired material that can be pressed against a deck surface and provide a seal or a barrier at least along a portion of the deck surface.

In various embodiments, a cockpit covering system can be utilized on a skiff or boat in open water, away from a launch or docking area in an emergency situation, for example if the boat breaks down, even if the weather is not bad or raining. In such a situation a water proof layer may not be needed but a bug proofing layer will still be desirable. A foam material that is compressible to form a seal around the perimeter of the cockpit wherein bugs cannot move under or through the layer can be utilized, although preferably a sealable layer is both water and bug proof so that when compressed at a cockpit perimeter it also can prevent water from flowing under or through the sealable layer. The tent walls above the sealable layer can also prevent bugs from entering the interior of the tent covering system and are preferably at least water resistant, e.g., of a nylon or polyester material, to help prevent water from entering the interior through the tent walls. In some embodiments a rainfly can also be used to cover the tent covering system and provide added protection from rain water.

In one or more preferred embodiments, a tent covering system can provide any desired water proofing to a cockpit area without also including a rainfly.

In one or more preferred embodiments, a tent covering system can provide any desired water proofing to a cockpit area and a rainfly can also be included to help guide rain runoff away from the boat.

In some embodiments the material of the tent cover can be water proof, e.g., not penetrable by water, or the tent material can be treated with a water proofing layer to prevent water from being absorbed by or penetrating the tent material.

Preferably four tension straps are sized to extend from the boat outer perimeter to cockpit corners and are attached to the cockpit tent covering system at or near tent corners at the tent base.

In various embodiments, each of the straps extends from the boat outer perimeter to the cockpit at corners or bends of a cockpit rail or lip and are attached to the covering system at tent corners between a lower portion of one or more walls and a base layer.

In various embodiments, each of the tension straps extending from the boat outer perimeter to the cockpit are threaded through a sealed or sealable opening in a lower portion of one or more of the plurality of tent wall portions and are attached to the tent on an interior side of one or more of the tent wall portions.

In various embodiments, each of the straps extending from the boat outer perimeter to the cockpit are attached to the tent covering system between a base layer and the sealable layer.

In various embodiments a second plurality of straps can be provided spaced apart along a lower portion of the tent, as desired, and sized to extend from a tent wall portion to the outer perimeter of the small boat. Such straps may or may not also be attachable to the cockpit, e.g., to a cockpit wall or cockpit rail or lip.

In various embodiments, the enclosure and covering system provides a water and/or bug proof seal around a cockpit perimeter but the enclosure formed by the covering system can receive gas, e.g., air into the enclosure interior.

In various embodiments, an entrance/exit is provided for entering or exiting an interior of the enclosure formed by the covering system, wherein an occupant can enter or exit the interior by temporarily unsealing the entrance/exit, which can be resealed, while the sealable layer around the cockpit perimeter continues to provide a water and/or bug proof seal at the cockpit outer perimeter.

Various embodiments can include a rain fly for covering the tent and/or deck of the boat or skiff.

Preferably a rain fly extends over the outer perimeter of the boat and is secured underneath the boat to enable rain or water to flow off the boat and provide another level of waterproofing to the enclosure and tent covering system.

A plurality of brackets can be positioned along the outer perimeter of a boat or skiff. Preferably at least four brackets positioned along the outer perimeter of a boat or skiff include an opening or loop for receiving a strap extending from the boat outer perimeter to the cockpit outer perimeter corners. In various embodiments at least four such brackets can include a rain fly tie down area (e.g., an opening for the tie down to be threaded through or a raised coupler for the tie down to be coupled to). In some embodiments, the at least four brackets may also include a tent tie down or a pole tie area (e.g., an opening, loop, or raised coupler via which a tie down for one or more poles or for tent sides can be coupled).

In various embodiments a method for providing a tent covering system with a water and/or bug proof seal around an outer perimeter of a cockpit of a small boat or skiff comprises the following steps:

a. providing a tent or cover comprising:
   - a plurality of walls, each of the plurality of walls having a lower portion and wherein the tent is sized to cover the opening of a cockpit;
   - a base layer attached to the lower portion of each of the plurality of walls and positionable at or near deck level around the cockpit, the base layer preferably not extending across or over a recessed area of the cockpit;
   - a compressible sealable layer below the base layer for resting on a deck around the cockpit;
   - a plurality of straps, each of the plurality of straps comprising first and second ends;

the first end of each of the plurality of straps attachable to an outer perimeter of the boat;

the second end of each of the plurality of straps coupled to the tent covering system and attachable to a cockpit;

b. positioning the tent around the cockpit wherein the compressible water and bug proofing layer rests on the deck at or near a cockpit deck lip;

c. attaching the first ends of the plurality of straps at the boat outer perimeter and the second ends of the plurality of straps at the cockpit;

d. applying tension to the plurality of straps to compress the compressible sealable layer to form a water and bug proof seal around the cockpit.

In various embodiments the method further comprises providing a pole bracket housing on at least two of the plurality of straps, wherein the bracket housing is moveable or slidable between one or more positions to enable increasing or decreasing tension of a pole secured therein.

Various embodiments of the method of the present invention includes a method of operating a boat on water, e.g., idling a boat from one location to another, or using poling techniques, with a cockpit tent covering system attached and working to provide a water and bug seal around a cockpit perimeter, while a boat or skiff is moving through water.

In various embodiments of the method, the tent covering system can be assembled on a boat or skiff in open water, or in a marshy area, at a distance away from a boat launch or docking location.

In various embodiments of the method, the tent covering system is assembled after a boat or skiff is launched on water.

In various embodiments of the method, the tent covering system is assembled on a small boat or skiff at least about ¼, ½, ¾ or 1 mile from a launch location or docking station, or between about ¼ and 1 mile away from a launch location or docking station.

In various embodiments of the method and cockpit covering system, a tent covering system is provided wherein straps that can extend from an outer perimeter of a boat or skiff to the cockpit are attached at one end to a rail bracket and attached at another end to a cockpit hook. In various embodiments an end of a said strap can be threaded through an opening on the rail bracket and threaded through a tension buckle, and another end of the said strap can be thread through an opening on a cockpit hook and then sewn to itself, or otherwise coupled to itself (e.g, via a sewn connection or an adhesive) or also threaded through a tension buckle.

In various embodiments an end of a said webbing tension strap can be threaded through an opening on the rail bracket and then coupled to itself, e.g., via a sewn connection or adhesive, and another end of the said strap can be threaded through an opening on a cockpit hook and then threaded through a tension buckle.

In various embodiments, a said strap can be coupled to a rail bracket or a cockpit wall via other means known in the art.

In various embodiments, the method of assembling a cockpit covering system comprises the following steps:

1. Attach corner rail brackets, preferably with tension straps coupled thereto, to a boat outer perimeter, and adjust the tension straps if necessary to release tension so that the other end of the tension strap, preferably with a gunnel or cockpit hook already coupled thereto, can reach the cockpit wall;
2. Open tent entrance/exits;
3. Place gunnel or cockpit hooks on cockpit walls, at cockpit gunwale corners;
4. Adjust tension in tension straps to create proper tension to achieve desired placement of tent base just outside of the cockpit opening, e.g., about 1 to 3 inches from the cockpit opening;
5. Attach any additional rail hooks, preferably with any additional straps attached thereto, to the boat outer perimeter;
6. If any additional straps are also attached to gunnel hooks, place gunnel hocks at cockpit gunwale and apply desired tension to the straps to secure placement of tent base on the deck near the cockpit opening;
7. Assemble poles by placing a selected pole end into a pole bracket housing and repeat until all poles are secured in a pole bracket housing; and
8. Adjust pole tension with pole foot adjustment to achieve desired tension on tent walls.

In various embodiments, preferably rail brackets with tension straps secured thereto are first attached to a windward side of the boat or skiff, then attached to the other side of the boat.

Preferably, after the rail brackets with tension straps connected thereto are positioned around the boat, the cockpit covering system is secured to the boat.

In various embodiments, the method includes further adjusting tension on tension straps until desired pressure and amount of seal of the bug and water proof seal around the cockpit is created.

In various embodiments of the method, a rain fly is assembled over the cockpit tent or cover.

In various embodiments of the method, assembling a rain fly comprises the following steps:

1. Attaching a rain fly strap to a bow line, e.g., a zip tie;
2. Attaching additional rain fly straps to rail brackets;
3. Attaching additional rain fly straps to port and starboard eyelets;
4. Flexing a vestibule pole or stake into foot pockets on starboard and/or port sides and rotating to appropriately spaced clips.

Preferably 4 rain fly straps can be attached to 4 rail brackets at a location exterior of the boat and underneath a boat rail or side.

In other embodiments, couplers can also be provided on tension straps wherein rain fly ties can be coupled to said couplers on a tension strap on the deck of the boat.

In various embodiments, when the cockpit enclosure system is not needed or desired it may be disassembled and stored on the boat, e.g., in a hatch or cabinet.

In one or more embodiments, a method of attaching a tent covering system that provides a water proof seal around a cockpit of a boat comprises the following steps:

a. providing a tent positionable around an outer perimeter of a cockpit, the tent for forming an enclosure around an interior, the tent comprising:

a plurality of wall portions, each of the plurality of wall portions having a lower portion and wherein the tent is sized to extend over a recessed area of a cockpit;

a base layer attached to the lower portion of each of the plurality of walls and positionable on a boat deck around a perimeter of a cockpit;

a compressible layer below the base layer for resting on a deck of the small boat around the cockpit perimeter;

a plurality of straps, each of the plurality of straps comprising first and second ends;

the first end of each of the plurality of straps attachable to an outer perimeter of the boat;

the second end of each of the plurality of straps attached to the tent covering system and attachable at or near the cockpit perimeter;

b. attaching the first ends of the plurality of straps at the boat outer perimeter and the second ends of the plurality of straps at the cockpit outer perimeter;

c. applying tension to the plurality of straps to position the tent base layer and compressible layer on the deck near a cockpit perimeter; and d. applying additional tension if necessary to compress the compressible layer and form a bug and/or water proof seal around the cockpit.

In one or more embodiments, the method further comprises providing a tent pole bracket housing on at least two of the plurality of straps.

In one or more embodiments, the method further comprises securing one or more tent poles to the tent and a tent pole bracket housing to provide support and to the tent.

In one or more embodiments of the method, the tent pole bracket housing is moveable or slidable between one or more positions to enable increasing or decreasing tension of a pole secured therein.

In one or more embodiments, the method includes operating the boat while the tent is attached to the boat and providing a water seal around the cockpit.

In one or more embodiments, the method includes moving the boat through water while the tent is attached to the boat and providing a water seal around the cockpit.

In one or more embodiments of the method, the tent is assembled a distance away from a boat launch point.

In one or more embodiments of the method, the tent is assembled on open water.

In one or more embodiments of the method, the tent covering system is assembled on a boat or skiff in a marsh area at least one mile away from a launch point or dock.

In one or more embodiments of the method, the tent covering system is assembled after a boat or skiff is launched on water.

In one or more embodiments of the method, the tent covering system is assembled on a boat or skiff at least one mile from a launch location.

In one or more embodiments of the method, tension in the straps that forms the water and bug proof seal also secures a tent pole base at or near deck height with restricted or no movement on the deck.

In one or more embodiments of the method, a boat occupant that is at least 5 feet tall can stand on a floor of the cockpit within the interior space.

In one or more embodiments of the method, the cover has a height at least 70 inches above a cock pit floor.

In one or more embodiments of the method, the cover has a height at least 60 inches above deck height.

In one or more embodiments of the method, the water and/or bug seal remains in place while an entrance or exit to the interior space is opened or closed.

In one or more embodiments of the method, the interior space extends below a height of the base layer.

In one or more embodiments of the method, a person that is at least 5.5 feet tall can stand within the interior space.

In one or more embodiments of the method, the person can lie down on the cockpit floor within the interior space.

In one or more embodiments of the method, the amount of seal is adjustable based on the tension in the strap from 5% to 100%.

In one or more embodiments of the method, a recessed area below a height of the base layer is at least 4 inches below the height of the base layer.

In one or more embodiments of the method, a recessed area below a height of the base layer is about 4 inches to 40 inches below the height of the base layer.

In one or more embodiments, an enclosure system for a boat comprises:

a) a cover comprising a plurality of wall portions and a base for resting on a deck of the boat, and wherein the cover is sized to enclose an interior space on the boat;

b) a plurality of straps coupled to the cover;

c) one or more exterior fittings, each attachable to the boat at a position that is exterior to said cover wall portions;

d) wherein at least some of the plurality of straps extend away from the cover to a said exterior fitting; and e) wherein at least some of the plurality of straps extend interior to the cover to an interior fitting on the boat that is located in the interior space.

In one or more embodiments, the system comprises a plurality of poles, each of the plurality of poles having a pole end coupled in a housing on the base of the cover.

In one or more embodiments of the system, at least one of the plurality of poles extends from one cover side to another cover side and crosses over another of the plurality of poles.

In one or more embodiments system includes a plurality of poles, each of the plurality of poles having a pole end coupled in a housing on one of the plurality of straps that extend exterior to the cover.

In one or more embodiments of the system, at least one of the plurality of poles extends from one cover side to another cover side and crosses over another of the plurality of poles.

In one or more embodiments of the system, the base includes a compressible material for resting on the deck of the boat.

In one or more embodiments of the system, applying tension to at least one of the plurality of straps that is exterior to the cover compresses at least a portion of the compressible material against the deck of the boat.

In one or more embodiments of the system, the compressible material pressed against the deck of the boat forms a seal.

In one or more embodiments of the system, the compressible material pressed against the deck of the boat forms a water and/or bug seal.

In one or more embodiments of the system, the cover encloses a cockpit of the boat and a floor of the cockpit defines a floor for the enclosure system.

In one or more embodiments of the system, the compressible material is a neoprene gasket.

In one or more embodiments of the system, at least some of the plurality of straps extending exterior to the cover include a tension buckle adapted for increasing or reducing tension of said straps.

In one or more embodiments of the system, said exterior fittings are c-clamps.

In one or more embodiments the system, includes a plurality of interior poles.

In one or more embodiments the system, the system does not include interior poles.

In one or more embodiments the system, at least a portion of the base is wrapped in a water proof or water resistant material.

In one or more embodiments the system, the base is a skirt extending exterior to the cover.

In one or more embodiments the system, the base is formed from a water proof material or a water resistant material.

In one or more embodiments, a tent covering system for a cockpit of a boat comprises:

a) a tent including a plurality of side wall portions and a base attached to said side wall portions, wherein the tent is sized and shaped to cover an opening of the cockpit and an interior space;

b) the base including a compressible layer for resting on a deck surface of the boat at least along one of said side wall portions of the tent;

c) a plurality of straps attached to the cover, wherein at least some of the straps extend to the exterior of the tent to connect with an exterior fitting on the boat that is exterior to the tent;

d) wherein at least some of the plurality of straps extend from the tent to a fitting within the interior space; and e) wherein tension applied to at least one of the straps and fittings compresses the compressible layer against at least a portion of the deck.

In one or more embodiments the system, one or more inserts can be included in the base on any side portion that does not include the compressible layer.

In one or more embodiments, a method of assembling a tent covering system adapted for providing a seal along at least a portion of a cockpit of a boat, the method comprising the following steps:

a) providing a tent positionable on a deck at or near the cockpit, wherein the tent is sized to extend over the cockpit, the tent for forming an enclosure around an interior space, said tent having:

i) a plurality of wall portions and a base for resting on the deck of the boat;

ii) a plurality of straps attached to said tent;

iii) a plurality of fittings including one or more exterior fittings and one or more interior fittings, each said fitting attachable to the boat and to a said strap;

iv) wherein at least some of the plurality of straps extend from the tent to a said exterior fitting on the boat that is exterior to the tent; and v) wherein at least some of said straps extend from the tent to a said interior fitting on the boat within the interior space; and b) applying tension to at least to one of said straps attached to a said fitting to compress at least a portion of the compressible layer against the deck.

In one or more embodiments of the method, one or more tent pole housings are included on the base.

In one or more embodiments of the method, the method further includes securing one or more tent poles to a tent pole housing.

In one or more embodiments of the method, the method further includes moving the boat through water while the tent is attached to the boat and providing a seal around at least some portions of the cockpit outer perimeter.

In one or more embodiments of the method, the seal is a water and/or bug seal.

In one or more embodiments of the method, the tent is assembled a distance away from a boat launch point.

In one or more embodiments of the method, the tent is assembled on open water.

In one or more embodiments of the method, the tent is assembled on the boat in a marsh area at least one mile away from a launch point or dock.

In one or more embodiments, a cockpit enclosure system for a boat, comprises:

a) a cover comprising a plurality of wall portions and a base, and wherein the cover is adapted to enclose an interior space;

b) the base positionable on a deck of the boat around the cockpit;

c) a plurality of straps coupled to the cover;

d) a plurality of fittings, each said fitting attachable to the boat and to a said strap, one or more of said fittings being exterior fittings spaced away from said tent;

e) wherein at least some of the plurality of straps extend from the cover to a said exterior fitting; and f) wherein tension applied to said straps extending from the cover to the exterior fitting causes at least a portion of the base to press against the deck of the boat.

In or more embodiments, a fitting for use in securing a tent covering system to a boat, the fitting comprising:

a body having a c-shape adapted for coupling to an outer perimeter of a boat hull;

a clamp for loosening or tightening the fitting to the boat hull; and a rotating member adapted to receive a strap of a tent, the rotating member having a rotating connection with the body.

In one or more embodiments of the fitting, the fitting includes a cushioning material in at least some areas that will make contact with boat surfaces.

In various embodiments, a tent/cover base is a skirt. In various embodiments the skirt extends exterior to the cover. In various embodiments, the skirt extends interior and exterior to the cover.

In various embodiments, a tent/cover base is made of the same material as the tent.

In various embodiments, a tent/cover base is made of the same material as the tent and includes a compressible material.

In various embodiments, a tent/cover base is made of a different material from the tent and includes a compressible material.

In various embodiments, a tent/cover base is made of the same material as the tent and includes a material that can be pressed against the deck of a boat.

In various embodiments, a tent/cover base is made of the same material as the tent and includes a layer of compressible material.

In various embodiments, a tent/cover base can be pressed against the deck of a boat.

In various embodiments, a tent/cover base is made of a compressible material.

In preferred embodiments, boat fittings, e.g., brackets, c-clamps, and hooks are made of a plastic material.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
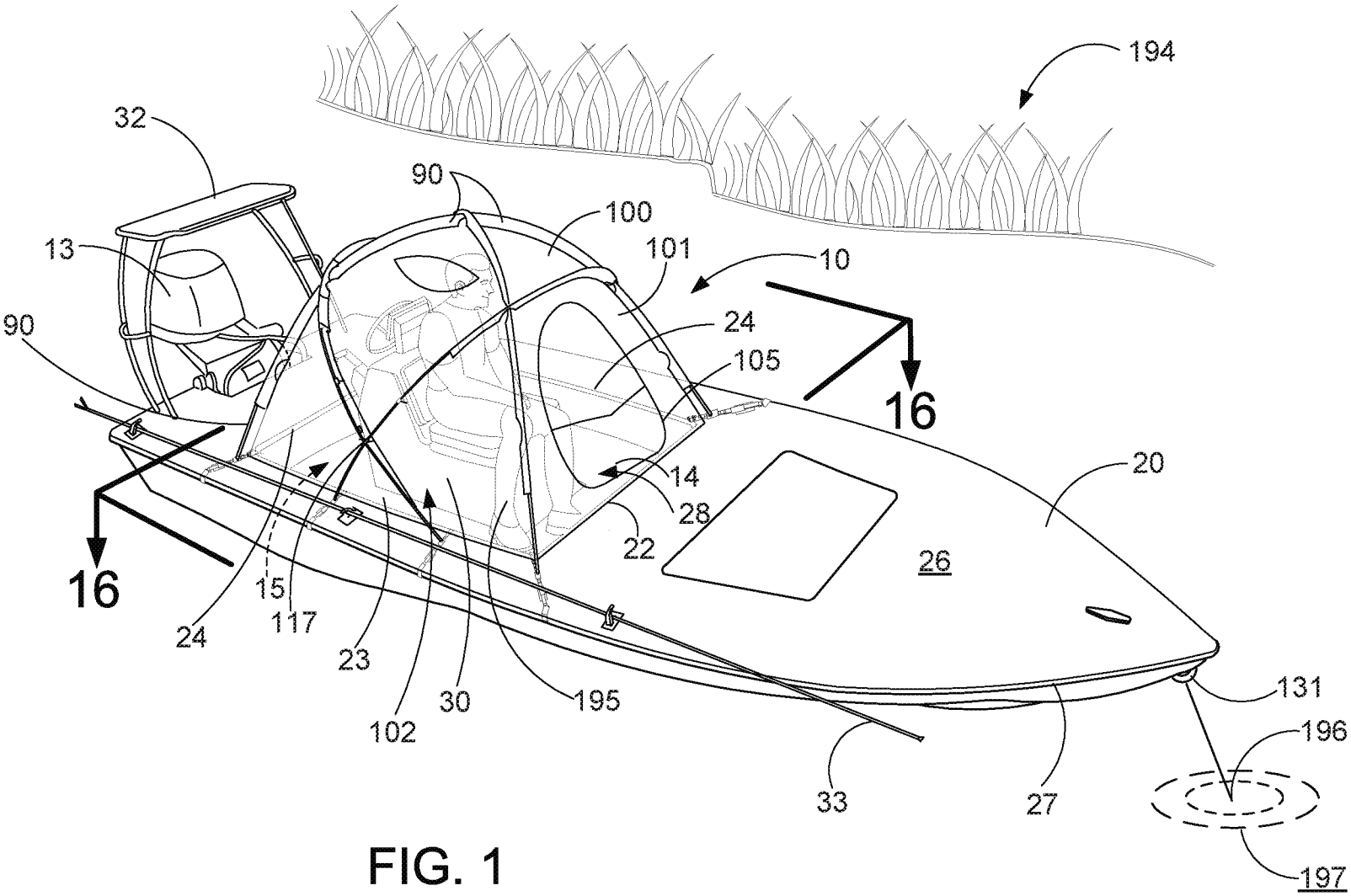
FIG. 1 is a perspective view illustrating a first preferred embodiment of a tent covering system of the present invention assembled on a small boat or skiff that does not include seats at or near a cockpit edge.
Figure 2:
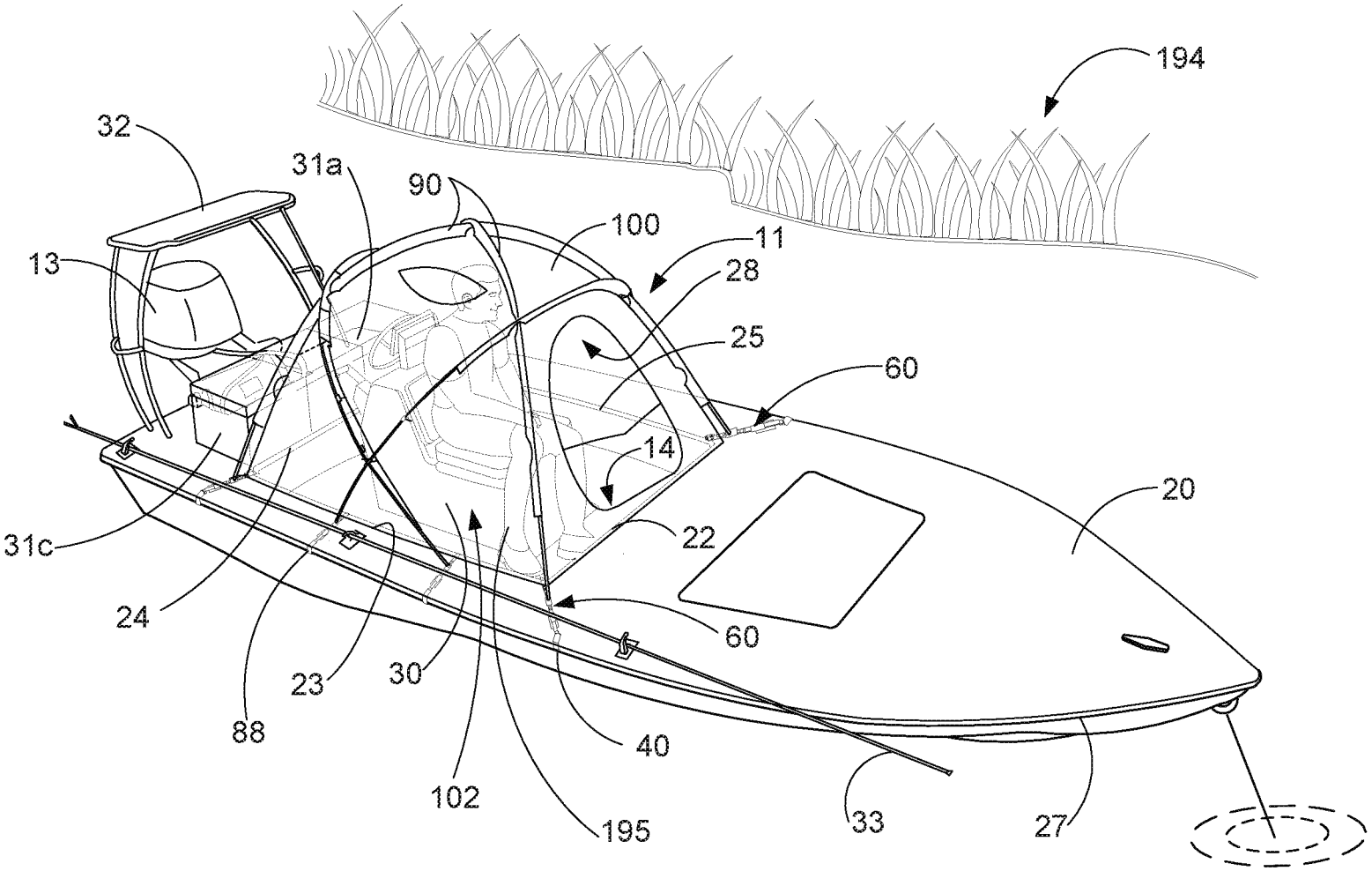
FIG. 2 is a perspective view illustrating a second preferred embodiment of a tent covering system of the present invention assembled on a small boat or skiff that includes seats at or near a cockpit edge.
Figure 3:
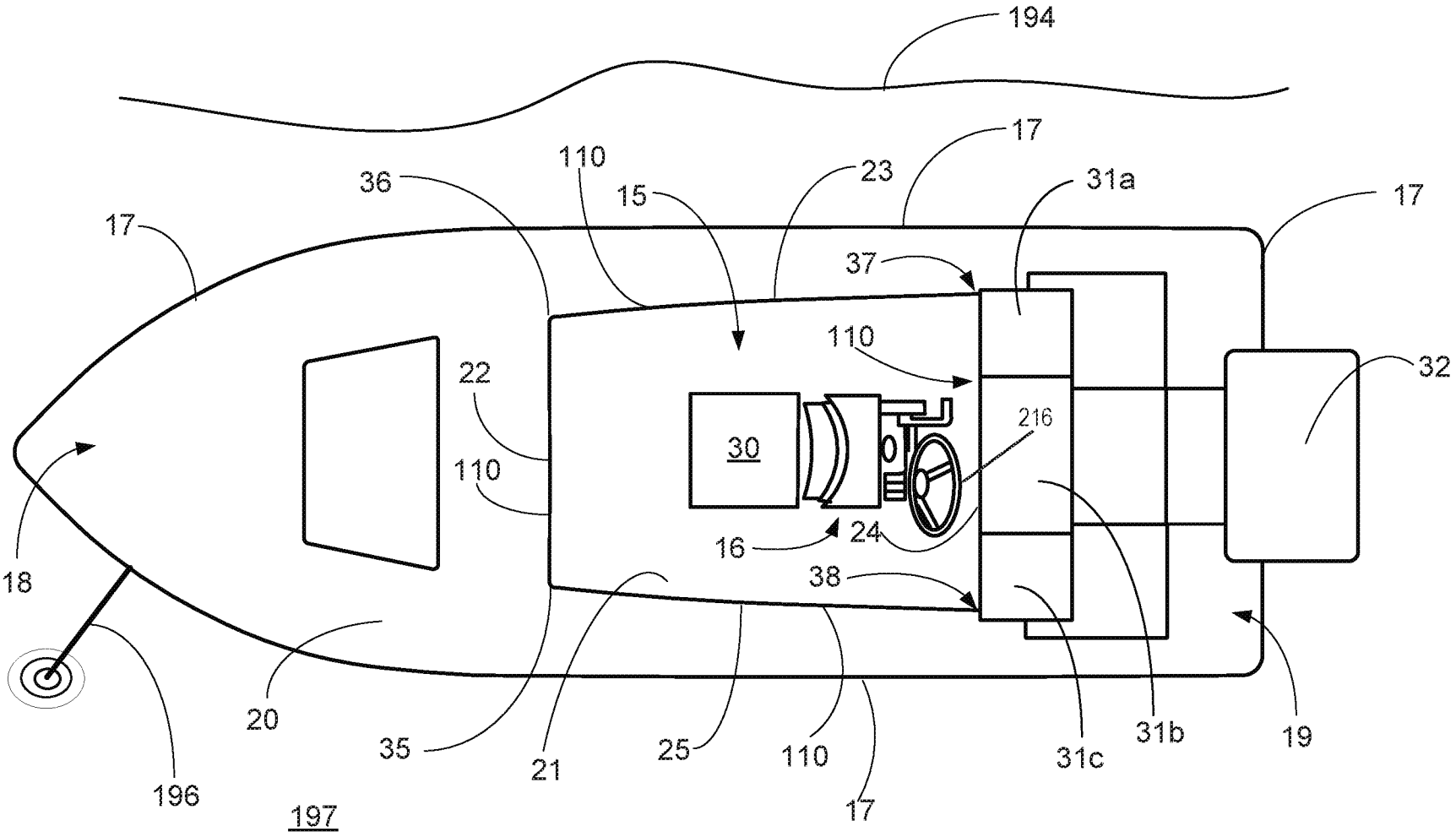
FIG. 3 is a top view of a small boat or skiff on which the second preferred embodiment of the tent covering system of FIG. 2 can be assembled.

FIGS. 1-3 illustrate a common small hunting and fishing boat or skiff 20 that can be used with various embodiments of the method and system of the present invention. The skiff in FIGS. 1-3 for example, can be a Hell's Bay Boatworks® skiff (a registered trademark of Hells Bay Boat Works Co.).

As shown in FIGS. 1-3, small boat or skiff 20 includes a deck 26 and a cockpit 21, wherein cockpit 21 comprises a recessed area 15 with a floor 14. Skiff 20 has a bow or forward portion 18, an aft or rear portion 19, and an outer perimeter 17. A skiff outer rail or outer lip 27 can define an outer perimeter 17 of skiff 20. A cockpit 21 typically is substantially rectangular in shape, but can also comprise other shapes. In various embodiments a tent covering system 10 of the present invention can be adapted or modified from the embodiment as shown and depicted herein to provide an enclosed interior around a cockpit of a boat, for other boats having cockpits of different sizes or shapes. For example, dimensions of rail brackets, cockpit hooks, tensions straps, tent walls, and the tent sealable layer and base layers can be modified to enclose a cockpit and fit a particular boat for which the tent covering system will be utilized.

In the embodiment as shown in the figures, a cockpit 21 includes a front or bow side 22, a starboard side 23, a rear or aft side 24 and a port side 25. Cockpit 21 can be an irregular rectangle. Cockpit 21 also includes corners or bends 35, 36, 37, 38 which commonly have a radius of curvature. A cockpit 21 also generally has a deck lip portion 85 extending around an outer perimeter 110 of cockpit 21 (see FIGS. 3, 6B, 7). A gunwale, gunnel or cockpit wall 39 typically extends a distance downwards from deck 26 at or near deck lip 85 on each side 22, 23, 24, 25 of cockpit 21 into recessed area 15 of cockpit 21. Recessed area 15 of cockpit 21 typically can include a chair or seat 30 and a steering station 16 as shown in FIGS. 1-3.

One or more seats can be included on some boats or skiffs at or near a cockpit 21 edge. For examples, seats 31*a*, 31*b* and 31*c* as shown in FIGS. 2 and 3 can be included at or near a rear edge of cockpit and such seats 31*a*, 31*b* and/or 31*c* can commonly open to a storage area, e.g., hatch 262. A guide seat 32 and pole 33 are also commonly included on a boat or skiff 20 and are illustrated in FIGS. 1-3. A motor 13 is also commonly included on a rear or aft 19 portion of a boat or skiff 20.

Figure 16:
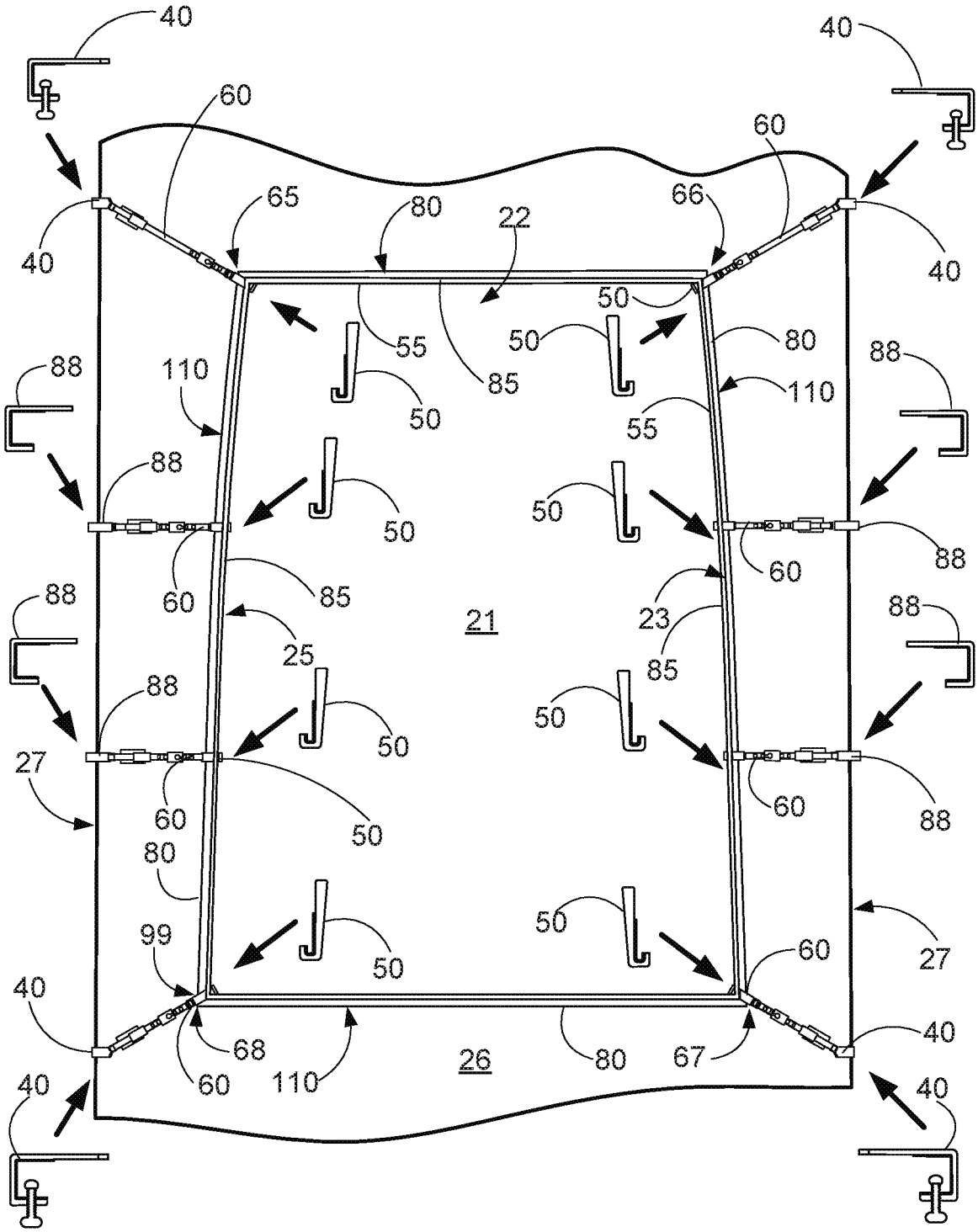
FIG. 16 illustrates a tent base portion coupled to a boat or skiff taken along lines 16-16 of FIG. 1, and also illustrates possible locations where rail brackets can be coupled to a boat skiff outer rail and where hooks can be coupled at a cockpit in one or more preferred embodiments of the system and method of the present invention.

FIGS. 1 and 2 illustrate two different embodiments of a cockpit covering system. FIG. 1 illustrates a cockpit covering system 10 that can be used with a boat that does not have seats located at or near a cockpit edge. FIG. 2 illustrates a cockpit covering system 11 that can be used with a boat that has one or more seats at or near a cockpit edge, e.g., on a rear cockpit edge as shown. It is also possible that a cockpit covering system as shown in FIGS. 1, 16 could also be utilized on a boat that has a seat at or near a cockpit edge, with a tent base portion and compressible sealing layer pushed under a seat and held in place with a plurality of tension webbing straps on the boat deck.

In the tent covering system 10 shown in FIG. 1, a tent or cover 100 is positioned over and around cockpit 21 of boat or skiff 20 to enclose an interior 28. Tent 100 can be made from a continuous piece of material, e.g., nylon or polyester. Tent 100 can also be made from a piece of material sewn together along at least one sew line, or made from more than one piece of material sewn or otherwise coupled together, e.g., with adhesive, to form a tent 100. Tent 100 preferably is coupled to skiff or boat 20 via a plurality of tension webbing straps 60 that are coupled at one end to a plurality of brackets/exterior fittings/c-clamps 40 or 88 at outer rail or lip 27 of skiff 20, and which tension straps are also coupled to a plurality of cockpit couplers/interior fittings/hooks 50 for coupling to a cockpit wall at the other end, said cockpit couplers/interior fittings/hooks 50 hooked under one or more cockpit walls 39.

Tent 100 includes a base portion 34 that can rest on deck 26 around the cockpit perimeter 110. One or more wall portions, e.g., a forward or bow wall portion 101, starboard wall portion 102, rear or aft wall portion 103, and port wall portion 104, extend from the base portion 34 to a height above deck 26 and form an enclosure above the cockpit recessed area 15. Poles 90 can be coupled to the tent wall portions, e.g., coupled to wall portions 101, 102, 103, 104, e.g., via twist hooks or clips 117. Ends of poles 90 can be coupled in pole bracket housings on tension straps 60. Poles 90 can support tent 100 and maintain tent 100 at a desired height above cockpit 21.

Figure 7:
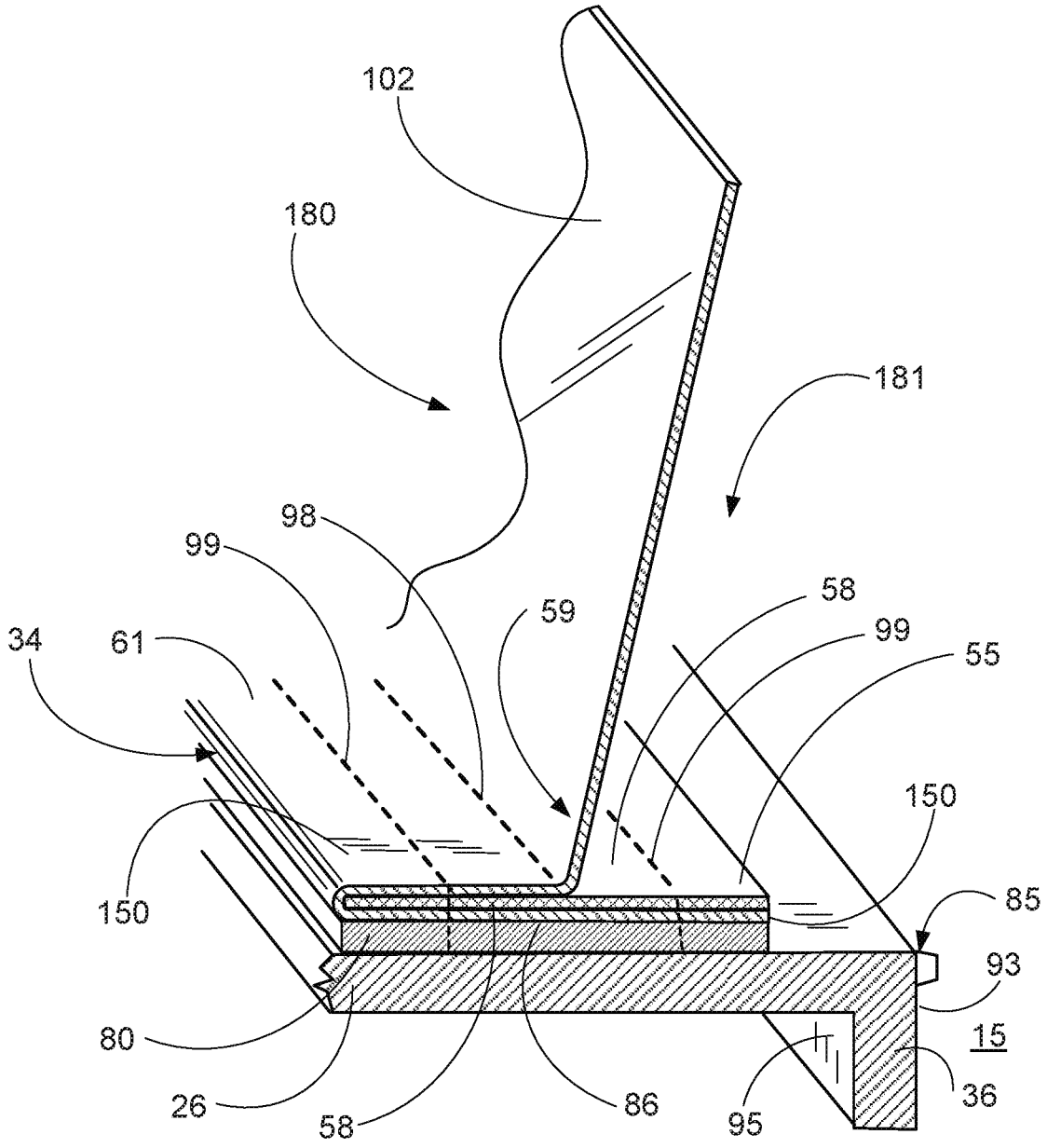
FIG. 7 is a cutaway view illustrating a tent base portion on a sealable layer on a deck of a boat or skiff, near a cockpit edge in a preferred embodiment of the present invention, taken along lines 7-7 of FIG. 4.
Figure 18:
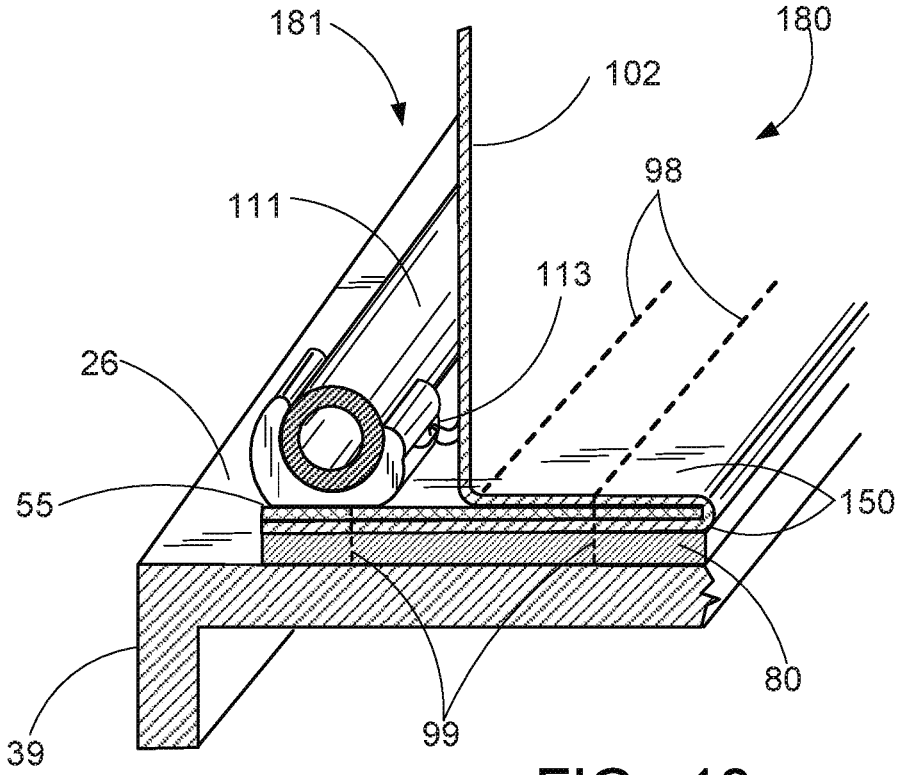
FIG. 18 is a cutaway view illustrating an interior tent pole and clip or bracket taken along lines 18-18 of FIG. 17.
Figure 19:
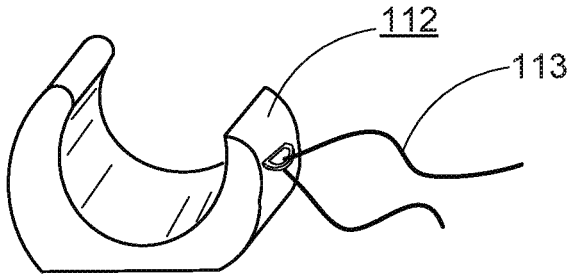
FIG. 19 illustrates an interior pole bracket housing as shown in FIG. 18.
Figure 20:
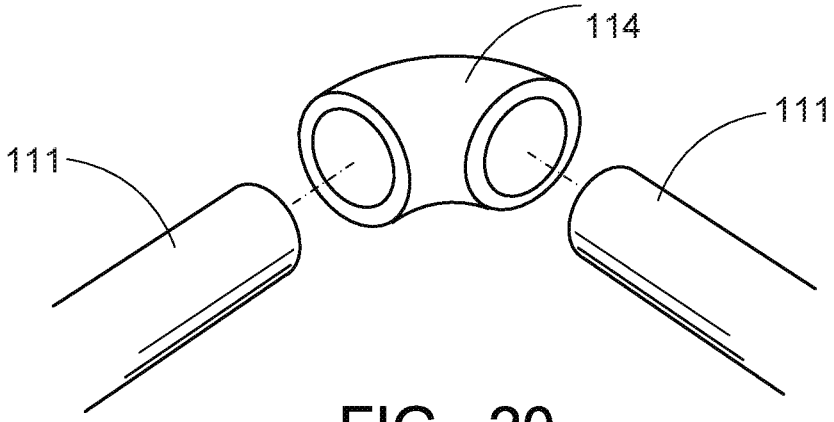
FIG. 20 illustrates a corner sleeve or pocket that can receive interior pole or stake end portions in one or more preferred embodiments of the apparatus, system and method of the present invention.
Figure 21A:
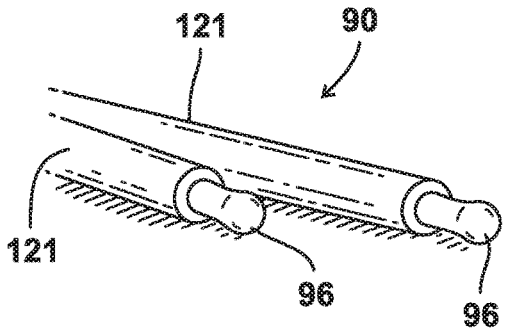
FIG. 21A illustrates prior art tent pole ends.

As shown in FIG. 7, tent base portion 34 preferably includes a tent base webbing layer 55. Tent base webbing layer 55 can be of the same material as tension webbing strap 60. Preferably a lower portion 150 of the tent wall or wall portions, e.g., of tent wall portions 101, 102, 103, 104, is coupled to at least an upper side of the tent base webbing layer 55, and wraps around a portion of the tent base webbing layer 55 (preferably towards exterior 180) and under the tent base webbing layer 55. Lower portion 150 of a tent wall coupled to and wrapping around tent base layer 55 together can define tent base portion 34. Tent base webbing layer 55 can be attached to tent wall portion 150 on each wall portion 101, 102, 103, 104 around an entire perimeter of tent 100, e.g., via sewing at sew line 98 (see FIGS. 7, 16, 18). Alternatively an adhesive could be applied to couple lower tent wall portion 150 to tent base webbing layer 55, and such an adhesive could be applied to the entire area where the lower tent wall portion 150 wraps around and under tent base webbing layer 55, or to less than the entire area where the tent wall portion 150 wraps around and under tent base webbing layer 55.

Figures 6A, 6B:
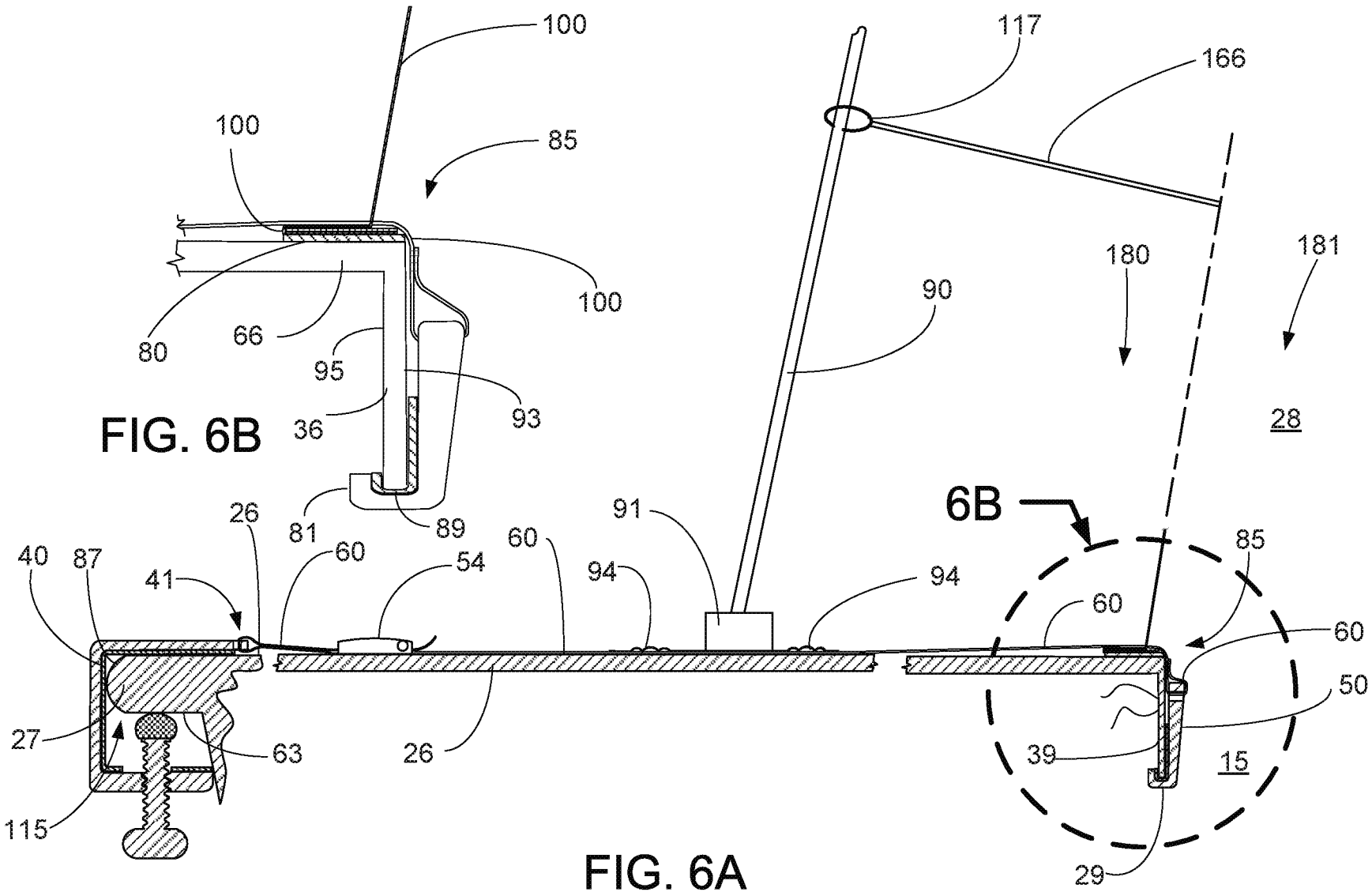
FIG. 6A is a cutaway view of a tent covering system taken along lines 6A-6A of FIG. 4.
FIG. 6B is an enlarged view of a gunnel or cockpit hook on an interior cockpit wall and coupled to the tent covering system as shown in FIG. 6A.

A sealable layer 80 is preferably coupled under tent base portion 34, e.g. under the lower tent wall portion 150 coupled to the tent base webbing layer 55 as shown in FIGS. 6A, 6B, and 7. The sealable layer 80, which preferably is a compressible water proofing and/or bug proofing layer can rest on deck 26 around an outer perimeter 110 of cockpit 21. Sealable layer 80 can be a neoprene gasket or another type of compressible material, e.g., comprising foam that is preferably water proof, e.g., wherein water cannot be absorbed by or penetrate the sealable layer 80. Sealable layer 80 can also be made of a material that is water resistant.

Sealable compressible layer 80 preferably is coupled to base portion 34, e.g., via an adhesive or sewn connection. Sealable layer 80 can be connected to base portion 34 between lines 99 designating an attachment area as shown in FIG. 7. On an interior 181 tent side, a sewn connection at line 99 can be stitched through the base layer 55, the lower tent wall portion 150 under base layer 55 and the sealable layer 55. On an exterior 180 tent side, a sewn connection at line 99 can be stitched through the lower tent wall portion 150 on top of tent base webbing layer 55, the tent base webbing layer 55, the tent wall portion 150 below tent base webbing layer 55, and sealable layer 55. Alternatively, sealable layer 80 could be coupled to tent base portion 34 via an adhesive securing the sealable layer 80 to the lower tent wall portion 150 under layer 55. The adhesive could extend between lines 99, or extend across the entire width of the lower tent wall portion 150 under tent base webbing layer 55. Tent base webbing layer 55 preferably is included in tent base portion 34 to promote a flat lie of tent or cover 100 on sealable layer 80.

Referring now to FIG. 16, the figure is taken along lines 16-16 of FIG. 1 and depicts a tent base portion 34 along with tension straps 60 secured to a boat 20 at or near deck level 26. As shown, preferably at or near tent 100 corners 65, 66, 67, and 68, tension straps 60 are secured to tent or cover 100. A tension strap 60 can be secured to tent or cover 100 in between tent base portion 34 and gasket layer 80 (see FIG. 16), e.g., via an adhesive and/or sewing. In FIG. 16, base webbing layer 55 is depicted as having a shorter width than sealable layer 80. The lower portion 150 of a tent wall 150 is also not shown in this view, for clarity. As previously mentioned, although base webbing layer 55 can have a shorter width than sealable layer 150, preferably the width of base webbing layer 55 and sealable layer 80 are the same or similar. Also note that in the figure the tent base portion 34 and sealable layer 80 appear to be right at the edge of cockpit 21. Although the tent base portion 34 and sealable layer 80 can be sized to be positioned at an edge of cockpit 21, preferably the tent base portion 34 and sealable layer 80 are sized to be positioned on deck 26 a distance away from an edge of cockpit 21, e.g., about 1 to 3 inches away from an edge of cockpit 21.

Each tension strap 60 may also be threaded through a sealable opening at one or more tent corners 65, 66, 67, 68 above the location where lower tent portion 150 wraps around tent base webbing layer 55 (see FIGS. 6A-6B). If attached in the manner as shown in FIGS. 6A-6B, the webbing strap can be threaded through an opening in wall portions at tent corners 65, 66, 67, 68 and then the opening around said strap 60 can be sealed or sewn or otherwise coupled to the strap 60 to preferably form a bug and/or water proof seal at the location where the strap 60 is threaded through the tent walls at corners 65, 66, 67, 68.

Tension straps 60 can also be coupled to tent cover 100 in a manner as described above at locations other than tent corners, e.g., tension straps 60 coupled to brackets 88 as shown in FIG. 1, 16, wherein a webbing tension strap 60 can be coupled to tent 100 between lower portion 34 of tent 100 and sealable layer 80, or wherein a webbing strap 60 at such locations can be coupled to tent 100 in the manner as shown in FIGS. 6A-6B, wherein a tension strap 60 is threaded through an opening in a tent wall portion 102 or 104 and then preferably sealed to form a bug and/or water proof attachment at the location where the strap 60 is threaded through the tent wall 102 or 104.

In various embodiments a sealable compressible layer 80 can be removably attachable to tent or cover 100, e.g., via velcro. In various embodiments, a sealable compressible layer 80 is not removably attached to tent or cover 100. In various embodiments a sealable compressible layer 80 can be a separate component of the tent system 10 for positioning on a deck 26, around a cockpit 21 underneath a tent or cover 100 base portion 34.

A sealable layer 80 may comprise one or more portions that are compressible and one or more portions that are not compressible.

Preferably, sealable layer 80 and tent base webbing layer 55 comprise the same width, although this is not required. In various embodiments the sealable layer 80, and tent base webbing layer 55 are about 1 to 2 inches wide.

Preferably sealable layer 80 is sized to rest on deck 26 at or near perimeter 110 of cockpit 21. Sealable layer 80 can be positioned on deck 26 a distance away from cockpit lip 85 around sides 22, 23, 24, 25 of cockpit 21, e.g., about 0.5 to 2 or 3 inches away from cockpit lip 85 on each side 22, 23, 24, 25 of cockpit 21. Preferably tent 100 base portion 34 is sized to be coupled to sealable layer 80. As previously discussed, the dimensions and shape of sealable layer 80 can be selected based on the dimensions and shape of the cockpit.

Preferably the tent base webbing layer 55 and/or base portion 34 of tent 100 are also sized to be coupled to at least an upper portion 86 of sealable layer 80 (see FIG. 7). As mentioned, the dimensions and shape of tent base webbing layer 55 and base portion 34 and of tent 100 can be selected based on the dimensions and shape of the cockpit and/or based on the dimensions and shape of a selected sealable layer 80.

In FIG. 7, arrow 59 represents a location where a tent wall lower portion 150 of wall 102, for example, can be attached at top portion 58 of webbing layer 55, at line 98 which can be at or a near a center of tent base layer 55. As shown, lower portion 150 of each wall portion 101, 102, 103 and 104 can be longitudinally and centrally attached to tent base layer 55.

Tent base layer 55 promotes a flat lie of tent or cover 100 on sealable layer 80 on deck 26 of boat or skiff 20, around a cockpit 21.

For a tent covering system sized for use with a Hellsbay Boatworks Skiff, the width of a forward wall portion 101 extending along bow cockpit side 22 can be about 46.5 inches when the width of bow cockpit side 22 is about 42.5 inches, so that each end of forward wall portion 101 will extend across deck 26 about two inches further than cockpit side 22 on each side of cockpit side 22. Rear or aft wall 103 can have a width of about 54.5 inches when the cockpit rear side 24 is about 48 and ¾ inches, so that each end of rear wall 103 extends across deck 26 about 2.88 inches further than cockpit side 24 on each side of cockpit side 24. Tent walls 102 and 103 can have a width of about 84 inches when cockpit sides 23, 25 are about 78.5 inches long. The tent walls 102, 104 can extend across deck 26 about 2.75 inches more on each side of cockpit sides 23, 25. As discussed, the dimensions of the tent walls can vary based on the dimensions of a cockpit 21 on a boat or skiff 20, with tent base sides or corners preferably extending about 1 to 3 inches away from a cockpit outer lip 85.

As discussed, a lower portion 150 of each tent wall portion 101, 102, 103, 104 (see FIGS. 7, 16) can be coupled to webbing layer 55, e.g., about centrally, at a top 58 of tent base webbing layer 55. Tent base webbing layer 55 preferably is generally rectangular and sized to rest on sealable layer 80, positionable on deck 26 around a perimeter 110 of cockpit 21 at or near cockpit deck lip 85.

Some of the webbing tension straps 60 preferably have a length that is sized to at least extend from a gunwale hook or cockpit interior wall hook 50 (which is preferably positionable on a cockpit wall 39 at a bend or corner 35, 36, 37, or 38 (see FIGS. 6A-6B, 16) of a cockpit 21) to a bracket 40 positionable on an outer rail or lip 27 of a boat or skiff 20.

Figure 17:
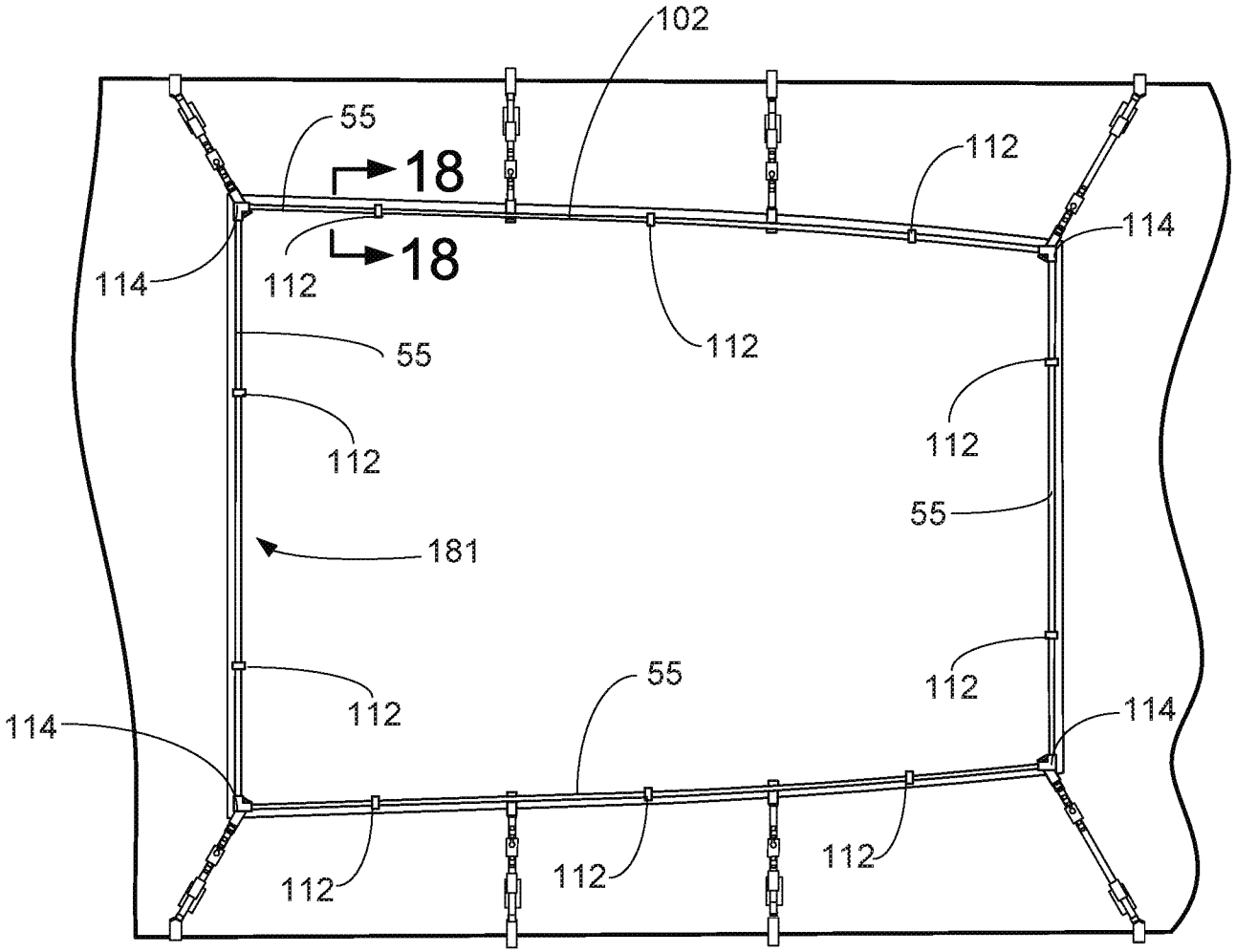
FIG. 17 is a cutaway top view of a tent base portion positioned on a deck of a boat or skiff illustrating possible locations of interior tent pole or stake clips or housing and corner sleeves or pockets in one or more preferred embodiments of the apparatus, system and method of the present invention.

Some of the webbing tension straps 60 preferably have a length that is sized to at least extend from a hook 50 (which is preferably positioned on a cockpit wall 39 at a location between a bend or corners of cockpit 21 (see FIGS. 6A-6B, 17), to a bracket 88 positioned on an outer rail or lip 27 of a boat or skiff 20.

Preferably the length of a said webbing tension strap 60 is longer than the distance between a said boat gunwale hook 50 positionable at a cockpit wall 39 at a corner location and bracket 40 positionable on outer rail or lip 27, or longer than the distance between a said hook 50 positionable at a cockpit wall 39 between cockpit corners and a bracket 88, so that tension in the strap 60 can be increased or decreased as necessary to secure tent 100 in place on deck 26 and over cockpit 21. Preferably the length of a tension strap 60 allows room for tension of the strap 60 to be adjusted, e.g. increased or decreased from 0.01% to 100%.

As shown in FIGS. 6A, 6B, and 16, a tension webbing strap 60 can extend from a distance away from exterior side 180 of tent or cover 100 to a distance away from interior side 181 of tent or cover 100. In various embodiments, a tension webbing strap 60 can extend from at or near a boat outer rail 27 to at or near cockpit lip 85. In various embodiments, tension webbing strap 60 can extend from at or near a boat outer perimeter 17 to at or near a cockpit perimeter 110. In various embodiments, a tension webbing strap 60 can extend from at or near the boat outer perimeter 17 to a distance interior of the cockpit perimeter 110.

Figure 10A:
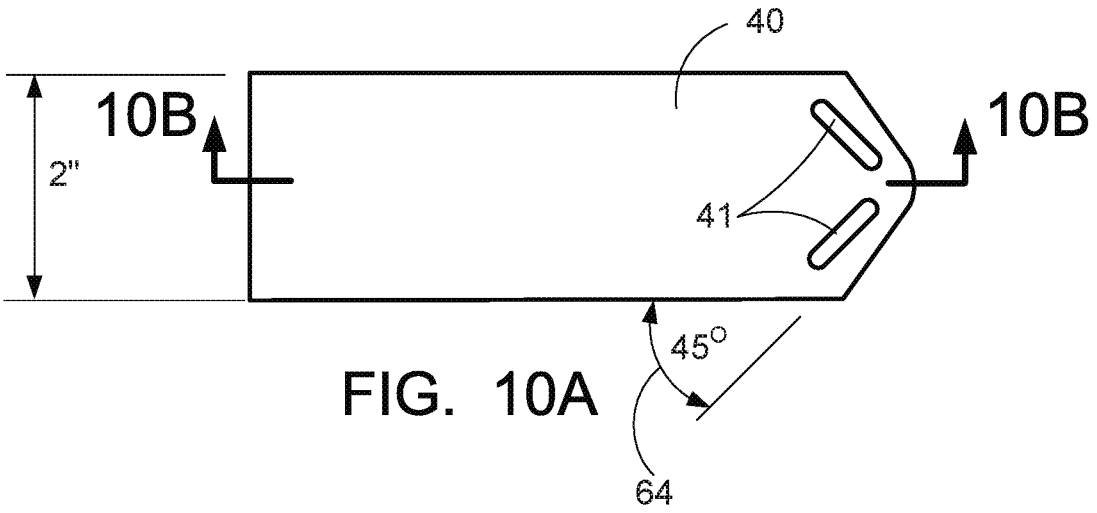
FIG. 10A is atop view of a first preferred embodiment of a rail bracket that can be used with one or more preferred embodiments of a tent covering system of the present invention.
Figure 10B:
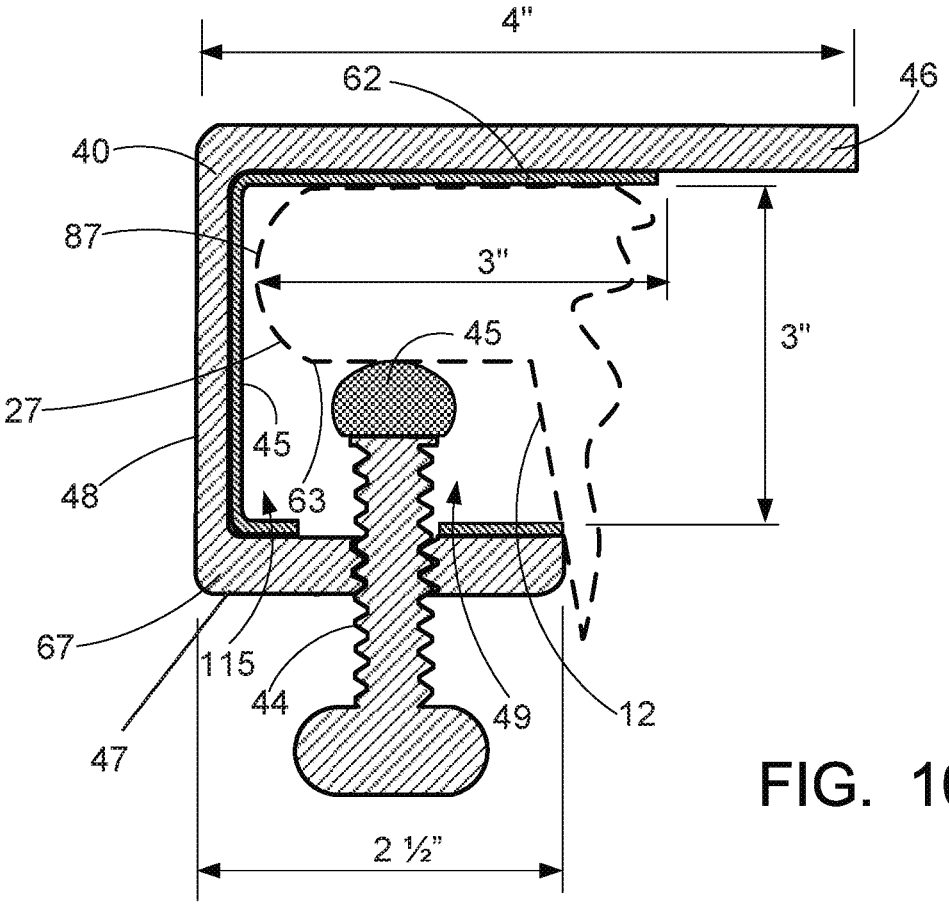
FIG. 10B illustrates the first embodiment of a rail bracket positioned on a boat rail and taken along lines 10B-10B of FIG. 10A.

FIGS. 10A and 10B illustrate a preferred embodiment of a bracket 40, and example dimensions for a bracket 40, for positioning on an outer rail or lip 27 of boat or skiff 20, said rail or lip 27 generally having a radius of curvature 87. A top view of bracket 40 is shown in FIG. 10A. FIG. 10B is a view of bracket 40 taken along lines 10B-10B of FIG. 10A, and depicts a side view of bracket 40 on an outer rail or lip 27 of boat 20.

A rail or lip 27 at an outer perimeter 17 of a boat 20, commonly extends about 2.5 inches beyond a boat outer wall 12 towards an exterior 115 of a boat or skiff 20. A rail or lip 27 may also laterally extend about 2 to 3 inches towards boat exterior 115 off a deck 26 of a boat or skiff 20. The height of a rail or lip for a rail top side 62 to a rail bottom side 63 commonly can be about 2 inches. The height of rail or lip 27 from top side 62 to bottom side 63 may also be about 1 to 3 inches, for example.

A side view of bracket 40 attached to a boat rail 27, taken along lines 10B-10B of FIG. 10A is illustrated in FIG. 10B. As shown, bracket 40 can comprise a C-shape having upper and lower transverse members 46 and 47, with center member 48 extending downward from upper transverse member 46 to lower transverse member 47. Upper transverse member 46 preferably includes one or more openings 41, wherein one of said openings can receive a tension webbing strap 60 extending from a cockpit corner 35, 36, 37, or 38. The other opening 41 can be left unused, or can potentially receive a tent pole tie down or other tent tie down. In the configuration of bracket 40 as shown in FIG. 10A, preferably an opening 41 is positioned on bracket 40 at an angle, e.g., at or about a 45 degree angle, as indicated by arrow 64, for receiving a tension webbing strap 60 extending at an angle from a corner 35, 36, 37, or 38 of cockpit 21. Alternatively, an opening on bracket 40 can be positioned laterally across a width of bracket 40, similar to the opening shown in bracket 88 in FIG. 12A, although this is not preferred for a bracket receiving a tension webbing strap 60 extending from a corner of cockpit 21 at an angle.

Opening or space 49 between lower transverse member 47 and upper transverse member 46 can receive a rail or lip 27 of boat or skiff 20. The dimensions of bracket 40 can vary depending on the dimensions of a rail or lip 27 of a boat or skiff 20 and/or the shape of a rail or lip 27 of a boat or skiff 20. As shown in FIG. 10B, when bracket 40 is positioned on lip or rail 27 of boat or skiff 20, center member 48 is positioned along exterior 115 side of boat or skiff 20, along a radius of curvature of rail or lip 27. Upper transverse member 46 with openings 41 can extend a distance onto deck 26, preferably at deck level and with openings 41 sized to receive or accommodate a webbing strap 60 therethrough. Preferably a cushioning material, e.g., rubber 45 or a foam material, is provided on surfaces of members 46, 47, 48 of bracket 40 that will be in contact with rail or lip 27 or other boat surface, which commonly can be fiberglass.

Bracket 40 also preferably comprises an adjustable tightening means, e.g., bolt 44, to enable a tight fit of bracket 40 on lip or rail 27. Preferably any portion of the bolt 44 that will contact the rail or lip 27 or skiff 20 surface will have a cushioning layer, e.g. rubber 45.

If a rain fly 130 is included, a rain fly tie down can be tied to bolt 44. In other embodiments, a lower transverse member 47 can comprise another opening or a raised coupler, that can be coupled to a rain fly 130 tie down.

Figure 4:
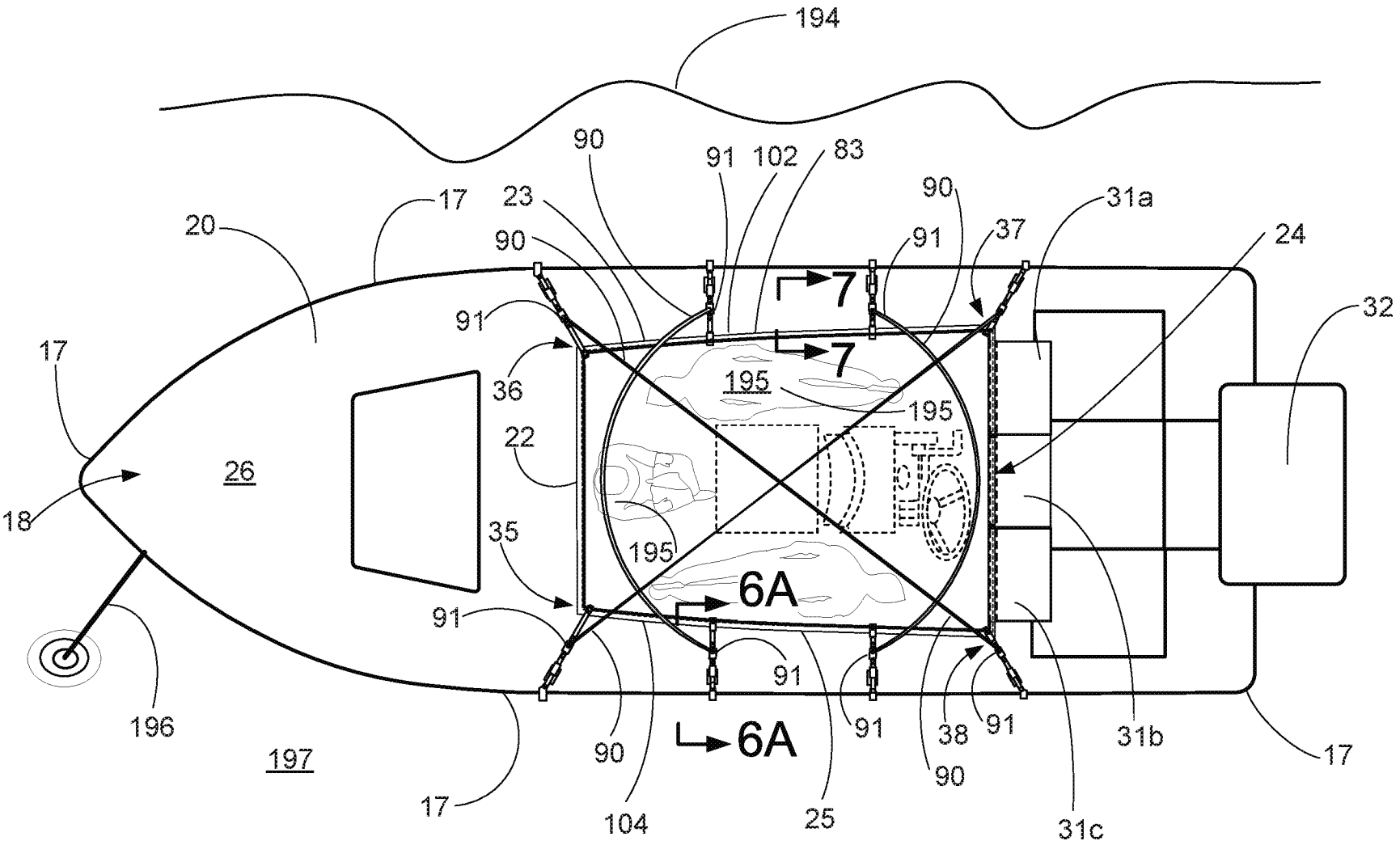
FIG. 4 is a top view of the second preferred embodiment of a tent covering system of the present invention assembled on a small boat or skiff and illustrating possible positioning of exterior poles for supporting the tent or cover.

As illustrated in FIGS. 4, 6A, a webbing tension strap 60 is threaded through an opening 41 of a bracket 40 in a direction from the bottom of upper member 46 to the top of upper member 46, and then tension strap 60 is threaded through a tension buckle 54 located on webbing strap 60. In various embodiments, a covering system 10 or 11 will be provided with each tension strap 60 already through an opening 41 of a bracket 40 and/or bracket 88 and then through a tension buckle 54.

As discussed a webbing tension strap 60 that is attachable to exterior fitting/bracket/c-clamp/rail brackets 40 on outer rail or lip 27 of boat or skiff 20 can also be attachable to a cockpit coupler/interior fitting/hook 50 at cockpit wall 39 (see FIG. 6A), preferably at corners or bends 35, 36, 37, and 38 of cockpit 21 (see FIGS. 6A-6B, 16). In various embodiments, covering system 10 will be provided with tension straps 60 already threaded through an opening 41 of rail bracket 40 and a tension buckle on the tension strap 60 and also threaded through an opening 51 of hook 50 and coupled to itself after being threaded through opening 51.

Figure 11C:
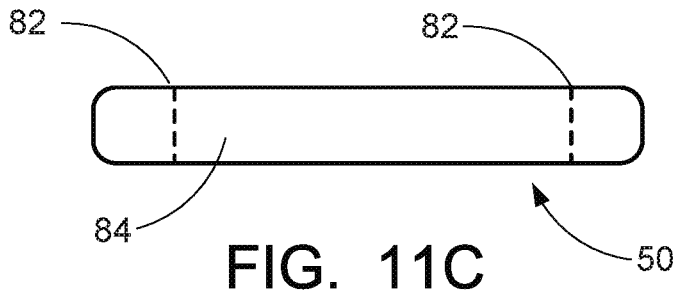
FIG. 11C is a top view of the first preferred embodiment of the cockpit wall hook as shown in FIG. 11A.
Figure 11B:
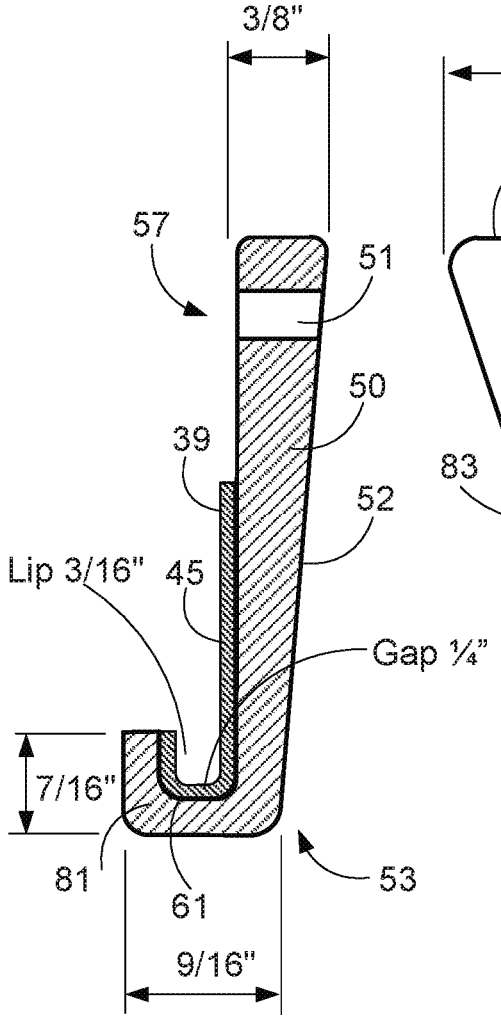
FIG. 11B is a side view of the first preferred embodiment of the cockpit wall hook taken along lines 11B-11B of FIG. 11A.
Figure 11A:
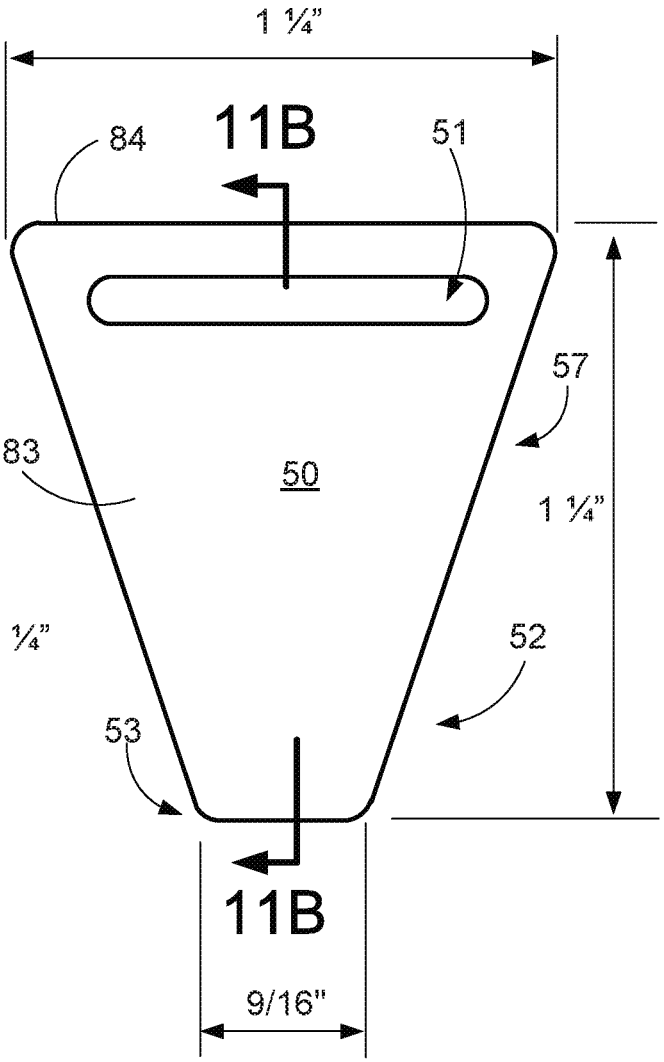
FIG. 11A is a front view of a first preferred embodiment of a cockpit wall hook that can be used with one or more preferred embodiments of a tent covering system of the present invention.

FIGS. 11A-11C illustrate a hook 50 and example dimensions for a hook 50. As illustrated in FIGS. 11A-B, hook 50 can have a wider upper portion 57, with a middle portion 52, and a hook end 53 with hook lip 81. As shown in FIG. 11A, upper end 57 can taper down to a narrower lower hook end 53. Lower hook end 53 can have bottom portion 29 and hook under the bottom of a cockpit wall 39 wherein hook lip 81 can extend along a backside 95 of a cockpit wall 39, bottom side 61 of hook 50 can extend along a bottom side 89 of cockpit wall 39, and front side 83 of hook 50 can extend along a front side 93 of cockpit interior wall 39.

Hook 50 also preferably has an opening 51 that can extend laterally across a width of upper portion 57, and which can receive an end of a tension strap 60 therethrough. FIG. 11C is a top view of a hook 50 and lines 82 designate a potential width for opening 51, which preferably is sized to received a tension strap 60 and can be about 1 and ⅛ inches wide, for example. As shown in FIG. 11A, preferably opening 51 is spaced a distance downwards from top side 84 of hook 50.

Preferably hook 50 has rubber 45 or other cushioning material spaced at least along a portion of surfaces of hook end 53 and center portion 52 that can come into contact with surfaces of wall 39 to provide a cushion against wall 39 surfaces.

Hook 50 can be used to receive an end of a webbing tension strap 60 extending from either a bracket 40 or a bracket 88 for positioning on boat 20 outer rail 27 (see FIG. 16). As discussed, at least one tension buckle 54 preferably is provided on a webbing tension strap 60 for increasing or decreasing tension of a webbing strap 60 extending from a bracket 40 or 88 on rail or lip 27 at outer perimeter 17 of boat or skiff 20 to the cockpit, e.g. to a hook 50 on cockpit wall 39. As shown in FIG. 6A, a tension buckle 54 can receive an end of tension strap 60 that has been threaded through an opening 41 of bracket 40. Another tension buckle 54 can also receive the other end of a tension strap 60 after the other said end is threaded through opening 51 of a hook 50. Alternatively, the other end of a tension strap 60 can be sewn or otherwise coupled to itself after being threaded through opening 51 of hook 50.

A gunnel, gunwale or interior cockpit wall 39 may commonly extend down about 1 to 1.5 inches into cockpit interior 28, recess 15 of cockpit 21, and sometimes may extend down less than about 1 inch. A deck lip with a portion extending downwards towards cockpit recess 15 can also be about 1 to 1.5 inches, or in some cases under about 1 inch. A gunnel, gunwale or interior wall 39, or a deck lip, may also extend down about 1 to 5 inches into recess 15 of cockpit 21. A lateral width of wall 39 or a deck lip commonly can be about 3/16 inches. Dimensions of a hook 50 can vary based on the dimensions of cockpit wall 39 or of a deck lip extending into recess 15 of cockpit 21. As shown in FIG. 6A a hook 50 can be sized to hook under a wall 39 of cockpit 21 with top 84 being positioned below a deck 26 height when hook 50 is hooked onto wall 39 and with a portion of webbing strap 60 extending a distance along front side 93 of cockpit wall 39. In other embodiments, a hook 50 can be sized so that a top 84 of hook 50 is at or near deck 26 height when hook 50 is hooked under cockpit wall 39. In various embodiments, a hook 50 can have a top portion that will extend onto deck 26, similar to the top portion of brackets 40 or 88.

As discussed, a hook 50 can be positioned onto a cockpit wall at or near corner junctions of cockpit walls 39. A hook 50 can also be positioned onto a cockpit wall 39 at one or more locations between corner junctions of cockpit wall 39.

Figure 12A:
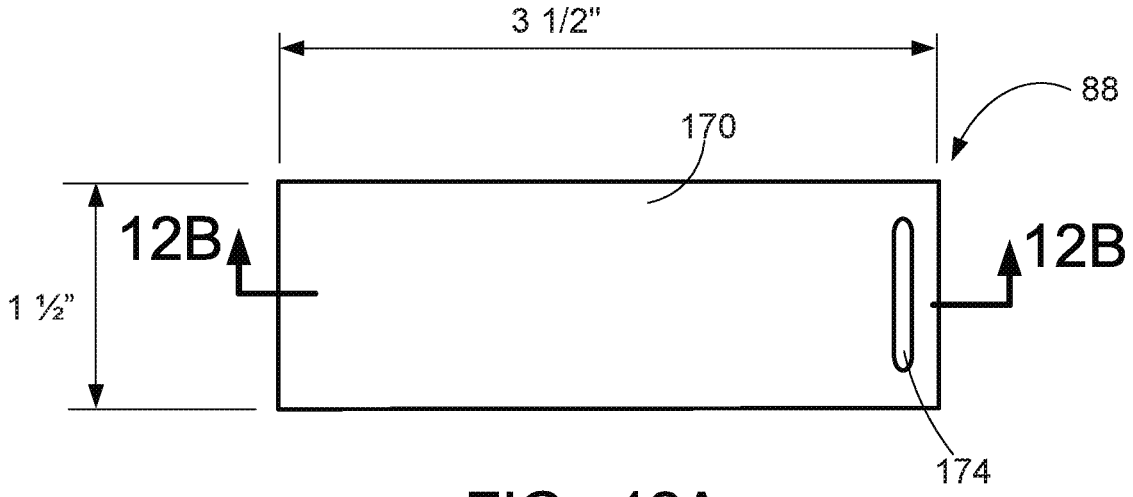
FIG. 12A is top view of a second preferred embodiment of a rail bracket that can be used with one or more preferred embodiments of a tent covering system of the present invention.
Figure 12B:
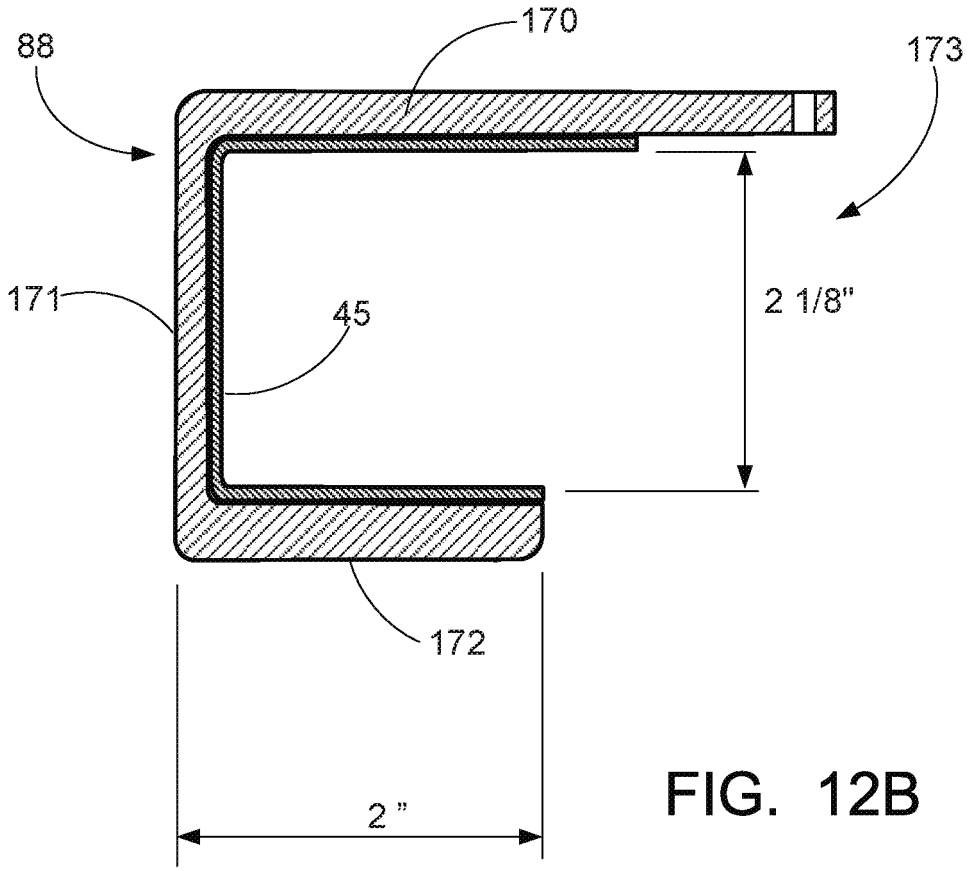
FIG. 12B is a side view of the second preferred embodiment of a rail bracket taken along lines 12B-12B of FIG. 12A.
Figure 13A:
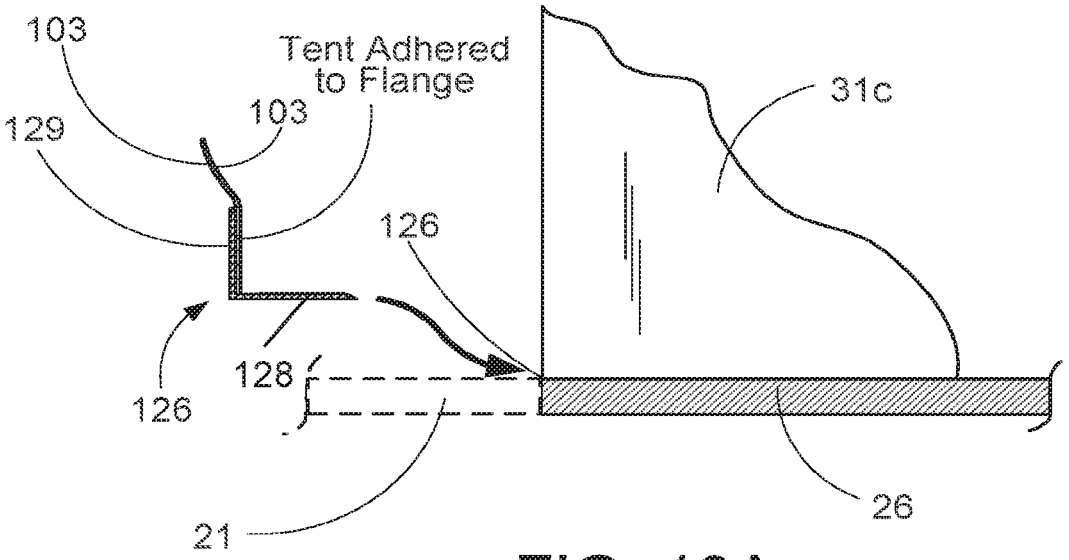
FIGS. 13A-13B illustrate how a flange portion of the second preferred embodiment of the tent covering system can be positioned under a boat or skiff seat.
Figure 13B:
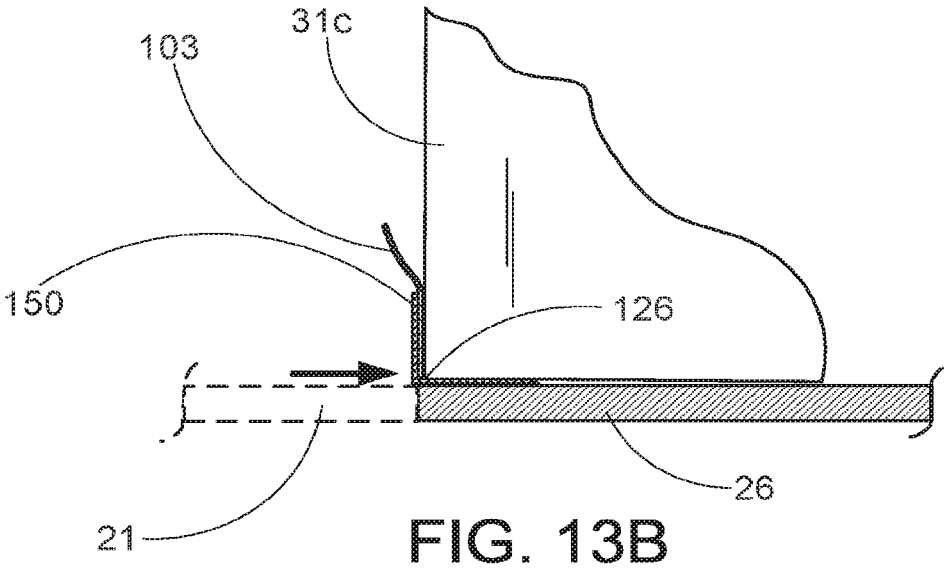
Figure 14A:
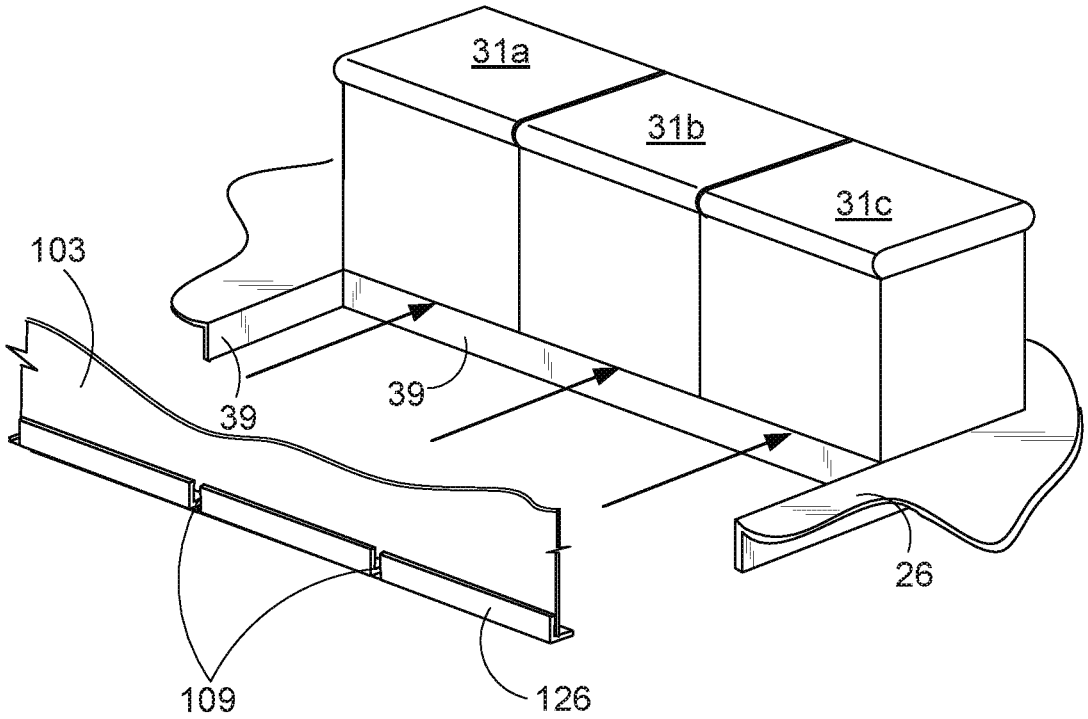
FIGS. 14A and 14B are additional views showing how a flange portion of the second preferred embodiment of the tent covering system can be coupled to a cockpit side that has one or more seats near a cockpit edge.
Figure 14B:
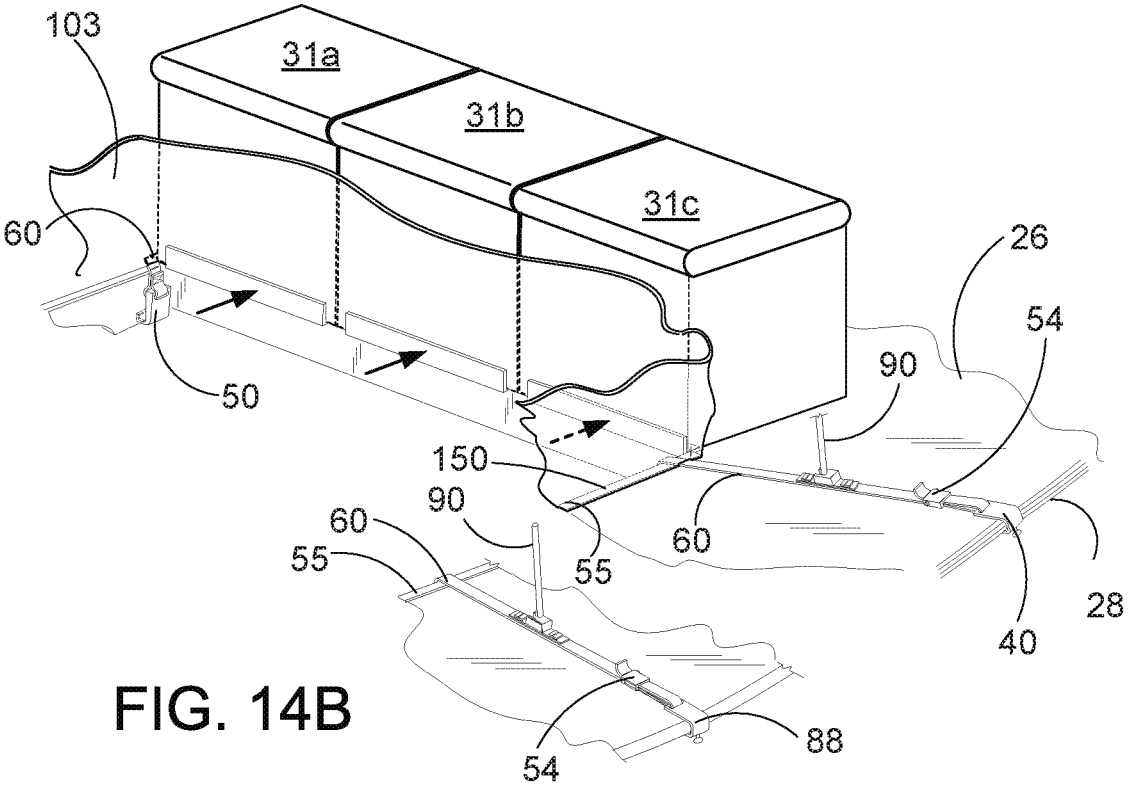

FIGS. 12A and 12B illustrate an embodiment of rail bracket 88, and example dimensions for a bracket 88, which can comprise a general "C" shape as shown. Bracket 88 as shown has a top member 170, lower member 172, and center member 171 spaced longitudinally between top member 170 and lower member 172. An opening 174 is spaced laterally across a width of top member 170 of bracket 88. Bracket 88 can be positioned on a deck or rail lip 27 in manner similar to bracket 40, wherein top member 170 can rest on rail or lip 27 and extend a distance onto deck 26, wherein center member 171 can extend along an exterior surface of rail or lip 27 and lower member 172 can extend a distance under rail or lip 27, with rail or lip 27 extending a distance within opening 173 between top member 170 and lower member 172. Preferably rubber 45 or other cushioning material extends along surfaces of a bracket 88 that can come into contact with a boat rail 27 surface or other boat surface. Bracket 88 is shown without a tightening means or bolt 44 as illustrated in FIG. 10B for rail bracket 40. If desired a tightening means, e.g., a bolt 44, could also be provided on a rail bracket 88.

As discussed, preferably at least four webbing straps 60 are provided, each attachable at one end to one of 4 rail brackets 40 and at the other end to one of four hooks 50. Additional tension webbing straps 60, can also be provided that can be coupled to a bracket 88 at one end and to a hook 50 at the other end. The bracket 88 as shown in FIG. 12A includes a laterally positioned opening 174 which can receive a tension webbing strap 60 extending from a location on a cockpit side, for example, as shown in FIGS. 4 and 16. The laterally positioned opening can easily receive a tension strap 60 extending in a substantially horizontal or lateral direction from a cockpit side.

In various embodiments the positioning of an opening 174 in a bracket 88 or the positioning of an opening 41 in a bracket 40 can be modified as desired based on the angle at which a strap 60 will extend from the cockpit.

In various embodiments a bracket 40 and a bracket 88 can comprise the same shape. In various embodiments a bracket 40 and a bracket 88 can comprise the same shape but with openings for receiving a tension strap 60 positioned at different angles. In various embodiments a bracket 40 and a bracket 88 can comprise a different shape. In various embodiments either a bracket 40 or a bracket 88 can include a tightening means. In various embodiments, a tightening means on a bracket 40 or 88 may not be needed when sufficient tension in tension straps 60 is provided to hold the brackets 40 and 88 in place at the boat rail or lip 27.

A tension strap 60 for coupling to a rail bracket 88 and a hook 50 can be coupled to a tent base portion 34 in a similar manner as previously described when tension straps 60, e.g., between tent base portion 34 and sealable layer 80, or through a lower tent wall portion 150. In some embodiments, a tension strap 60 extending from a hook 88 can be coupled to a tent base portion 34 and also to a hook 50. In some embodiments, a tension strap 60 extending from a hook 88 can be coupled to a tent base portion 34, end at or around tent base portion 34 and not be threaded through a hook 50. Straps 60 can extend from at or near a tent lower portion 150, for example, to a bracket or hook 88 on outer rail or lip 27. Straps 60 can be sewn or glued, for example to a tent lower portion 150 on exterior side 180 of tent 100. Straps 60 may also extend through a sealable or sealed opening in a tent wall portion and can be coupled at an interior side 181 of tent 100 when not threaded through an opening in a hook 50.

In various embodiments at least one tension buckle 54 is provided on a webbing strap 60 to receive at least one end of a tension strap 60 after being threaded through a rail bracket 40 or 88, and/or a hook 50 so that tension of strap 60 can be adjusted to secure tent 100 in place on boat 20. An end of a tension strap 60 that is not threaded through a tension buckle can be coupled back to itself after being threaded through an opening on a bracket 40, bracket 88 or hook 50, e.g., by sewing or adhesive or heat sealing.

In various embodiments, a tension buckle is provided on both ends of a tension strap 60 for receiving an end portion of a tension strap 60 from an opening in a bracket 40 or 88 and for receiving an end portion of a tension strap 60 from an opening in a hook 50.

In some embodiments, e.g., for tension straps 60 extending from a side of a cockpit 21 to a bracket 88 on a the deck rail 27, a tension buckle does not need to be included on said tension webbing straps 60. In said embodiments, tension can be applied based on the length of the tension strap 60 extending from the cockpit 21 side to bracket 88 and from tension applied to tension straps 60 that extend from the corners of the cockpit to a bracket 40.

As discussed, preferably a plurality of 4 webbing tension straps 60 extend from a bracket 40 on rail or lip 27 of boat or skiff 20 to a hook 50 at a cockpit corner 35, 36, 37, 38. Other webbing straps 60 can also extend from a hook 50 positioned on a sidewall of a cockpit to a bracket 88 on the boat rail 27. When the plurality of webbing straps 60 are secured to the plurality of hooks 50 and hooked onto a cockpit wall 39 and secured to the plurality of rail brackets 40 at or near deck 26 height, and tension is applied to straps 60, e.g., via tightening of a strap 60 in buckle 54, the force spreading the webbing straps 60 applies pressure to sealable compressible layer 80 under tent base portion 34 to compress sealable layer 80 against deck 26, and form a water and/or bug proof seal around cockpit 21, wherein water and/or bugs cannot enter a cockpit interior from under sealable layer 80, through sealable layer 80, or between the tent base portion 34 and sealable layer 80.

Tension on webbing 60 can be applied through spreading the webbing from bracket 40 or bracket 88 to hook 50. The amount of tension of tension strap 60 can be adjusted 0.1, 1, 5, 10, 15, 20, 25, 30, 35, 40, 45, 50, 55, 60, 65, 70, 75, 80, 85, 90, 95 or 100 percent, or at a percentage therebetween, to adjust the level of seal around cockpit 21. The amount of tension of tension strap 60 can be adjusted between about 0.1% and 100% to adjust the level of seal around cockpit 21. Tension of a webbing tension strap 60 and pressure on a sealable layer 80, for example, can be increased or decreased via tension buckles 54. With sealable layer 80 compressed against deck 26, water and bugs will be unable to enter cockpit interior 28 at around the deck area. Lower tent wall portion 151 wrapped around webbing layer 55 from a distance away from exterior side 180 of tent 100 to a distance away from interior side 181 of tent or cover 100 provides an additional bug and water proofing feature. The tent material is also preferably at least water resistant. Where doors and/or windows are provided on a tent 100, preferably a mesh layer or screen 206 that can be zipped or unzip is also provided to provide a barrier against bugs while also allowing wind to flow therethrough.

When a covering system 10 or 11 is in place on a boat 20, an occupant 195 can preferably lie down on a cockpit floor 14 or sit on cockpit floor 14 as shown in FIG. 4.

In an alternative embodiment as shown in FIGS. 2, 4, a compressible sealable layer 80, e.g., a neoprene gasket, will only be provided on certain sides of a tent 100 and cockpit 21, e.g. along three tent wall portions for positioning around 3 sides of a cockpit 21, e.g. on sides 22, 23 and 25 of cockpit 21 but not on rear side 24.

Some skiffs or boats 20, include foldable or removable seats, e.g., seats 31*a*, 31*b*, and 31*c*, at or near a rear edge of side 24 of a cockpit 21. Other skiffs or boats include seats that are permanent and may not be removed. When a cockpit covering system 10 is to be used on a boat with removable rear seats or without rear seats, a compressible sealable layer 80 can be provided to extend around an entire cockpit perimeter and form a closed perimeter, e.g., around all four cockpit sides 22, 23, 24 and 25 and wall portions 101, 102, 103 and 104.

FIGS. 2, and 13A-15B illustrate a tent covering system 11 that can be used with a boat that includes permanent seats along a side of a cockpit, or also potentially for a boat with removable seats along a side of a cockpit. In this embodiment, preferably a sealable layer 80 will not be included along a tent wall portion, e.g., along tent wall portion 103, that will be positioned on the side of a cockpit 21 that includes a seat or seats at or near an edge of the cockpit 21, e.g., at or near an edge of cockpit rear side 24. A tent base portion 34 along such a wall portion, e.g., along wall portion 103, preferably is modified to include a flange 126.

A flange 126 preferably comprises an "L" shape with an at least substantially horizontal member/horizontal member 128 and an at least substantially vertical member/vertical member 129. Vertical member 129 can be positioned perpendicular to horizontal member 128. Vertical member 129 and horizontal member 128 can comprise the same or different dimensions. The junction of a horizontal member 128 and vertical member 129 can form a 90 degree angle. A lower portion 150 of wall 103 can be coupled to the vertical member 129, e.g., via an adhesive. Horizontal member 128 preferably is sized to be pushed or slide in between a bottom of a seat or seats 31*a*, 31*b*, 3*c*, and a surface of deck 26 with the vertical member 129 extending a distance along a longitudinal side of the seats 31*a*, 31*b*, 31*c*. Preferably a flange 126 includes one or more spaces 109 that will allow a flange 126 to be folded when the tent system 11 is not in use.

As discussed, the tent 100 can be made from a continuous piece of fabric or from fabric pieces coupled together to form a continuous tent 100. In an embodiment of system 11, the majority of tent base portion 34 can include tent base webbing 55 with a portion of tent lower portion 150 sewn around a portion of tent base webbing 55 as previously described, and a sealable layer will be under the tent base webbing 55 and portion 150 wrapped around tent base webbing 55, with sealable layer 80 for resting on a deck surface at least around 3 sides of a cockpit (or around sides of a cockpit that do not include seats located near an edge of the cockpit).

Figure 15A:
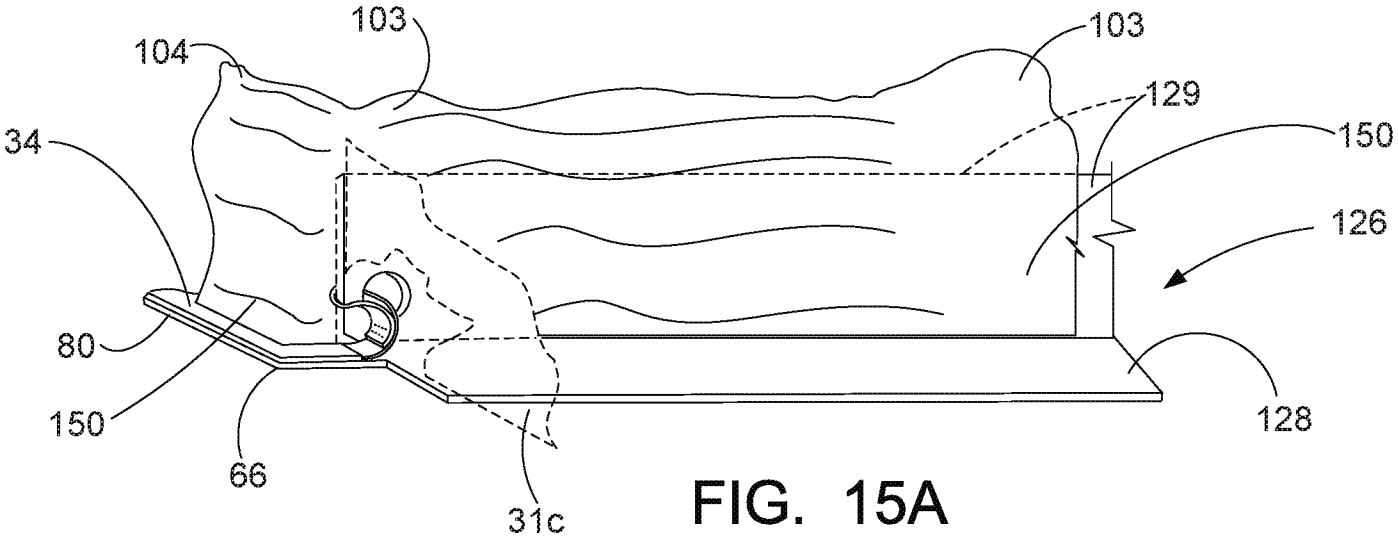
FIGS. 15A-15B illustrate a junction of a flange with tent base webbing and a compressible sealable layer in the second preferred embodiment of the tent covering system, which is positionable on a boat or skiff that includes one or more seats at or near a cockpit edge.
Figure 15B:
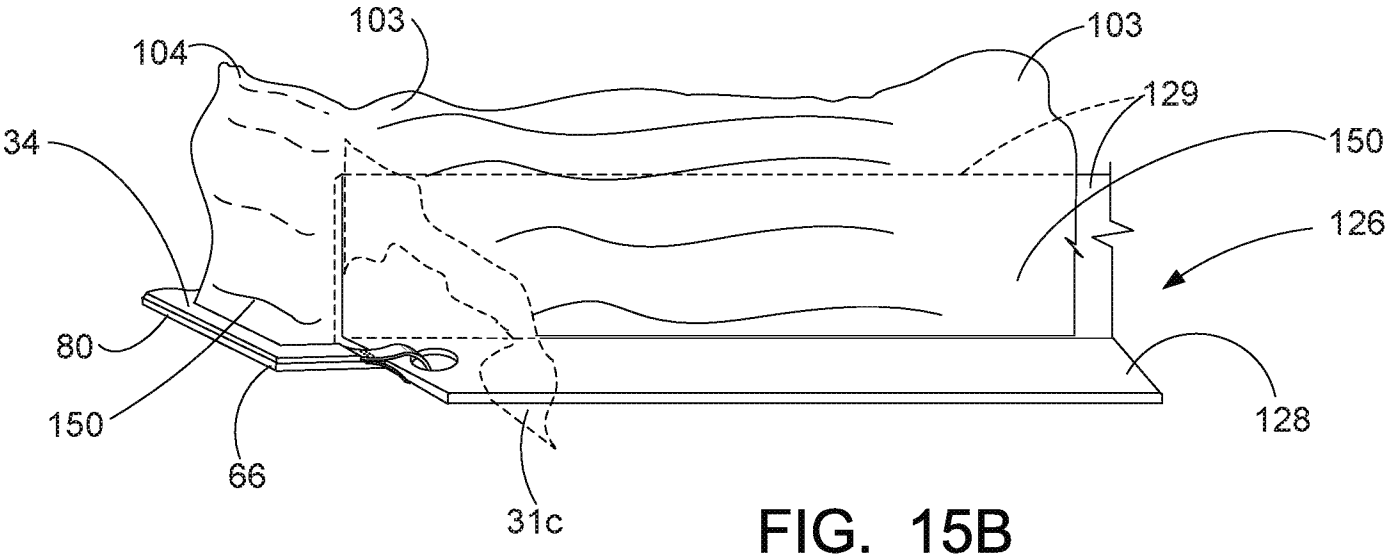

A portion of the tent base webbing layer 55 extending along side 23 of cockpit 21 can turn corner 37 from cockpit side 23 to cockpit rear side 24 and can be coupled to flange 126. For example a portion of the tent base webbing layer can be threaded through an opening in flange 126, e.g., on vertical side 129, on vertical side 128 or at the junction of sides 129 and 128. Webbing 55 can then be sewn back on itself as shown in FIG. 15A, for example. A portion of the tent base webbing layer 55 extending along side 25 of cockpit 21 will also turn corner 38 from cockpit side 25 to cockpit side 24 and can be coupled to flange 126, for example the webbing can be threaded through an opening in the vertical side 129 of flange 126, in an opening on horizontal side 128, or an opening at the junction of flange members 128 and 129 and sewn back on itself. The lower tent wall portion 150 of wall 103, for example, can be coupled to the vertical member 129 after the tent base webbing layer 55 is coupled to flange 126.

Sealable layer 80 on sides 23 and 25 that can turn corners 37 and 38 preferably can extend right up to a side edge of flange 126, or possibly can extend a distance onto lower portion 128 of flange 126, e.g., when there is enough space between a bottom of the seats 31*a*, 31*b*, and 31*c* and deck 26 to accommodate both horizontal member 128 and the sealable layer 80.

The weight of the seats 31*a*, 31*b*, and 31*c* can hold flange 126 in place and tent wall portion 103 in place. Preferably when constructing tent system 11, the tent wall portions at the junction of the flange, tent base webbing layer 55, and sealable layer 80 will not include any spaces through which water or bugs can enter. If necessary an extra piece of tent material can be coupled around the junction area to promote a water and/or bug proof seal at the junction of a flange 126 with the rest of tent 100.

On the side of a cockpit 21 with seats, the flange configuration 126 can provide a barrier or seal against water and bugs. In some embodiments flange configuration 126 can provide a water proof and/or bug proof seal for interior 28. In such an embodiment, the compressible sealable material 80 and flange 126 together form a closed sealable layer around an entire cockpit perimeter. In some embodiments, a compressible layer can be placed under flange 126 and compressed under flange 126.

In various embodiments, a tent lower portion 150 is not wrapped around a flange 126, but a base of the wall is attached to at least vertical member 129 of flange 126. In various embodiments, a base wall layer 150 is not wrapped around a flange 126, but a base of the wall is attached to at least vertical member 129 and extends over the portion of tent base webbing layer 55 coupled to flange 126.

Preferably a tent wall will be glued to flange 126 so there are no holes anywhere to form a solid water tight and/or bug proof seal. In some embodiments, tent base webbing layer 55 with the lower portion 150 wrapped around at least a portion of layer 55 and attached to sealable layer 80 can extend along an entire length of horizontal member 128 in embodiments where there is enough space between a seat bottom and the boat deck to accommodate the flange horizontal member 128, sealable layer 80 and tent wall portion 34 including tent lower portion 150 wrapped around tent webbing base layer 55.

In some embodiments a tent covering system as described with regard to FIG. 1 can be utilized with a boat that comprises seats and without including a flange member, wherein a lower portion 34 of a tent and compressible sealable layer can be slid between the seat and the deck 26 on a cockpit side where seats are included. Tension applied to webbing straps 60 at various locations will hold the tent system in place on the deck.

In various embodiments, if seats are included at or near more than one cockpit side edge, a tent base portion can include more than one flange member.

When assembling a tent system 11 on a boat 20, brackets 40, 88 and hooks 50 can be put into position prior to inserting flange 126 between a boat seat and deck 26. If seat 31*a*, 31*b*, or 31*c* comprises a hatch portion that can open and close, preferably a window, or a door 105, is included on the wall portion 103, for example, so that a person within the tent 100 interior 28 can open the window, e.g., unzip the window or door 105, and/or mesh screen portion 206, and access the hatch/hatch door 262 from an interior of the tent.

Figure 29:
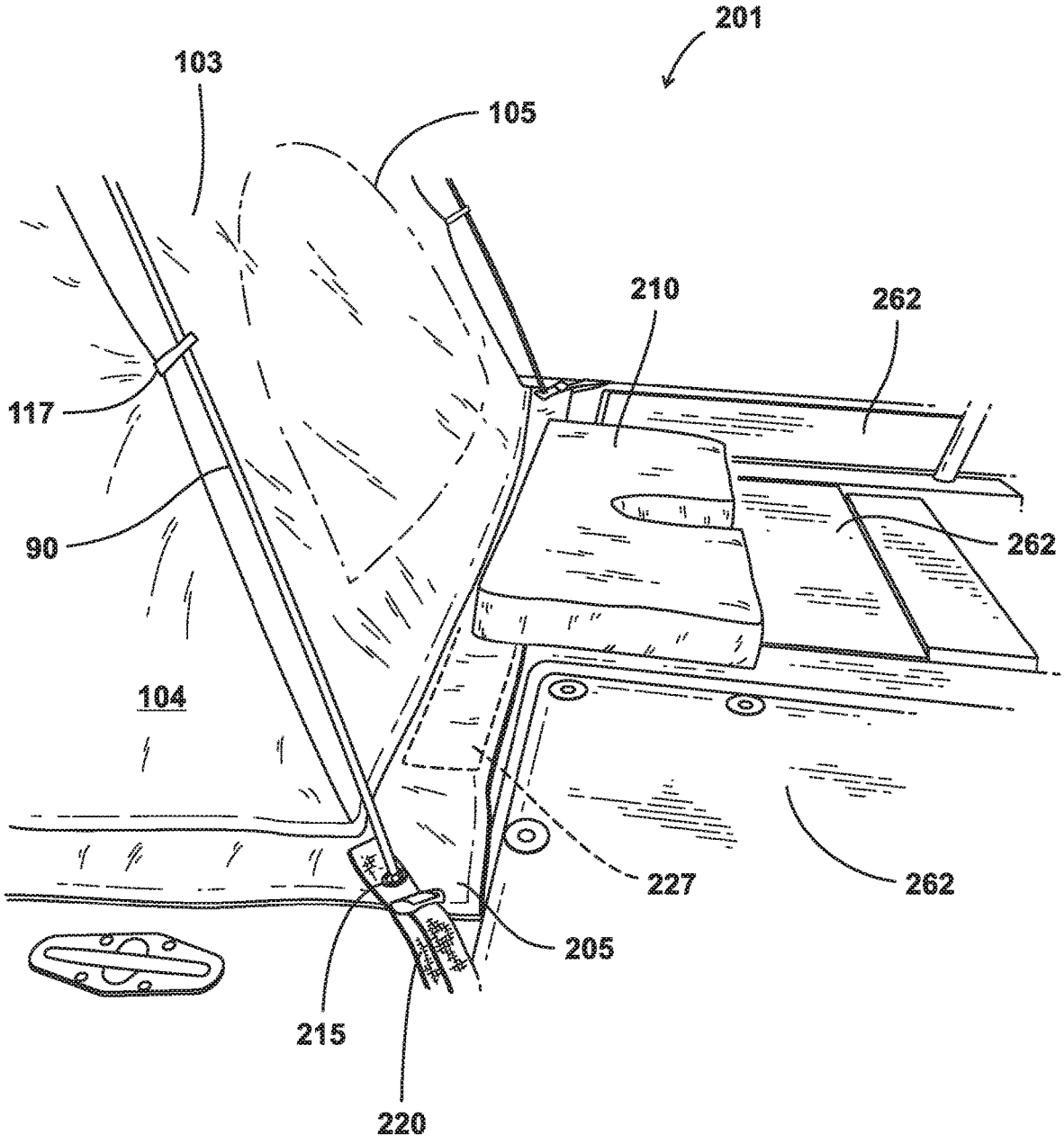
FIG. 29 is a partial perspective view of the third preferred embodiment of a tent covering system of the present invention.

On some boats or skiffs 20, three rear seats can be located on the boat 20, e.g., a starboard rear seat 31*a* and port rear seat 31*c*, and a rear seat located in the middle, 31*b* (see FIGS. 2, 4). A common seat 31*a* or 31*c*, can be about 13 inches measured from a seat bow side to seat aft side. The width of a common starboard seat 31*a*, or port seat 31*c*, can be about 12 inches, measured from a seat starboard side to a seat port side. A middle seat 31*b* positioned between a seat 31*a* and seat 31*c* generally can be wider, e.g., comprising a width of about 20 inches, extending from a seat port side to seat starboard side of a seat 31*b*. Alternatively, a seat that is the same or similar to seat 210 as shown in FIG. 29, for example, can be included on boat or skiff 20 and used with a tent covering system 10 or 11.

Referring now to FIGS. 8, 9A-9D and 23, a pole bracket assembly system that can be used with tent systems 10, 11 or 201 will be described. A plurality of poles 90 can be used in tent systems 10, 11 or 201 for providing support and maintaining a desired height for a tent or cover 100, 200 (see FIGS. 1-2, 23), which poles 90 may for example be attachable to an exterior of the tent or cover 100, 200 with twist clips or hooks 117 (e.g., DAC® twist clips 117) spaced around the tent/cover 100, 200 as desired, e.g., spaced about 1-foot apart. A swivel hub for example may also be utilized at a top portion of a tent 100, 200 for coupling two poles 90 together and a tent top portion at a location where the poles 90 overlap one another.

Figure 22A:
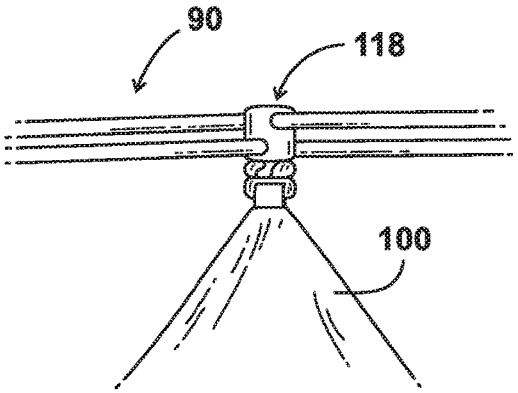
FIG. 22A illustrates a prior art swivel hub which can be used for connecting overlapping poles at a tent top portion exterior.
Figure 21B:
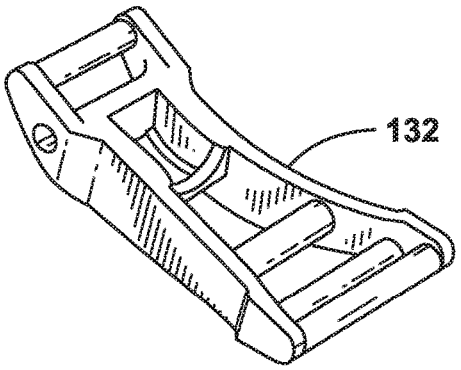
FIG. 21B illustrates a prior art DAC Jake's foot.
Figure 22B:
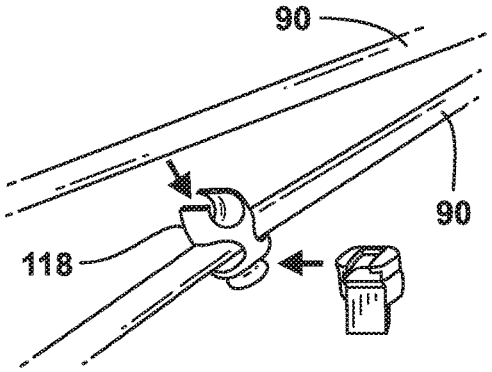
FIG. 22B is an exploded view of a prior art swivel hub and poles as shown in FIG. 22A.
Figure 21C:
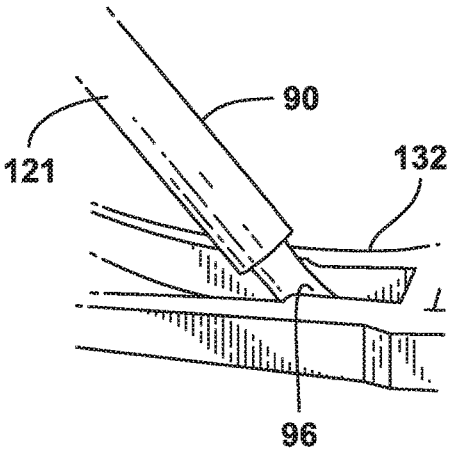
FIG. 21C illustrates a tent pole end coupled within a DAC Jake's foot.
Figure 22C:
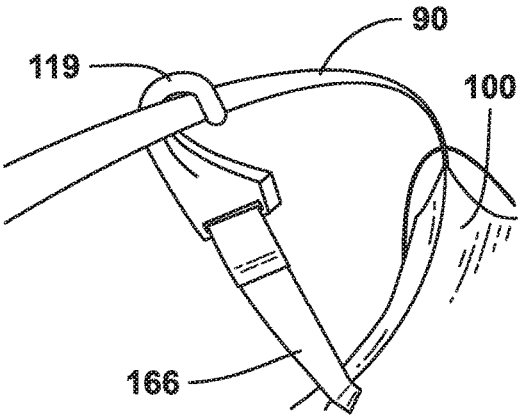
FIG. 22C illustrates a prior art hook coupling a pole to a tent exterior.

FIGS. 22A-22C illustrate an example of a prior art swivel hub lock 118 and twist clip or hook 119 that can potentially be utilized with a tent cover system 10, 11 or 201 for coupling two poles 90 at one or more locations on an exterior of tent 100, 200 with hub 118 and for coupling the same or other poles 90 at a plurality of other spaced apart locations on a tent or cover 100, 200 with clips or hooks 119. Twist clips or hooks 117 or 119, and a hub 118 can be coupled to a tent 100, 200 via a plurality of straps or tie downs 166 in a similar manner to what is shown in FIGS. 22A-22C.

Figure 24:
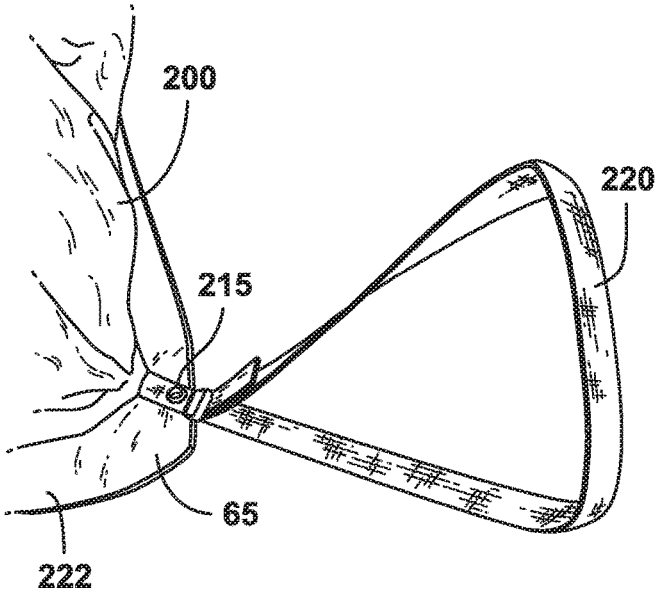
FIG. 24 is a partial perspective view of the third preferred embodiment of a tent covering system of the present invention illustrating an exterior strap and pole housing on a tent base.
Figure 25:
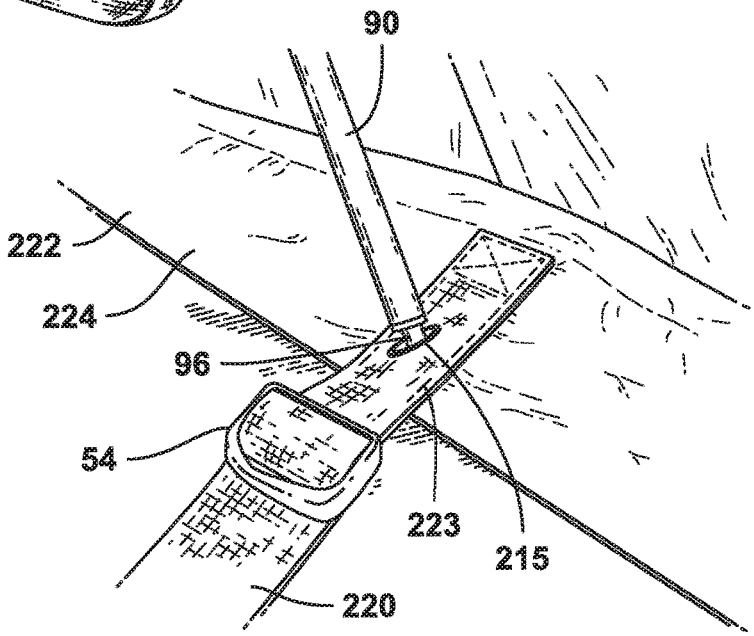
FIG. 25 is a partial perspective view of the third preferred embodiment of a tent covering system of the present invention illustrating an exterior strap and pole housing on a tent base.
Figure 26:
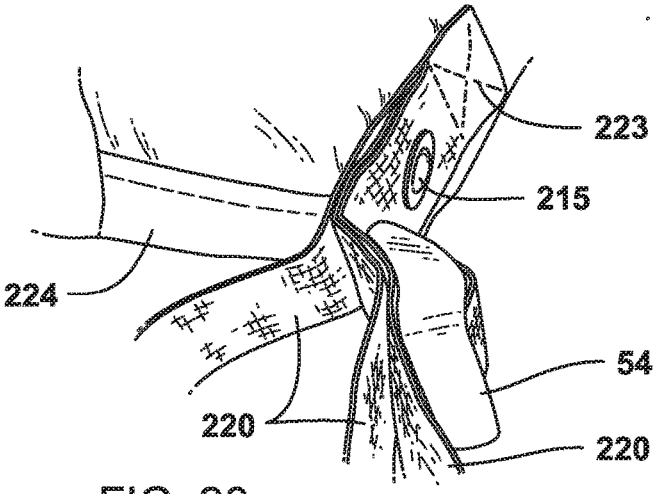
FIG. 26 is a partial perspective view of the third preferred embodiment of a tent covering system of the present invention illustrating an exterior strap and pole housing on a tent base.

A pole bracket assembly can comprise a pole bracket housing 91 coupled to a pole housing tension strap 55, which is coupled to a webbing tension strap 60. A plurality of poles 90 can be releasably coupled to a pole base housing 91, e.g., wherein an end 96 of pole 90 can be pushed or inserted into a pole bracket housing 91. Pole bracket housings 91 preferably are coupled to a pole housing tension strap 92 on tension straps 60. A pole bracket housing 91 can be similar to a DAC® Jake's foot 132 (see FIGS. 22B and 22C), or other suitable pole housing, e.g., a grommet 215 as shown in FIGS. 24-26.

A pole bracket assembly can comprise a pole bracket housing 91 coupled to a pole housing tension strap 92 with tension buckles 94 on tension strap 92, and with said tension strap 92 coupled to a webbing tension strap 60. A plurality of poles 90 can be releasably coupled to a pole bracket housing 91, e.g., wherein an end 96 of pole 90 can be pushed or inserted into an interior 97 of pole bracket housing 91 and coupled to a coupler 120 at a base of bracket housing 91 in interior 97. Pole bracket housings 91 preferably are coupled to a tension strap 92 on tension straps 60.

Figure 8:
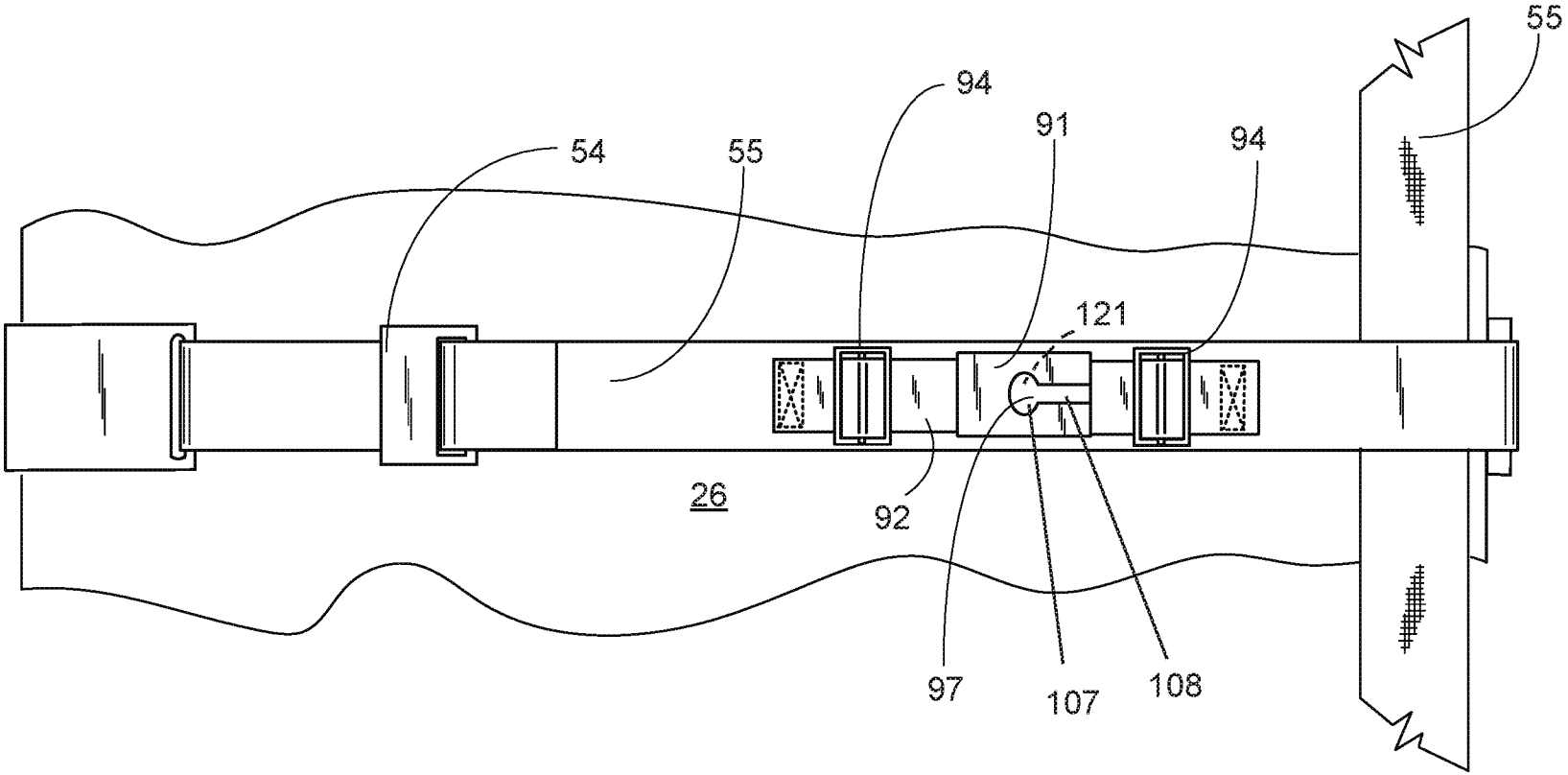
FIG. 8 is a top view of a pole bracket housing assembly on a tension webbing strap that can be used in one or more preferred embodiments of a tent covering system of the present invention.
Figure 9B:
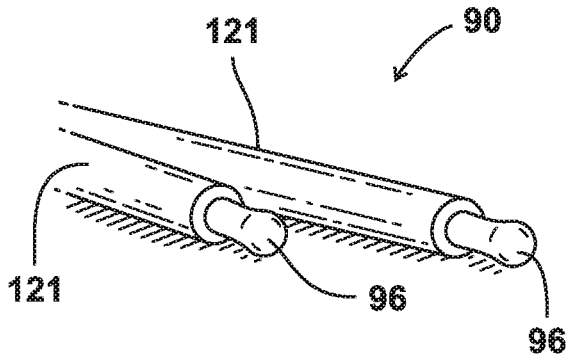
FIG. 9B illustrates an end of a pole that can be used in one or more preferred embodiments of the present invention.
Figure 9A:
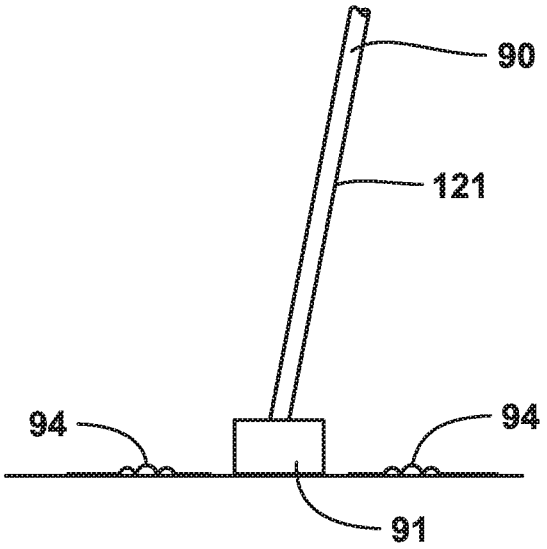
FIG. 9A is a side view of a pole in a pole bracket housing assembly that can be used in one or more preferred embodiments of a tent covering system of the present invention.

FIG. 8 depicts a top view of a pole bracket housing 91. As shown, a pole bracket housing 91 has an interior 97 that includes a coupler 120 therein, and can have an opening that has a shape with a wider end portion 107 that is continuous with a narrower end portion 108. Preferably the wider end 107 of the opening is sized to accommodate a pole end 96 coupled within a coupler 120, and the narrower portion 108 of the opening is sized to accommodate a pole 90 width. The pole end 96 can be pushed into interior 97 at the wider portion 107 of the opening into a coupler 120 on a bottom surface of housing 91, and preferably removably coupled, or removably locked, within the coupler 120. When the pole end 96 is locked within the housing coupler 120, the pole 90 itself can slide or otherwise move into the narrower portion 108 of the opening and the pole 90 can extend at an angle from the bracket housing 91 to a tent twist clip 117 on tent 100, e.g., as illustrated in FIG. 9A.

Generally, a pole end can have a different shape or width than the shape or width of a main portion 121 of pole 90. The opening in the bracket housing 91, can be modified based on dimensions of a main portion 121 of a pole 90 and a pole end 96. In some embodiments for example, the opening may not have an irregular shape, but can be a substantially rectangular, or oval shape opening, for example, with room to accommodate a pole coupler and a pole end at least in a portion of the housing. Preferably, the housing will also have a portion, for example, sized to allow a pole to rest thereon, or therein, at an angle. An insert also potentially could be placed within a housing sized to have a pole rest thereon or therein at an angle, and/or sized to accommodate a pole coupler.

FIGS. 22B and 22C illustrate a prior art DAC, Jake's foot 132. The releasable coupler 120 of housing 91 can be the same or similar to the releasable coupler 120 of a Jake's foot 132 as shown in the figures.

A lower end 96 of a tent pole 90 preferably can be removably secured or removably locked within a pole bracket housing 91 positioned on tension strap 92 coupled to webbing straps 60 on deck 26 (see FIGS. 6A, 8), and in this way can anchor the tent at or near the deck 26 surface.

In various embodiments, a pole bracket housing 91 can include an interior 97 for receiving lower end 96 of tent pole 90, wherein end 96 preferably comprises a shape and size allowing it to mate with, and snugly nest within interior 97 when pushed, for example, into interior 97, and to also be removed from housing 97 when desired, e.g., via pulling, or twisting of pole 90 or pulling or twisting of housing 91. In various embodiments housing 91 may also have a lock and release mechanism enabling locking or release of a pole end 96 in housing 91 interior 97. Interior 97 of housing 91 also preferably has a shape sized to mate with a pole 90 end 96.

As discussed, a lower end 96 of a tent pole 90 preferably can be removably secured within a pole bracket housing 91 positioned on tension strap 92 coupled to a webbing straps 60 on deck 26 (see FIGS. 6A, 8), and in this way can secure the tent to a boat 20 at or near the deck 26 height. A pole bracket housing 91 includes an interior 97 for receiving lower end 96 of tent pole 90, wherein end 96 preferably comprises a shape and size allowing it to mate with, and snugly nest within interior 97 when pushed, for example, into interior 97, and to also be removed from housing 97 when desired, e.g., via pulling, or twisting of pole 90 or pulling or twisting of housing 91. In various embodiments housing 91 may also have a lock and release mechanism enabling locking or release of a pole end 96 in housing 91 interior 97. Interior 97 of housing 91 also preferably has a shape sized to mate with a lower end 96 of a tent pole 90 so that a removable connection can be formed when end 96 is pushed or inserted in interior 97.

As discussed a pole bracket housing assembly preferably includes a pole bracket housing 91 coupled to a tension strap 92, which is attachable to webbing strap 60, e.g., via an adhesive or sewn connection. When tension is applied to webbing or tension strap 60 extending from cockpit 21 to outer lip or rail 27, webbing or tension strap 60 will have limited movement and can provide a secure base for a pole 90 nesting within a bracket housing 91 on strap 92, to anchor a pole end 96 at or near deck 26 level on the boat or skiff 20. Preferably bracket housing 91 is movable or slidable along tension strap 92, e.g., via buckles 94 (see FIG. 8). Movement of housing 91 along strap 92 when a tent pole 90 is coupled therein can increase or decrease tension of the tent 20 wall portions coupled to the poles 90. It can be desired to adjust tension of the poles 90, for example, because shrinking or stretching can occur in tent fabrics per changes in weather conditions. Pole bracket housing 91 preferably is movable along strap 92 in both directions, e.g., about 0.25 to 1 inches in both directions.

In some embodiments a pole end 96 releasably coupled within a housing 91 will be able to have limited movement, e.g., to move in a forward and backward direction. In such an embodiment buckles 94 or tension strap 92 do not need to be included.

In some embodiments, a pole housing 91 or 215 can be fixedly positioned on strap 60 and not moveable.

In the embodiments of systems 10 and 11 shown in FIGS. 1-20, a pole housing 91 is positioned on a strap 60. Alternatively, a pole housing 91 can be positioned on a tent base portion 34 in a system 10 or 11. A grommet/pole housing 215 can be used in system 10 and/or 11 and positioned on a strap 60 or on a tent base portion 34.

In some embodiments, a tent tie down or a strap that is also connected to a pole 90 could be coupled to a boat 20 at the outer rail or lip 27 to a bracket 40 or 88, e.g., by threading through an opening on a bracket 40 or 88 or by being tied around, or to, any suitable coupler on a bracket 40 or 88.

Figure 5:
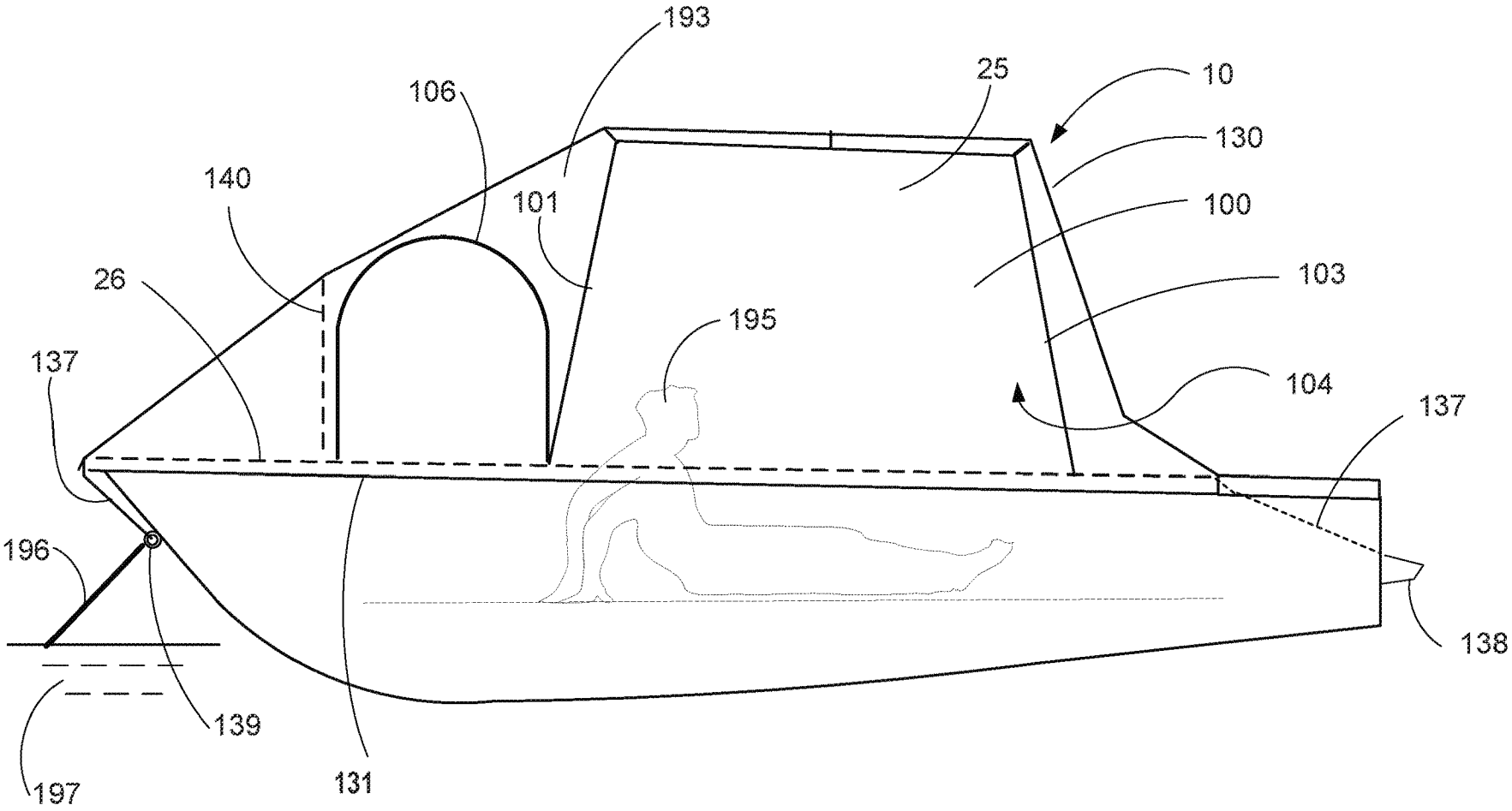
FIG. 5 is a side view of an alternative embodiment of a tent covering system of the present invention including a rain fly.

Referring now to FIG. 5, a tent rain fly 130 can also be provided as a removable or optional component of a tent covering system 10 or 11. A rain fly 130 can be provided for covering tent 100 and extending across and above deck 26, to a location exterior to rail or lip 27 of boat or skiff 20, e.g., to be secured under rail or lip 27 on exterior side 115 of boat or skiff 20. Preferably rain fly 130 tie downs 137 are provided which can be secured to a bracket 40 for example by tying it around or otherwise coupling tie down 137 to bolt 44 of bracket 40 under rail or lip 27. In some embodiments of bracket 40 or 88, an opening can be provided on bracket 40 or 88, preferably on lower member 67 or 172 respectively, wherein a tie down 37 could be coupled thereto.

When the rain fly 130 tie downs 137 are secured to a bracket 40 or 88 under rail or lip 27 or to an exterior of rail or lip 27, the rain fly can extend underneath or past rail or lip 27, which allows rain or other water on rain fly 130 to slide off the boat 20 and which can help prevent any pooling of water on deck 26. A rain fly 130 tie down 137, may also be provided for securing rain fly 130 on a bow line (which can be used to anchor the boat) (see FIG. 5), and tie down 137 can potentially be a zip tie. Additional rain fly 130 tie downs 137 can be provided to secure the rain fly at a stern eye 138 and/or at a port eye.

As illustrated in FIG. 5, preferably a rain fly base/rain fly bottom 131 is at an exterior of boat 20 below deck 26 height. A vestibule 106, which can be supported by one or more stakes 140 can also be provided as part of a rain fly 130 system.

A rain fly 130 system can be included in a similar manner as described above in a system 201 as shown in FIGS. 23-40.

Referring now to FIGS. 17-20, in various embodiments, a plurality of interior base poles or stakes 111 can be provided as part of a tent covering system 10 or 11. Said poles 111 can be coupled within a plurality of pole clips or housings 112 that are coupled via ties or straps 113 to an interior side 181 of lower tent portion 150 at a plurality of spaced apart locations. The interior base poles 111 preferably can be coupled within one or more housings or clips 112, wherein a pole 111 extends from corner 65 to corner 66, another pole 111 can extend from corner 66 to corner 67, another pole 111 can extend for corner 67 to corner 68 and another pole 111 can extend from corner 68 to corner 65, on an interior side 181 of tent 100. Corner sleeves or pockets 114 can be provided at corners 65, 66, 67, and 68 for receiving an end of two different poles 111 therein.

In an alternative embodiment, interior sleeves could be provided instead of clips 112 for receiving the base poles 111 that extend a distance along tent interior sides.

When poles 111 are coupled within housings 112 and corner sleeves 114 the poles can rest on an interior surface of tent base webbing layer 55 and also possibly a portion of the poles 111 can rest on a surface of deck 26 if a pole or stake width extends over tent base webbing 55.

If desired, poles 111 can be included in a system 201 as well, in a similar manner as described above, e.g., if tent 200 has an inner skirt/flare portion 225.

Tent or cover 100 can have a plurality of doors or windows. FIGS. 1 and 2 illustrate a door 105 on front side portion 101, which can be part of tent 100 in various embodiments. Such a door preferably may open and close, e.g., via zipper. A door 105 can include a mesh/screen 206 layer which can serve as a screen and tent fabric layer, which can be nylon or polyester material for a door exterior. Preferably a mesh/screen layer 206 will have a separate zipper from the tent fabric layer for door 105. A door 105 or a window is also preferably provided at an rear or aft wall 103, for enabling access to a hatch 262 or cabinet that typically can be near rear side 24 of cockpit 21, e.g., as part of a seat 31*a*, 31*b*, 31*c*, or 210. Preferably all doors 105 or windows on a tent 100, 200 includes a mesh layer and tent fabric layer, e.g., nylon or polyester material, and preferably the mesh and tent fabric do not allow bugs to enter the cockpit interior 28 through the mesh and/or tent fabric layers.

A door 105 or a window can provide an entrance/exit to interior 28 of the enclosure formed by the cockpit covering system. The entrance or exit can be unsealed and resealed while the sealable layer 80 continues to seal the cockpit interior 28 at or near the cockpit outer perimeter 110 at or around deck 26 height.

FIG. 5 illustrates a vestibule 106 which can be provided on a rain fly 130. Vestibule 106 can include a stake 140 for supporting vestibule 106. Stake 140 can be secured within a pocket or sleeve on the rainfly 130. Such a vestibule 106 can include a door that can be opened and closed by a zipper. A vestibule 106 can also be provided without a sealable door or closure.

Referring to FIG. 16, some steps of the method are shown. FIG. 16 illustrates locations where brackets 40 and 88 can be positioned on a boat rail or lip 27 when assembling a tent system 10. FIG. 16 also illustrates where hooks 50 can be positioned around the cockpit wall 30. The figure also illustrates the brackets 40, 88 and hooks 50 in position on the boat 20 and with webbing straps 60 extending between a bracket 40 and hook 50, or between a bracket 88 and hook 50. Brackets 40 and 88 and hooks 50 included with a tent system 11 can also be positioned in similar locations to what is shown in FIG. 16, e.g. see FIG. 4. A tent system 201 including brackets 230 and cockpit couplers/interior fittings/hooks 247 can be assembled in a similar manner.

In various embodiments, the method of assembling a cockpit enclosure system comprises the following steps:

1. Attach corner rail brackets 40, with tension straps 60 connected thereto, to the boat outer perimeter;
2. Open at least one tent entrance/exit;
3. Place gunnel hooks, preferably connected to the other end of the tension straps 40, at cockpit gunwale or interior wall corners;
4. Adjust tension in tension straps to create proper tension to achieve placement of tent base, preferably on the deck just outside of the cockpit opening, e.g., spaced about 1 to 3 inches from the cockpit opening;
5. Attach any additional rail hooks 88, preferably with any additional straps 60 attached thereto, to the boat outer perimeter;
6. If any additional straps are also attached to gunnel hooks, place gunnel hooks at cockpit gunwale and apply desired tension to the straps to secure placement of tent base on the deck near the cockpit opening; and
7. Assemble poles by placing within hooks 117 and/or 119 on the tent 100 and also place a selected pole end into a selected pole bracket housing and repeat until all poles are secured in a pole bracket housing;
8. Adjust pole tension with pole foot adjustment to achieve desired tension on tent walls.

In embodiments of the method for system 11, after step 3, a tent side including a flange can be pushed or slide under seats at or near a cockpit edge, e.g., at or near the rear cockpit edge. Then steps 4-8 can be performed to assemble a tent covering system 11.

In various embodiments, preferably rail brackets with tension straps secured thereto are first attached to a windward side of the boat or skiff, then attached to the other side of the boat.

Preferably, after the rail brackets with tension straps connected thereto are positioned around the boat, and the poles are within the pole housings, the cockpit enclosure and covering system is secured to the boat.

In some embodiments, the rail brackets can be positioned on the boat prior to threading a tension strap therethrough.

In various embodiments, the method includes further adjusting tension on tension straps until a desired amount of seal on the sealable layer is achieved.

In various embodiments, the method includes further adjusting tension on tension straps until desired amount of pressure on the bug and/or water proof seal around the cockpit opening and enclosure interior is created to achieve the desired amount of seal.

In various embodiments of the method, a rain fly is assembled over the cockpit enclosure or cover.

In various embodiments of the method, assembling a rain fly comprises the following steps:

1. Attaching a rain fly strap to a bow line, e.g., a zip tie;
2. Attaching additional rain fly straps to rail brackets;
3. Attaching additional rain fly straps to port and starboard eyelets;
4. Flexing a vestibule pole or stake into foot pockets on starboard and port sides and rotating to appropriately spaced clips.

Preferably 4 rain fly straps are attached to 4 rail brackets and are attached to a rail bracket loop positioned to the exterior of the boat and underneath a boat rail or side.

A covering system 10, 11 or 201 can be assembled on a boat 20 while in open water 197, and not moving with anchor 196 working to maintain the boat 20 in place. A covering system 10, 11 or 201 can also be assembled on a boat 20 while in open water 197 near a marshy area 194.

FIGS. 23-40 illustrate a third preferred embodiment of a cockpit covering system designated generally by the numeral 201. Except as specifically designated below, system 201 can include the same or similar component parts as systems 10, 11 of FIGS. 1-22 and can function and be assembled in a similar manner. A tent/cover 200 preferably includes four walls/wall portions 101, 102, 103, 104 and is preferably sized so that a tent base/tent base portion/skirt 222 rests on a boat deck 26 at or near a cockpit 21 outer perimeter 110 and so that tent/cover 200 covers a cockpit recess 15 area and an interior 28. Preferably tent/cover 200 does not have a bottom portion that completely covers recessed area 15 of cockpit 21, although a portion of skirt 222, e.g., part of an inner skirt/flare portion 225 can potentially extend past deck 26 a distance over or into recessed area 15. A boat/skiff 20 can include a motor 211, a steering column 216, and standing rail/rails or seat 217, 218.

Figure 35A:
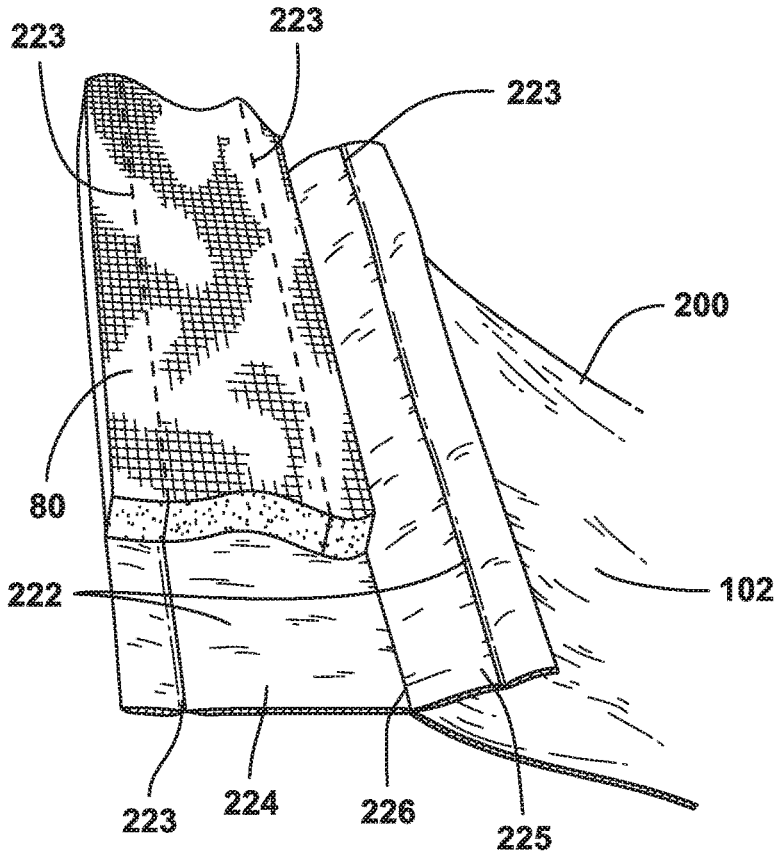
FIG. 35A is a partial perspective view of the third preferred embodiment of a tent covering system of the present invention illustrating one embodiment of a tent base portion.
Figure 35B:
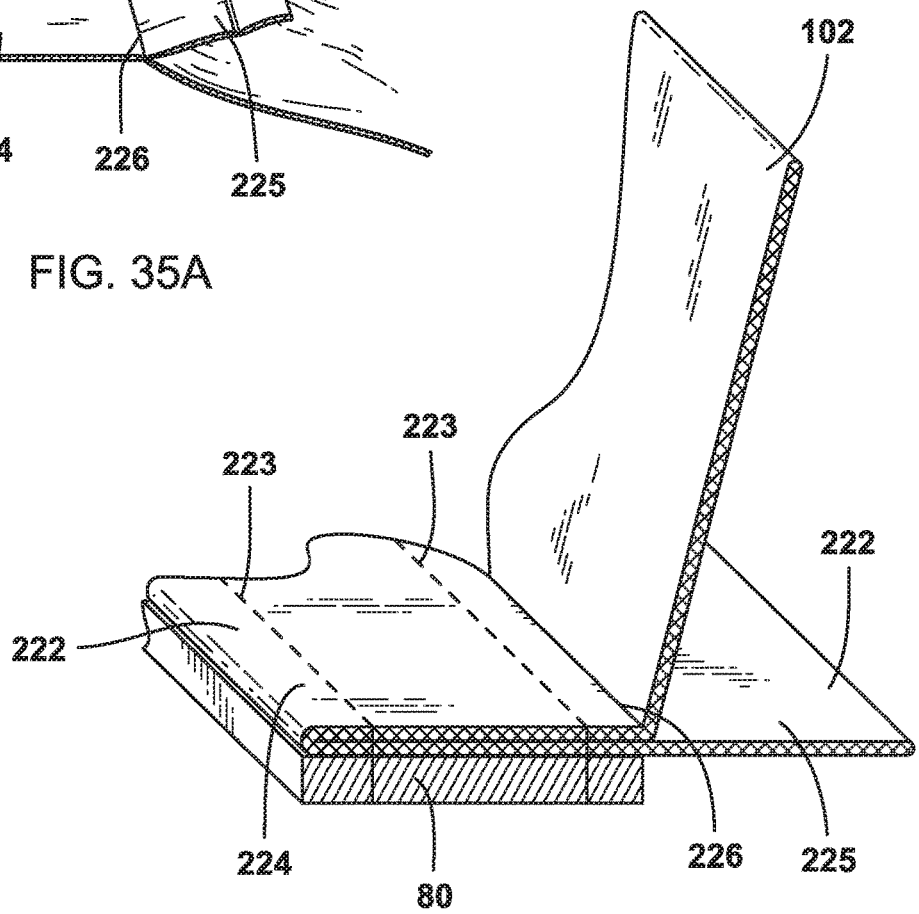
FIG. 35B is a partial perspective view of the third preferred embodiment of a tent covering system of the present invention illustrating another embodiment of a tent base portion.

Referring first to FIGS. 35A and 35B, tent/cover 200 can include an alternative embodiment of a tent base/tent base portion/skirt which is designated generally by the numeral 222. FIG. 35A shows a cutaway bottom view of a first alternate embodiment of a skirt 222, and FIG. 35B shows a side cut away view of a second alternate embodiment of a skirt 222. Preferably, an embodiment of a tent skirt 222 used in system 201 does not include tent base webbing layer 55. A tent base webbing layer 55 is not needed in a skirt 222 to help promote a flat lie of skirt 222 on deck 26.

A skirt 222 can be formed from the same material or fabric as a tent 200 wall 101, 102, 103, 104 and can be coupled to a tent 200 along tent walls 101, 102, 103, 104, at a seam 226. In FIGS. 35A and 35B, skirt 222 is shown coupled to wall 102. Material of tent wall 102 can be folded back on itself to form a skirt 222 having an outer flare/outer skirt portion 224 and an inner flare/inner skirt portion 225 (see FIG. 35B) or skirt 222 can be formed from a separate piece of material/fabric that is coupled to a tent wall, e.g., wall 102 at seam 226 (see FIG. 35A). Tent wall/wall portion 102 can extend upwards from skirt 222 at seam 226, for example, which can be a sewn/stitched seam. A skirt 222 can also be attached to a tent wall portion 101, 102, 103, 104, in other manners as are currently known in the art or to be developed in the future, e.g., via an adhesive.

In the embodiment as shown in FIG. 35B, if desired, inner flare or skirt 225 can also be folded back on itself to form a double fabric layer inner flare or skirt 225, at least in a portion of inner flare/skirt 225. In the embodiments of both FIGS. 35A and 35B, a compressible layer, e.g., gasket 80, or a rubber, foam or other material that can be pressed against a deck surface, can be coupled to the bottom of outer flare portion 224 as shown, e.g., at stitches/sewn connections 223. Gasket 80 can be about 4-5 millimeters thick. Compressible sealing layer/gasket 80 helps promote a flat lie of skirt 222 on deck 26. If desired, a skirt 222 outer 224 and/or inner 225 flare/skirt portions can include 2 or more layers of fabric/material, e.g., 2, 3, 4, 5, 6, or more layers of fabric/material.

In some embodiments, a compressible layer/gasket 80 can be included under both outer skirt/flare 224 and inner skirt/flare 225 of skirt 222.

Figure 40:
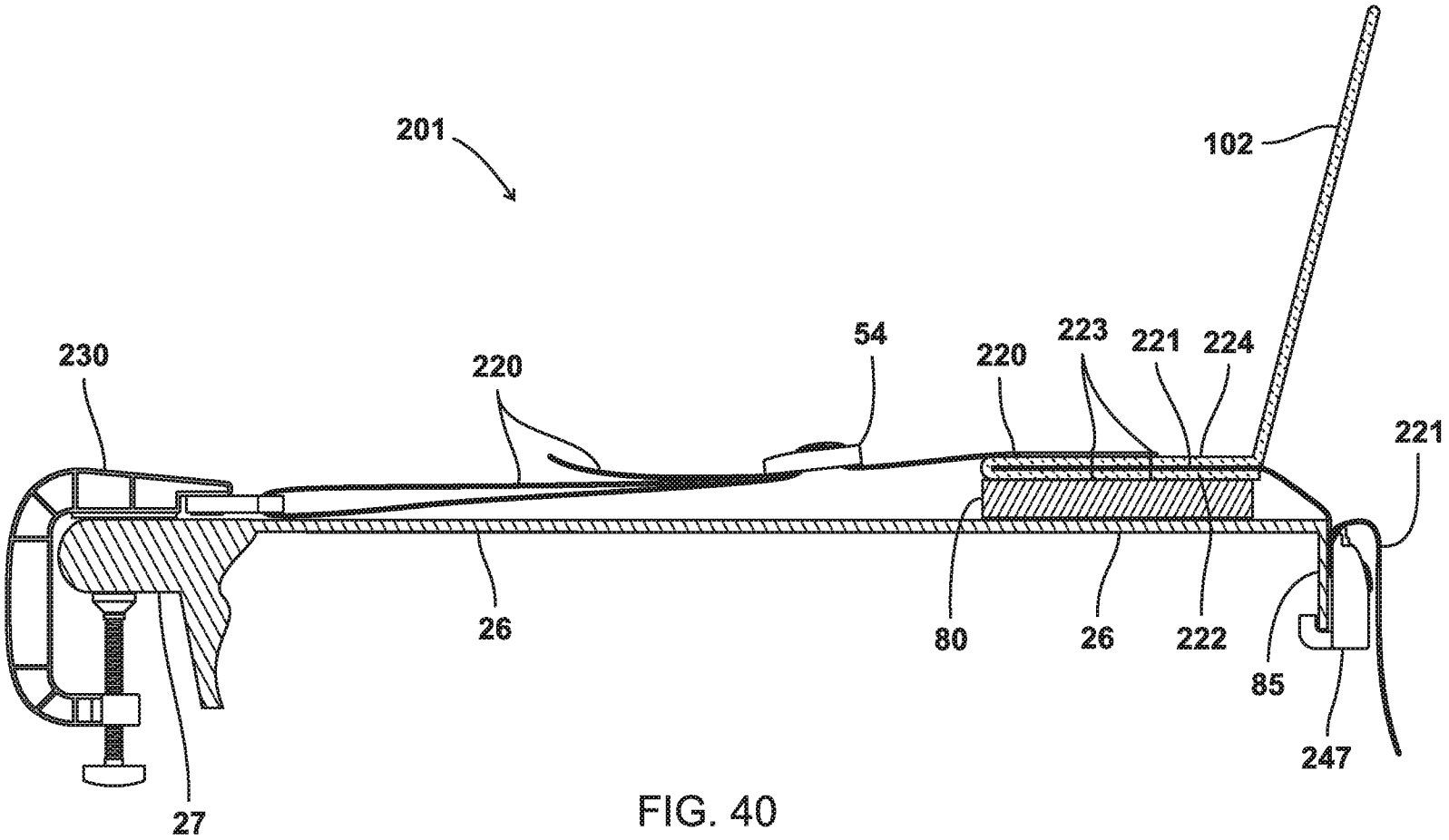
FIG. 40 is a partial cutaway view illustrating the third preferred embodiment of a covering system and another embodiment of a tent base portion.

FIG. 40 shows a third alternative embodiment of a skirt 222 in which there is no inner skirt/inner flare 225. In this embodiment, an outer strap 220 is coupled to a top surface of outer skirt/outer flare 224 of skirt 222 at stitches 223. An inner strap 221 is coupled in between upper and lower layers of outer skirt/outer flare 224 of skirt 222 at stitches 223. In the embodiment as shown, outer flare/outer skirt 224 is an extension of wall 102 fabric. An outer flare/outer skirt 224 could also be a separate piece of material sewn or otherwise coupled to a tent wall 101, 102, 103, 104, if desired. Exterior 220 and interior 221 straps can also be coupled to skirt 222 outer flare/outer skirt 224 at other locations if desired, e.g., on top or bottom surfaces, or between fabric layers. Straps 220 and 221 can be stitched together at stitches 223, or inner strap 221 can be stitched or otherwise coupled to flare/skirt 224 at a location before reaching strap 220. A compressible layer/gasket 80, e.g., at about 4-5 millimeters thick, can be coupled to a bottom of skirt 222 outer flare/outer skirt 224.

A tent base layer 222 as shown in FIGS. 35A-35B and 40 and described herein can also be used in the systems 10, 11 if desired.

As mentioned, in tent/cover 200 exterior 220 and interior 221 webbing/straps are included. A plurality of exterior straps/exterior webbing 220 can be coupled (e.g., sewn at sewn connection/stitches 223) to an upper surface of skirt 222 outer flare/skirt 224, in the embodiments of skirt 222 as shown in FIGS. 35A-35B and 40. Preferably exterior straps 220 are coupled to skirt 222 at tent corners (see, for example, FIG. 24). Exterior straps 220 can also be coupled to skirt 222 along sides of tent/cover 200 if desired (see for example, FIG. 25). Straps 220 preferably are sized to extend between an outer rail bracket/exterior fitting 40, 88, or 230 on boat 20 and the tent skirt 222 (e.g., at outer flare/skirt 224) and sized so that tension (e.g., applied via pulling) can be applied to straps 221. Straps 220 can be coupled to a exterior fitting/outer rail bracket 40, 88, or 230. Interior straps 221 can be placed on skirt 222 so that they extend in a direction that is at least about opposite from the direction that exterior straps 220.

Figure 27:
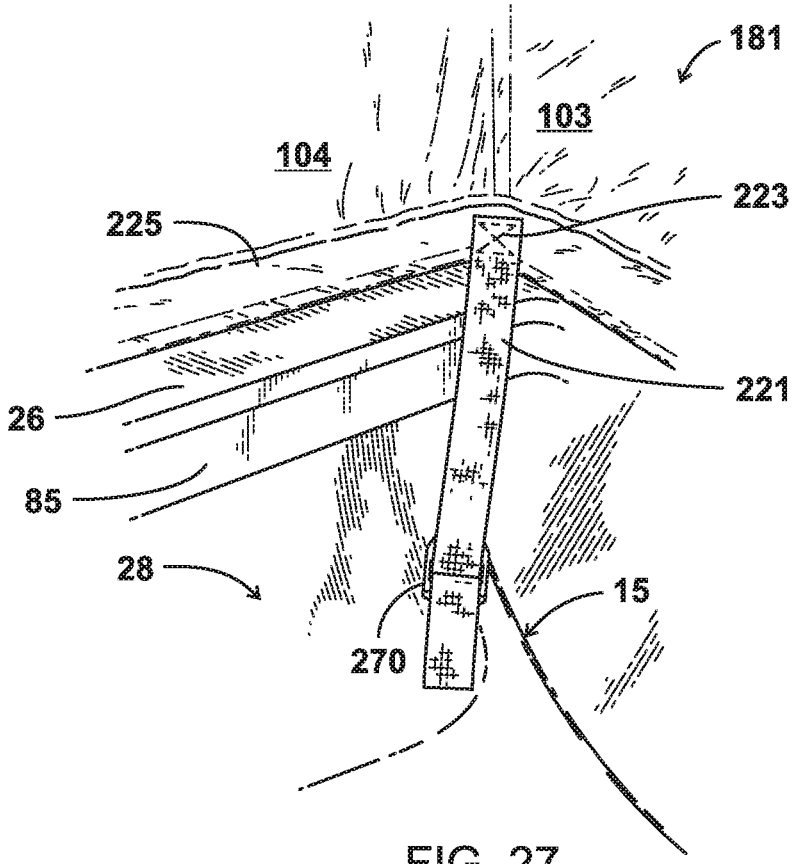
FIG. 27 is a partial perspective view of the third preferred embodiment of a tent covering system of the present invention illustrating an interior strap.
Figure 28:
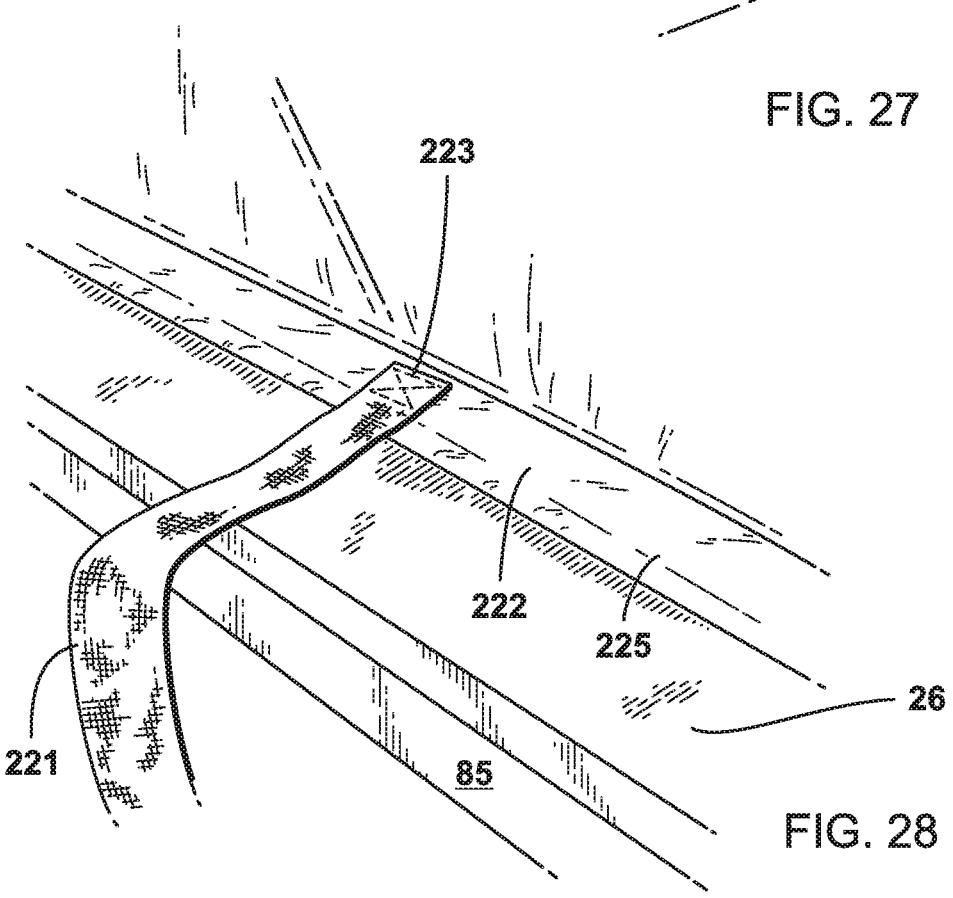
FIG. 28 is a partial perspective view of the third preferred embodiment of a tent covering system of the present invention illustrating an interior strap.

A plurality of interior straps/interior webbing 221 can be coupled (e.g., sewn at sewn connection/stitches 223) to skirt 222 inner flare/skirt 225 on an upper surface of inner skirt/flare 225 at tent corners, e.g., as shown in FIG. 27. A plurality of interior straps/interior webbing 221 can also be coupled (e.g., sewn at sewn connection/stitches 223) to skirt 222 inner flare/skirt 225 on an upper surface of inner skirt/flare 225 along tent sides if desired, e.g., as shown in FIG. 28. Straps 221 can also be coupled to an outer flare/skirt 224, e.g., as shown in FIG. 40. Strap 221 can also be coupled to a bottom surface of outer flare/skirt if desired, or to a top portion of outer flare/skirt 224, if desired. Straps 221 preferably are sized to extend from skirt 222 (either at tent inner skirt 225 (if included as part of skirt 222) or from an outer skirt 224) to an interior cockpit fitting, e.g., hook 50, 247 and sized so that tension (e.g., applied via pulling) can be applied to straps 221.

Exterior 220 and interior 221 straps can also be coupled to a skirt 222 in other ways as are known in the art or to be developed in the future, e.g., via an adhesive.

Figure 23:
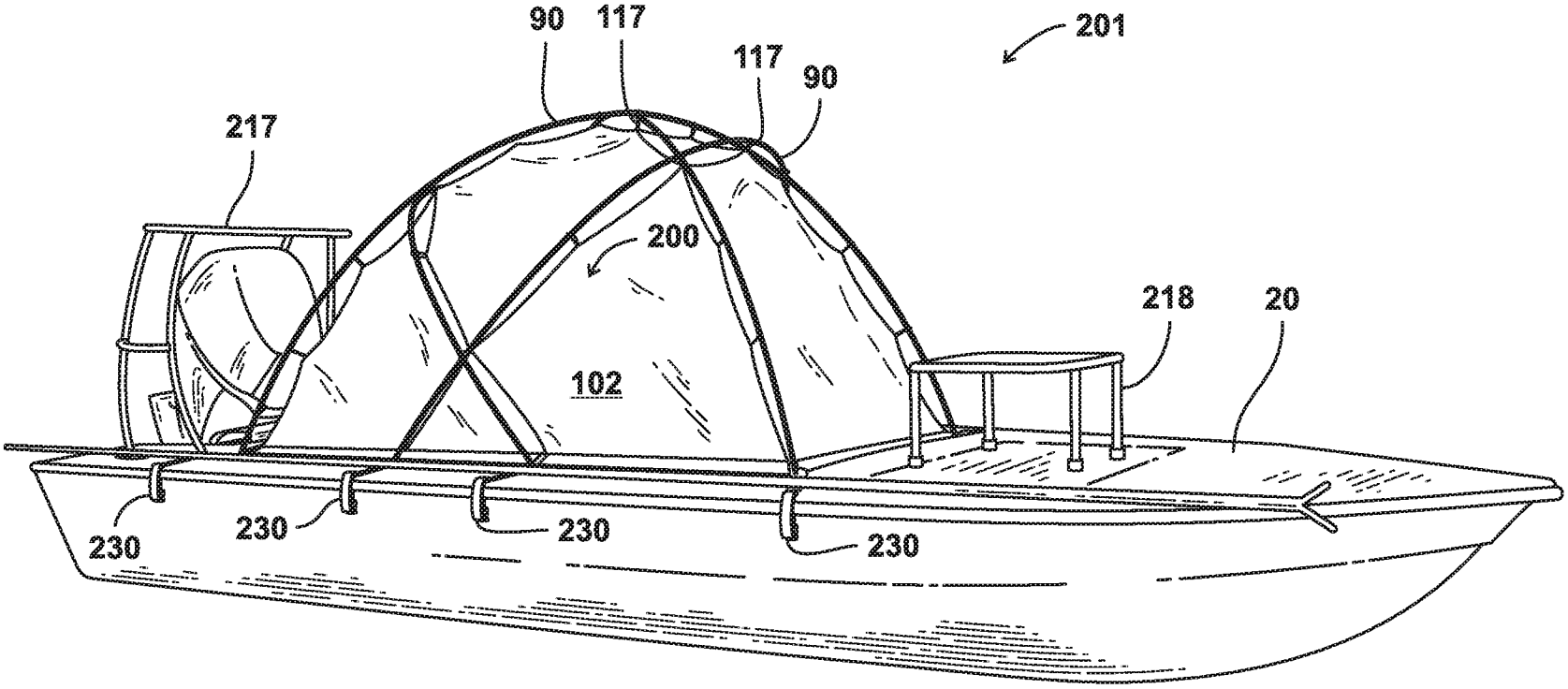
FIG. 23 is a perspective view of a third preferred embodiment of a tent covering system of the present invention.

A tension buckle 54 can be provided on exterior webbing/exterior straps 220, and can receive a free end of exterior webbing/exterior straps 220 after being coupled to (e.g., threaded through a rail bracket/exterior fitting/c-clamp 40, 88 or 230, so that tension of strap 220 can be adjusted to secure tent 200 in place on boat 20 (see, for example, FIGS. 23, 26, 40). Adjusting tension of strap 220 can also compress compressible layer/gasket 80. A free end of a tension strap 220 can be coupled back to itself after being threaded through openings on a bracket/exterior fitting/c-clamp 40, 88 or 230 and tension buckle 54, e.g., by sewing or adhesive or heat sealing. The amount of tension of tension strap 220 can be adjusted 0.1, 1, 5, 10, 15, 20, 25, 30, 35, 40, 45, 50, 55, 60, 65, 70, 75, 80, 85, 90, 95 or 100 percent, or at a percentage therebetween.

In the embodiments of FIGS. 23-40, an individual tension buckle is not shown on interior straps/interior webbing 221 which are coupled to a buckle portion that is formed as part of hook 247, as described further herein below. If an interior strap/interior webbing 221 is used with a hook 247, a tension buckle 54 is not needed. If a hook 50 is to be used in a system that includes tent/cover 200, a tension buckle can be provided on interior strap/interior webbing 221 if desired so that tension, e.g., applied via pulling, can also be adjusted for interior strap/interior webbing 221. The amount of tension of tension strap 221 can be adjusted 0.01, 1, 5, 10, 15, 20, 25, 30, 35, 40, 45, 50, 55, 60, 65, 70, 75, 80, 85, 90, 95 or 100 percent, or at a percentage therebetween, Tent/cover 200 includes a plurality of pole housings, e.g., grommets 215, sewn onto outer flare portion 224 of a skirt 222 (see FIGS. 24-26, 40). A grommet 215 can receive an end 96 of a pole 90. Preferably a pole end 96 can be releasably coupled, or locked, within grommet 215. Preferably a pole end 96 comprises a shape and size allowing it to mate with, and snugly nest within grommet 215 when pushed, for example, into opening 209 of grommet 215, and to also be removed from grommet 215 when desired, e.g., via pulling, or twisting of pole 90 and/or pulling or twisting of grommet 215. A tent/cover 100 of systems 10, 11, can also include a grommet 215 on an outer flare portion of tent base 34 for example, instead of, or in addition to one or more tent pole bracket housings 91 on webbing straps 60, if desired.

Figure 30:
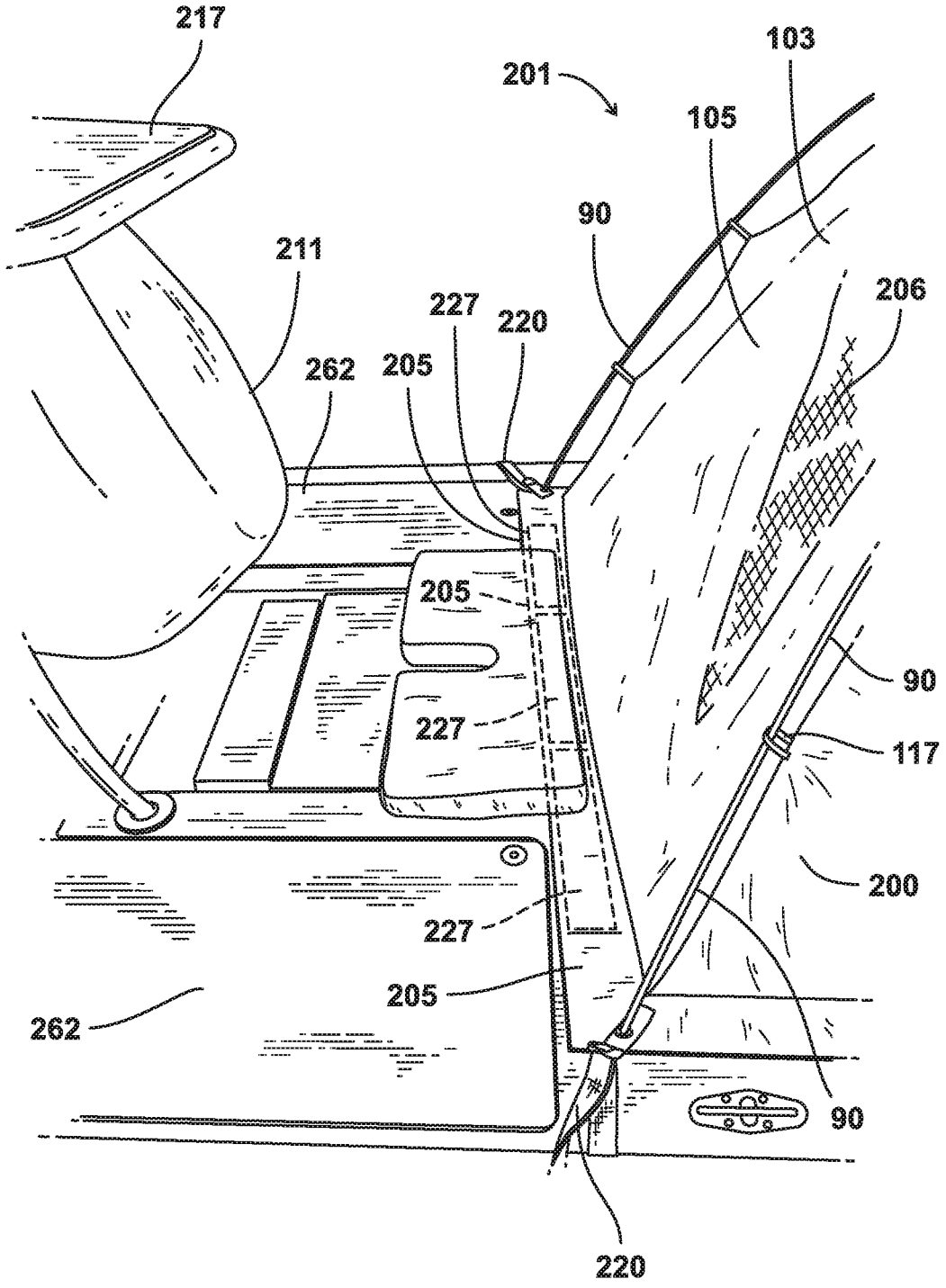
FIG. 30 is a partial perspective view of the third preferred embodiment of a tent covering system of the present invention.
Figure 31:
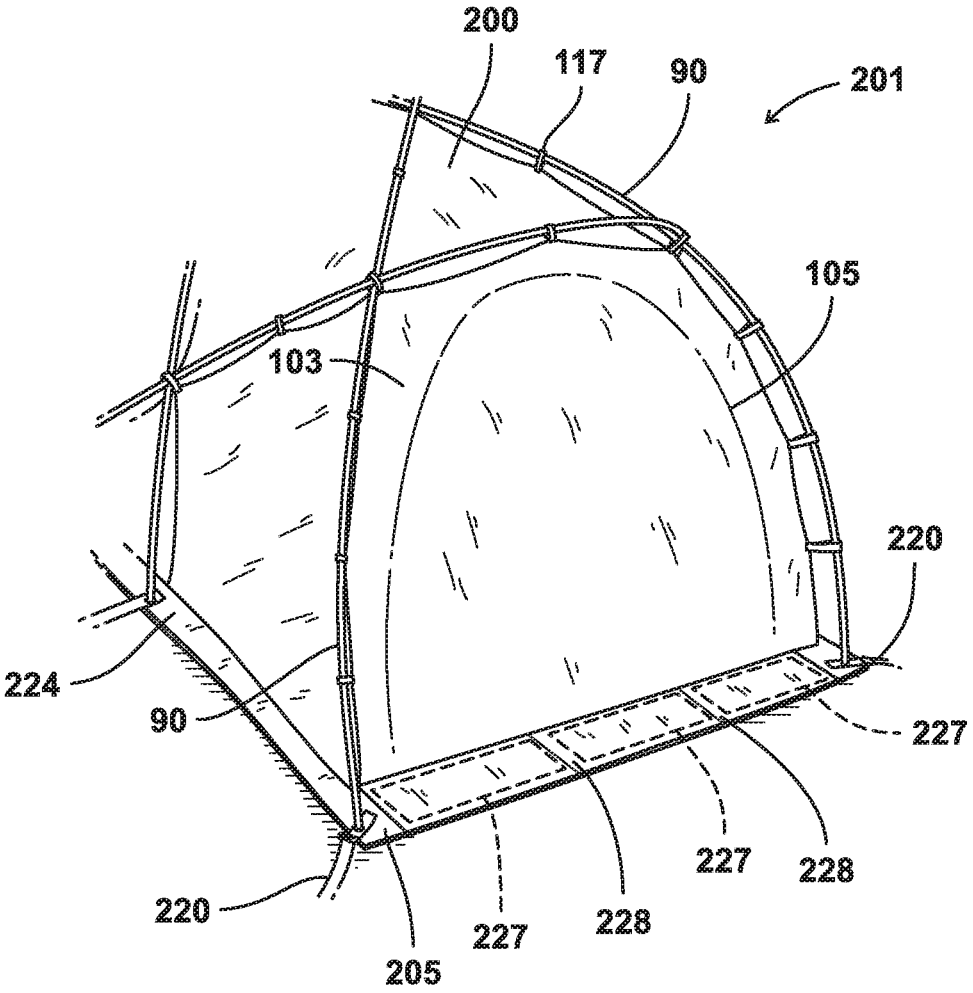
FIG. 31 is a partial perspective view of the third preferred embodiment of a tent covering system of the present invention.
Figure 32:
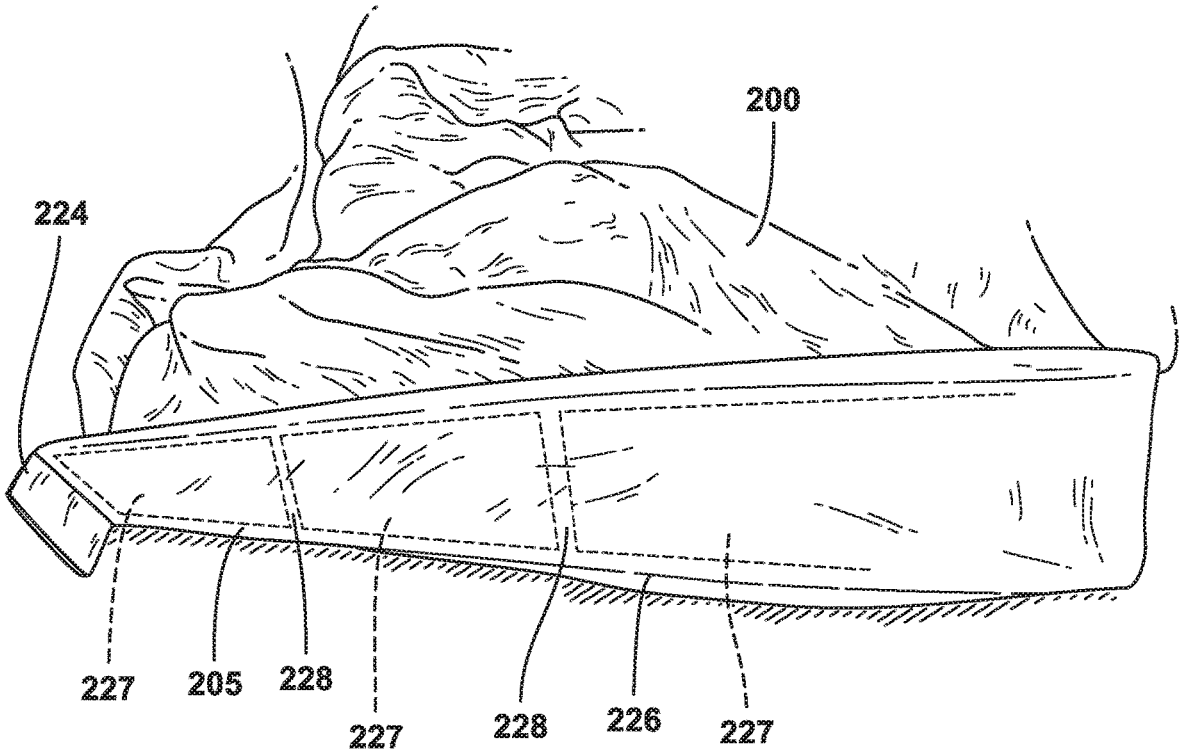
FIG. 32 is a partial perspective view of the third preferred embodiment of a tent covering system of the present invention illustrating a tent base seat insert portion.

Tent/cover 200 of system 201 also includes an alternative embodiment of a flange portion/base insert/skirt insert, which is designated generally by the numeral 205 in the figures. In the embodiment as shown in FIGS. 23, 29-34, flange portion/base insert/skirt insert 205 is a portion of skirt 222 that includes inserts 227 inside outer flare/outer skirt 224 along a side of skirt 222. A skirt insert 205 can be included in a skirt 222 of FIGS. 35A-35B and 40. Inserts 227 are preferably made of a material that provides some rigidity but which is also flexible. Inserts 227 preferably are made of a plastic material. Inserts 227 can also be made of metal if desired, but plastic is a preferred material to help prevent tearing or wearing of the fabric. Inserts 227 can be sewn within skirt 222 outer flare 224 along any tent side that will be positioned at or near a cockpit side wherein a boat seat is located at or near the cockpit outer perimeter on that cockpit side. Skirt insert 205 can be inserted under a seat 210, for example, in between a deck 26 surface and seat 210, as shown in FIGS. 29-30. Seat 210 helps to hold skirt insert 205 in place on deck 26 of boat 20. Tension applied to straps 220 also help to hold skirt insert 205 in place on deck 26 of boat 20. A seat insert 205 can also be used with a boat that has seats similar to seats 31*a*, 31*b*, and 31*c*.

Inserts 227 can be about 15 inches long, for example, if three inserts 227 will be used on a tent side. A seat insert 205 can be about ⅛ inch high, when a gasket 80 is not included. About 3 and ¼ inches of fabric can extend between a tent corner and a first insert of a seat insert 205. A space 228 between inserts can be about 1 centimeter to 1 inch.

In some embodiments, inserts 227 can be coupled or adhered to an upper or bottom surface of outer flare portion 224 of a skirt 222 as shown in FIGS. 29-31, 34, e.g., instead of sewn within outer flare portion 224, to form a seat insert 205. A seat insert 205 can be included on any tent 200 side that will be positioned on a cockpit side that has a seat at or near the cockpit outer perimeter. A flange portion/skirt insert 205 can also be included in a tent 100 of system 11 instead of flange 126 if desired. A compressible sealing layer/gasket 80 does not have to be included under a skirt insert 222, but can be included under a skirt insert 205 if desired and if there is room for compressible layer/gasket 80 to fit under seat 210. If a compressible layer/gasket 80 is not included under skirt insert portion 205, compressible layer/gasket 80 provided on other tent sides can end at respective tent corners where skirt insert 205 begins, or can be sized to end at or near edges of a seat 210.

Figure 33:
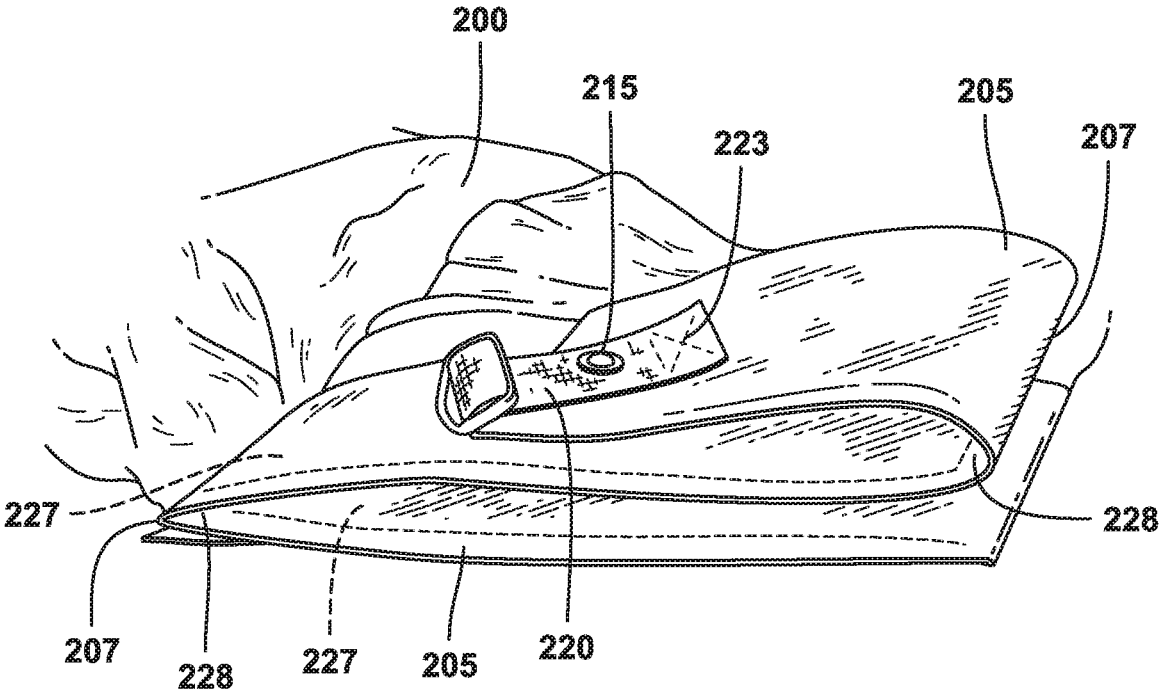
FIG. 33 is a partial perspective view of the third preferred embodiment of a tent covering system of the present invention illustrating a tent base seat insert portion.

Preferably a plurality of spaced apart inserts 227, e.g., 3 as shown in the figures, are included in a flange portion/base insert/skirt insert 205. Leaving spacing (designated by the numeral 228) between inserts 227 allows flange portion/base insert 205 to be folded as shown in FIG. 33, for example, at a fold 207. Space 228 allows tent/cover 200 to be folded, e.g., for storage. Any desired number of inserts 227 can be included in a flange portion/base insert/skirt insert 205, however, preferably at least 2 inserts 227 are included to enable more compact folding of tent/cover 200.

Figure 34:
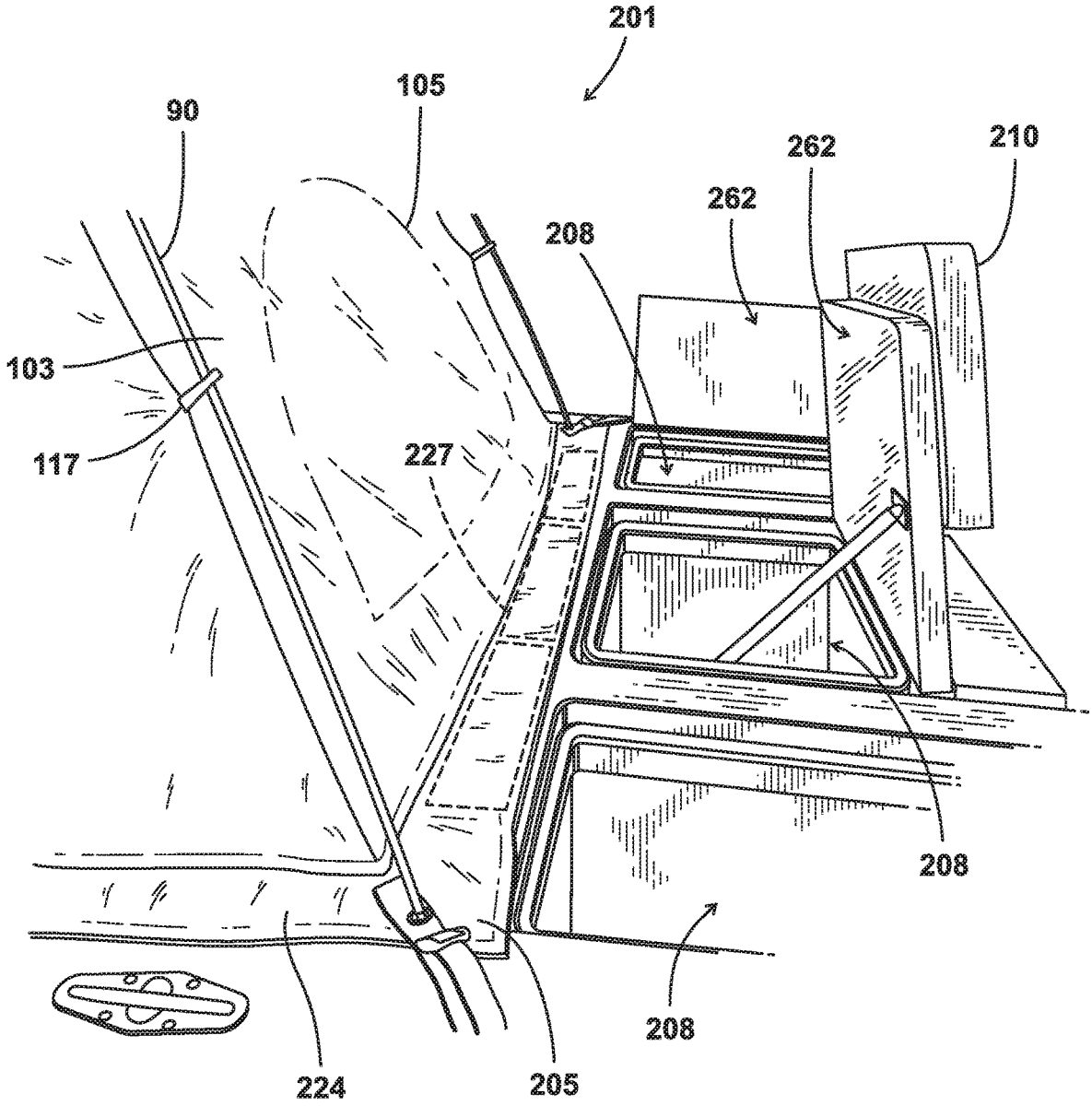
FIG. 34 is a partial perspective view of the third preferred embodiment of a tent covering system of the present invention.

Referring to FIG. 34, a plurality of hatches/hatch doors 262 are shown, and seat 210 is on a hatch door 262. The hatches 262 can open to an interior 208. Door 105 on rear/aft wall 103 can be unzipped from an interior 28 of tent 200 to access hatches 262 when tent 200 is installed on boat 20. In this manner, access to boat hatches 262 is allowable while a user is under shelter of tent 200.

FIGS. 36A-37F illustrate an alternative embodiment of a boat fitting/outer rail bracket/c-clamp/c-bracket, designated generally by the numeral 230. Boat fitting 230 as shown comprises a c-shape having lower and upper transverse portions 231, 233, with longitudinal portion 239 extending downward from upper transverse portion 233 to lower transverse portion 231. Boat fitting 230 includes a movable buckle portion/strap coupler/pivot member 232. Exterior webbing/exterior strap 220, or a webbing strap 60 can be threaded through opening 251 of movable buckle/strap coupler/pivot member 232 for coupling exterior webbing/exterior strap 220, or a webbing strap 60 to rail bracket 230. Movable buckle/strap coupler 232 can move along rotational axis 256 in the direction of arrows 252. Preferably movable buckle/strap coupler/pivot member 232 can move a total of about 90 to 180 degrees along rotational axis 256, or about 45 to 90 degrees in either direction along rotational axis 256. Stop 261 can stop movable buckle/strap coupler/pivot member 232 from moving more than 90 degrees in either direction, for example, if desired. Movable buckle/strap coupler/pivot member 232 can move along rotational axis 256 while attaching a strap 220 or 60 thereto, when positioning a tent 200, 100 in place on a boat 20, and/or when applying tension to exterior webbing/exterior strap 220, or a webbing strap 60, e.g., via a tension buckle 54. Movable buckle/strap coupler/pivot member 232 can move based on the angle of a strap 60, 220 extending from a tent 200, 100.

Opening/space 259 between lower transverse portion 23 land upper transverse portion 233 can receive a rail or lip 27 of boat or skiff 20, in a similar manner as described with regards to brackets 40, 88. The dimensions of bracket/fitting 230 can vary depending on the dimensions of a rail or lip 27 of a boat or skiff 20 and/or the shape of a rail or lip 27 of a boat or skiff 20. Dimensions of a bracket/fitting 230 can be similar to dimensions of brackets 40, 88. Movable buckle/strap coupler/pivot member 232 can rest on boat deck 26 when bracket 230 is coupled to a boat 20 (see, for example, FIG. 40). Preferably a cushioning material, e.g., rubber 237, is provided on surfaces of portions 231, 233, 236 and 239 of bracket 230 that will be in contact with rail or lip 27 or another boat surface, which commonly can be fiberglass. Preferably a bracket/fitting 230 is made of a plastic material. Other suitable materials as desired can also be used for bracket/fitting 230.

Figure 36B:
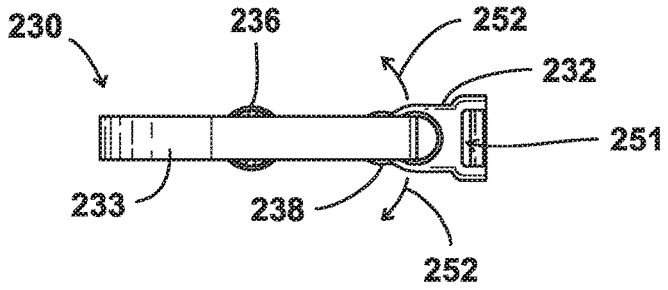
FIG. 36B is a top view of the third preferred embodiment of a rail bracket that can be used in one or more preferred embodiments of the apparatus, system and method of the present invention.
Figure 36A:
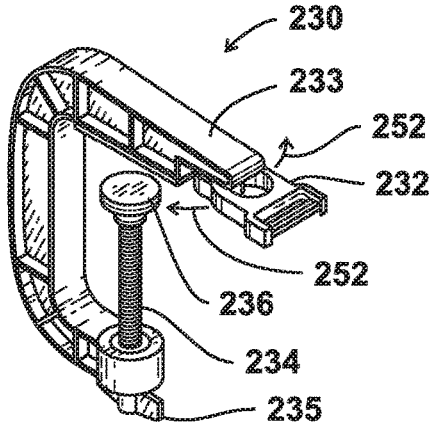
FIG. 36A is a perspective view of a third preferred embodiment of a rail bracket that can be used in one or more preferred embodiments of the apparatus, system and method of the present invention.
Figure 36C:
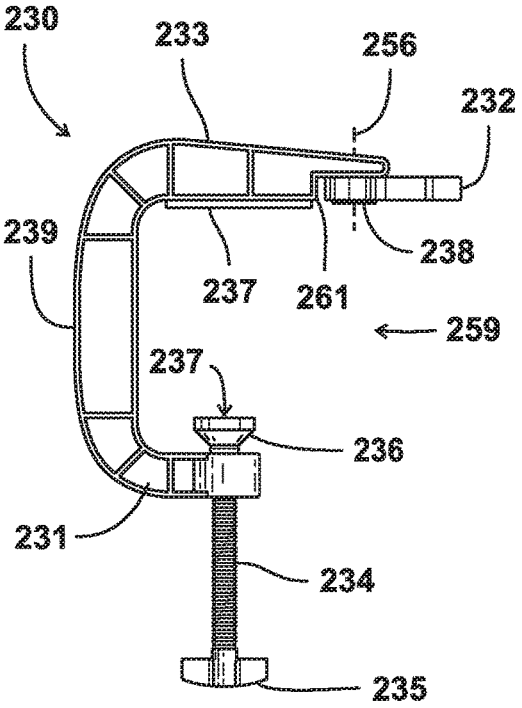
FIG. 36C is a side view of the third preferred embodiment of a rail bracket that can be used in one or more preferred embodiments of the apparatus, system and method of the present invention.
Figure 36D:
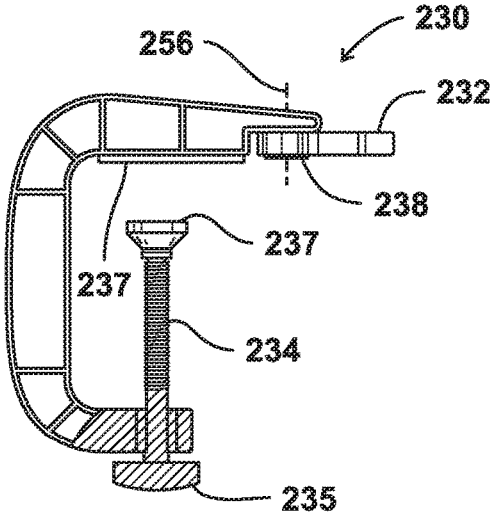
FIG. 36D is a side view of the third preferred embodiment of a rail bracket that can be used in one or more preferred embodiments of the apparatus, system and method of the present invention.
Figure 36E:
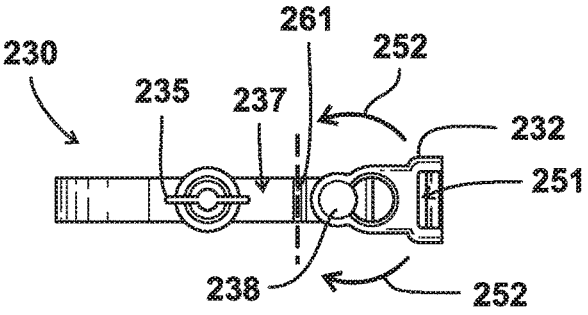
FIG. 36E is a bottom view of the third preferred embodiment of a rail bracket that can be used in one or more preferred embodiments of the apparatus, system and method of the present invention.

Bracket/fitting 230 also preferably comprises an adjustable tightening means, e.g., bolt 234 having a top portion/head 236, preferably with cushioning layer 237 thereon, and an end/handle 235 which can be rotated to enable a tight fit of bracket 230 on lip or rail 27. Bolt 234 can be a swivel bolt. Preferably any portion of bolt 234 that will contact the rail or lip 27 of a boat or skiff 20 surface will have a cushioning layer, e.g. rubber 237, at a top surface as shown in FIGS. 36A, 36C, 36D. Rubber 237 can be about ⅛ inch thick, for example.

Figure 36F:
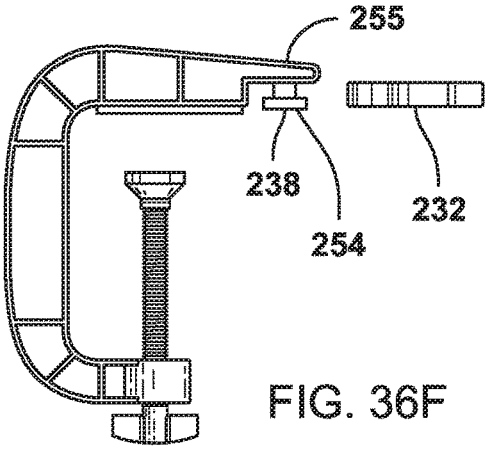
FIG. 36F is a side view of the third preferred embodiment of a rail bracket that can be used in one or more preferred embodiments of the apparatus, system and method of the present invention.
Figure 37A:
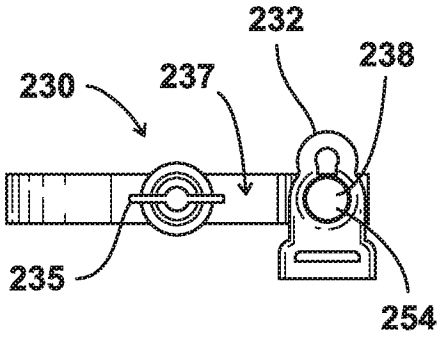
FIG. 37A is a bottom view of the third preferred embodiment of a rail bracket that can be used in one or more preferred embodiments of the apparatus, system and method of the present invention, illustrating a first pivot assembly step.
Figure 37B:
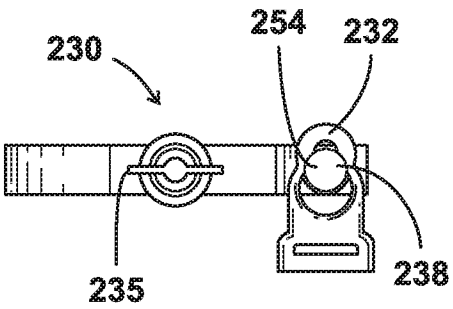
FIG. 37B is a bottom view of the third preferred embodiment of a rail bracket that can be used in one or more preferred embodiments of the apparatus, system and method of the present invention, illustrating a second pivot assembly step.
Figure 37C:
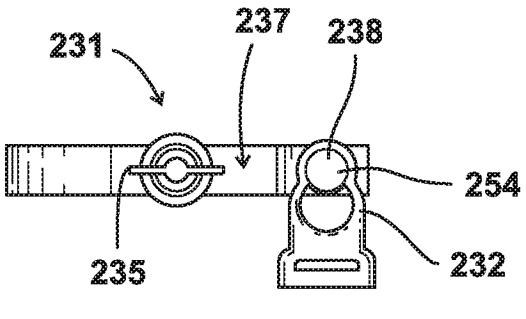
FIG. 37C is a bottom view of the third preferred embodiment of a rail bracket that can be used in one or more preferred embodiments of the apparatus, system and method of the present invention, illustrating a third pivot assembly step.
Figure 37D:
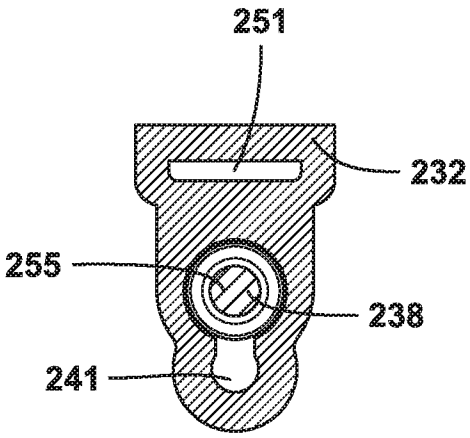
FIG. 37D is a bottom view of a pivot connection as shown in FIG. 37A.
Figure 37E:
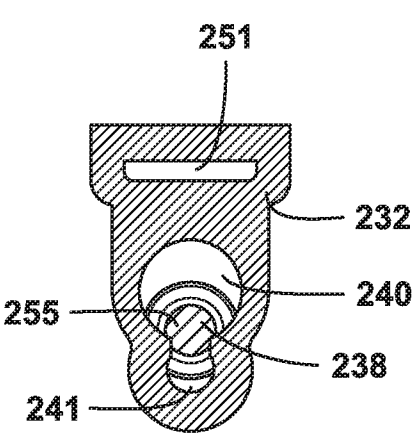
FIG. 37E is a bottom view of a pivot connection as shown in FIG. 37B.
Figure 37F:
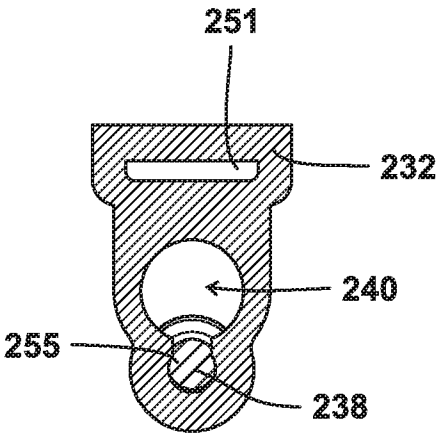
FIG. 37F is a bottom view of a pivot connection as shown in FIG. 37C.

FIGS. 37A-37F illustrate how a movable buckle/strap coupler/pivot member 232 can be coupled to bracket/fitting 230. Bracket/fitting 230 as shown in FIG. 36F includes button/pin/disc 238 having a wider top portion 254 and an narrower longitudinal portion 255 that is attached to rail bracket 230. Larger portion 254 of button/pin/disc 238 can be positioned through larger opening 240 of movable buckle/strap coupler/pivot member 232. Movable buckle/strap coupler/pivot member 232 can be moved so that narrow longitudinal portion 255 of button/pin/disc 238 slides into smaller opening 241 to lock movable buckle/strap coupler/pivot member 232 in place on button/pin/disc 238. When applying tension to exterior webbing/exterior strap 220, or a webbing strap 60, movable buckle/strap coupler/pivot member 232 can pivot or move along rotational axis 256 of button 238 based on the angle of a webbing strap 60, 220 extending from a tent/cover 100, or 200.

Figure 38B:
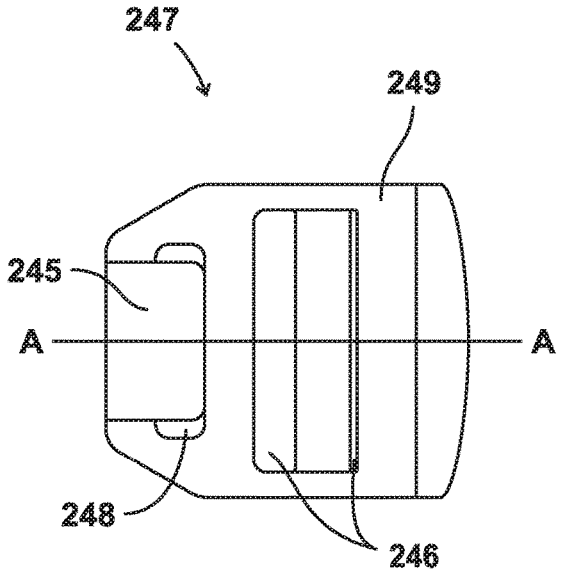
FIG. 38B is a top view of the second preferred embodiment of a cockpit hook that can be used in one or more preferred embodiments of the apparatus, system and method of the present invention.
Figure 38A:
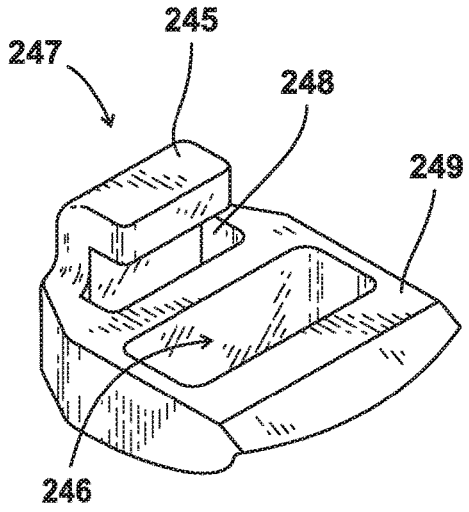
FIG. 38A is a perspective view of a second preferred embodiment of a cockpit hook that can be used in one or more preferred embodiments of the apparatus, system and method of the present invention.
Figure 38C:
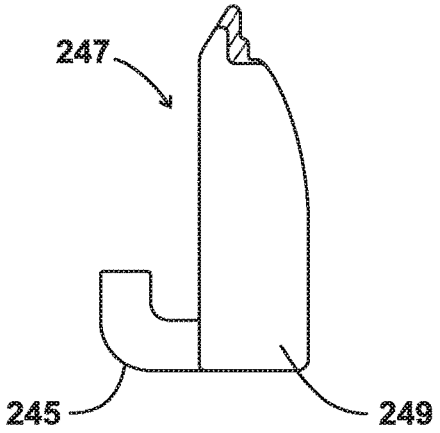
FIG. 38C is a side view of the second preferred embodiment of a cockpit hook that can be used in one or more preferred embodiments of the apparatus, system and method of the present invention.
Figure 38D:
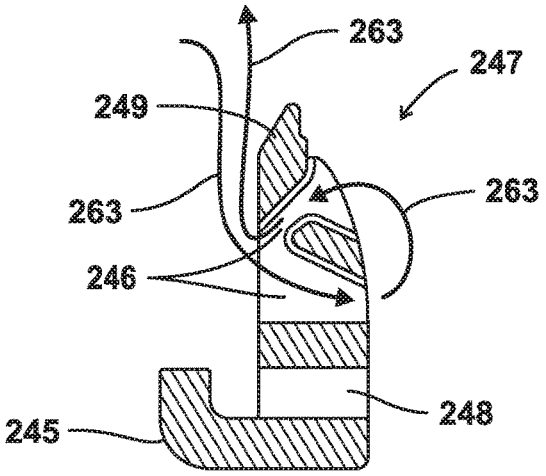
FIG. 38D is a sectional view taken along lines A-A of FIG. 38B.
Figure 39:
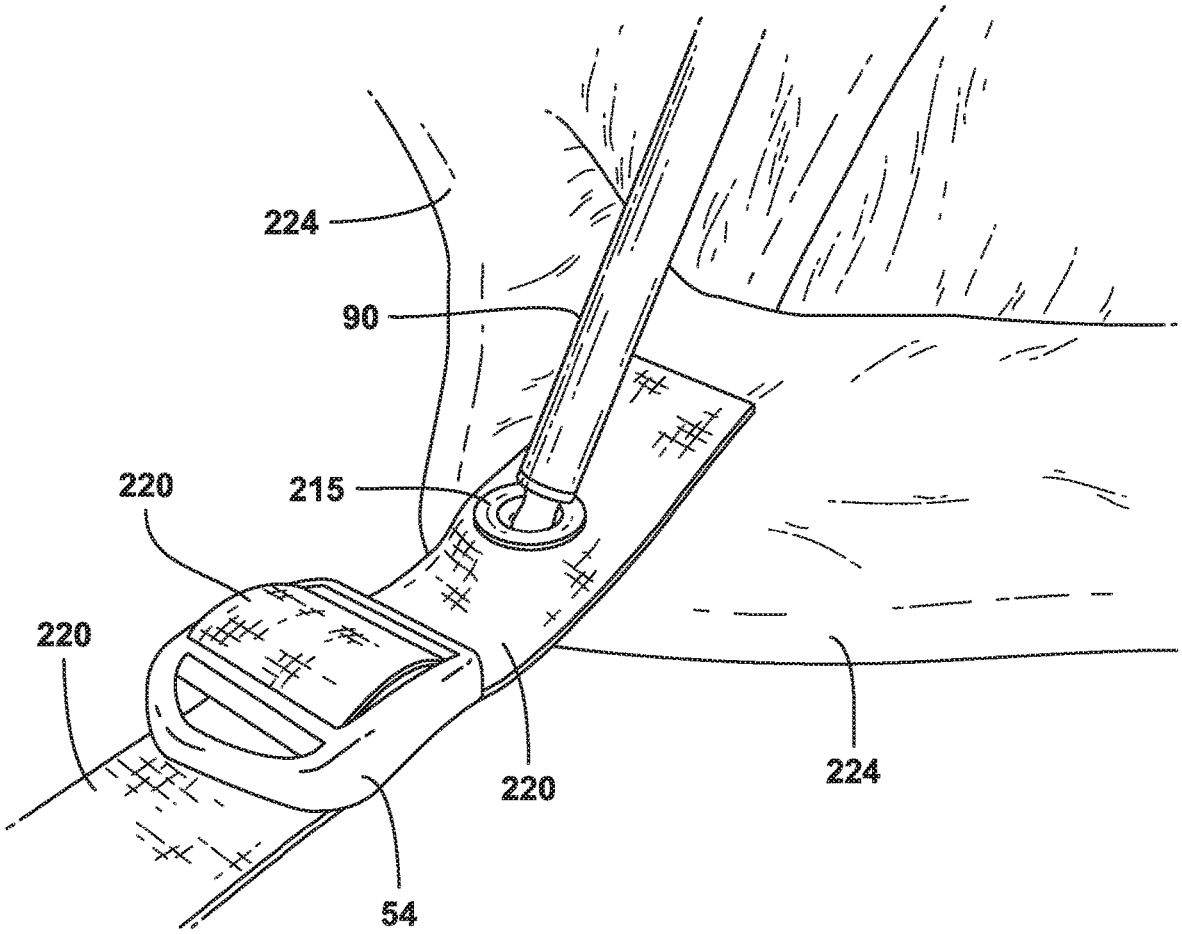
FIG. 39 is a partial perspective view of the third preferred embodiment of a tent covering system of the present invention.

FIGS. 38A-38D illustrate a second preferred embodiment of hook or cockpit coupler or interior fitting, designated generally by the numeral 247 which can be used with a tent/cover 100, or 200 in systems 10, 11 and 201. Hook/cockpit coupler/interior fitting 247 includes a buckle or strap coupler portion 246, which is adapted for applying tension to a strap 221 or 60 that extends from a tent/cover 100 or 200 to a cockpit or deck lip 85 at or near a cockpit recessed area 15. Interior webbing/interior strap 221, or webbing strap 60, can be threaded through buckle or strap coupler portion 246 of hook/interior fitting/cockpit coupler 247 on longitudinal portion 249 in the direction of arrows 263 as shown in FIG. 38D. Bottom hook portion 245 can be hooked under or onto a cockpit wall or deck lip 85. Opening 248 can be provided if desired but can also be eliminated in a hook 247. FIGS. 27 and 40 illustrate a strap 221 coupled to a hook 247. A webbing strap 60 free end portion in a system 10, 11 can also be coupled to a hook 247 in a similar manner, if desired.

A longitudinal length of a hook 247 can vary based on the dimension of a cockpit wall or deck lip 85, and can be about 1 inch, 1 and ⅛ inch, 1 and ¼ inch, or about 1 and ½ inches long, or a length there inbetween. A cockpit wall or deck lip 85 can commonly be about 0.5 to 2 inches long. A hook 247 preferably is made of a plastic material. A hook 247 can also be made of other suitable matters, if desired.

Although not shown, in one or more embodiments a boat fitting/outer rail bracket 40, 88, 230 can include a buckle portion similar to what is included in hook 247, formed as an integral part of the boat fitting/outer rail bracket for applying tension to a strap 220 or 60. However, preferably tension buckles 54 are included at a location between a fitting 40, 88, or 230 and tent 100 or 200 so that tension can be applied via pulling on strap 220 or 50 from two directions to more easily achieve the desired tension in strap 220 or 50 to hold tent 100 or 200 in place on the boat and/or to compress gasket 80. Preferably a tension buckle 54 is placed closer to a tent 100, 200 than to a boat fitting/bracket 40, 88 or 230.

In one or more embodiments of system 10, 11, and/or 201, a compressible layer/gasket 80 does not have to be included, e.g., if a user is not concerned about providing a barrier to water and bugs for the system. In such embodiments, a tent 100, 200 can be positioned on a boat deck and secured in place by applying tension to straps connected to fittings on the boat that are exterior to the tent. A tent 100, 200 can also be positioned on a boat deck and secured in place by applying tension to straps connected to fittings on the boated positioned within the tent 100, 200 interior 28.

PARTS LIST

The following is a list of parts and materials suitable for use in the present invention:

| Parts Number | Description |
|---|---|
| 10 | cockpit covering system |
| 11 | cockpit covering system |
| 12 | boat outer wall |
| 13 | motor |
| 14 | floor |
| 15 | recessed area |
| 16 | steering station |
| 17 | outer perimeter |
| 18 | bow/front of skiff |
| 19 | stem/rear of skiff |
| 20 | skiff' small boat |
| 21 | cockpit |
| 22 | bow/front side |
| 73 | starboard side |

-continued

| Parts Number | Description |
|---|---|
| 24 | aft/rear side |
| 25 | port side |
| 26 | deck |
| 27 | skiff rail/lip |
| 28 | interior |
| 29 | bottom |
| 30 | cockpit seat |
| 31a | starboard rear seat |
| 31b | middle rear seat |
| 31c | port rear seat |
| 32 | guide seat |
| 33 | pole |
| 34 | tent base portion |
| 35 | corner/bend |
| 36 | corner/bend |
| 37 | corner/bend |
| 38 | corner/bend |
| 39 | gunwale/gunnel/cockpit interior wall |
| 40 | exterior fitting/bracket/c-clamp/ rail bracket |
| 41 | webbing loop/opening |
| 44. | boll |
| 45 | rubber |
| 46 | upper transverse member |
| 47 | lower transverse member |
| 48 | center member |
| 49 | opening |
| 50 | cockpit coupler/hook/ interior fitting |
| 51 | webbing loop |
| 52 | center/middle portion |
| 53 | lower portion/hook end |
| 54 | buckle/tension buckle |
| 55 | tent base webbing layer |
| 57 | upper portion hook |
| 58 | top portion |
| 59 | arrow |
| 60 | webbing strap |
| 61 | hook bottom |
| 62 | rail top side |
| 63 | rail bottom side |
| 64 | arrow |
| 65 | tent comer |
| 66 | tent corner |
| 67 | tent comer |
| 68 | tent corner |
| 80 | compressible sealing layer/compressible layer/gasket |
| 81 | hook lip |
| 82 | line |
| 83 | front side hook |
| 84 | hook top side |
| 85 | cockpit deck lip |
| 87 | radius of curvature |
| 88 | exterior fitting/bracketic-clamp/rail bracket |
| 90 | tent pole |
| 91 | pole bracket/housing |
| 92 | tension strap |
| 93 | front side cockpit wall |
| 94 | buckle |
| 95 | backside cockpit wall |
| 96 | lower end |
| 97 | housing interior |
| 98 | sew line |
| 99 | attachment area |
| 100 | tent |
| 101 | forward wall |
| 102 | starboard wall |
| 103 | rear wall |
| 104 | port wall |
| 105 | door |
| 106 | window/opening/vestibule |
| 107 | wider portion |
| 108 | narrow portion |
| 109 | flange space/fold area |

-continued

| Parts Number | Description |
|---|---|
| 110 | cockpit outer perimeter |
| 111 | interior base pole |
| 112 | interior base pole housing |
| 113 | tie or strap |
| 114 | corner sleeve or pocket |
| 115 | exterior |
| 117 | twist clip/hook |
| 118 | swivel hub |
| 119 | twist clip/hook |
| 120 | bracket housing coupler |
| 121 | main pole portion |
| 126 | flange |
| 128 | flange side/horizontal member |
| 129 | flange side/vertical |
| 130 | rain fly |
| 131 | rain fly base/rain fly bottom |
| 132 | DAC ® Jake's foot |
| 137 | tie down |
| 138 | stern eye |
| 140 | vestibule pole/support stake |
| 150 | tent lower portion |
| 166 | pole/tent tie down |
| 170 | top member |
| 171 | center member |
| 172 | lower member |
| 173 | opening |
| 174 | opening |
| 180 | exterior |
| 181 | interior |
| 194 | marsh/land |
| 195 | boat occupant |
| 196 | anchor |
| 197 | water |
| 200 | tent |
| 201 | cockpit covering system |
| 205 | flange portion/bottom insert/seat insert/skirt insert |
| 206 | screen/mesh |
| 207 | fold |
| 208 | hatch interior |
| 209 | opening grommet/pole coupler/pole housing |
| 210 | seat |
| 211 | motor |
| 215 | grommet/pole coupler/pole housing |
| 216 | steering column |
| 217 | standing rail/seat |
| 218 | rail |
| 220 | exterior webbing/strap |
| 221 | interior webbing/strap |
| 222 | tent base/tent base portion/skirt |
| 223 | stitch/connection |
| 224 | exterior skirt/tent base outer flare |
| 225 | interior skirt/tent base inner flare |
| 226 | tent wall seam/connection area |
| 227 | insert |
| 228 | space/area between inserts |
| 230 | exterior fitting/outer rail bracket/c-clamp/c-bracket |
| 231 | lower transverse portion |
| 232 | movable buckle/movable strap coupler/pivot member |
| 233 | upper transverse portion |
| 234 | bolt |
| 235 | bolt end/handle |
| 236 | top/head bolt |
| 237 | rubber/cushioning layer |
| 238 | locking member/pin/disc/button |
| 239 | longitudinal portion |
| 240 | larger opening |
| 241 | smaller opening |
| 245 | bottom hook portion |
| 246 | buckle/tension buckle/strap coupler portion |
| 247 | hook/cockpit coupler/interior fitting |
| 248 | opening |

-continued

| Parts Number | Description |
|---|---|
| 249 | longitudinal portion |
| 251 | opening/slot |
| 252 | arrows |
| 254 | wider top portion/larger portion locking member |
| 256 | rotational axis |
| 255 | narrower longitudinal of portion locking member |
| 259 | opening/space |
| 261 | stop |
| 262 | hatch/hatch door |
| 263 | arrow |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the claims.

The invention claimed is:

1. An enclosure system for a boat comprising:

a) a cover comprising a plurality of wall portions and a base portion for resting on a deck of the boat, and wherein the cover is sized to enclose an interior space on the boat;

b) a plurality of straps coupled to the cover;

c) one or more exterior fittings, each attachable to the boat at a position that is exterior to said plurality of wall portions;

d) wherein at least some of the plurality of straps extend away from the cover to a said exterior fitting; and e) wherein at least some of the plurality of straps extend interior to the cover to an interior fitting on the boat that is located in the interior space.

2. The enclosure system of claim 1 further comprising a plurality of poles, wherein at least some of the plurality of poles have a pole end coupled in a housing on the base portion of the cover.

3. The enclosure system of claim 2 wherein at least one of the plurality of poles extends from one cover side to another cover side and crosses over another one of the plurality of poles.

4. The enclosure system of claim 1 wherein the base portion includes a compressible material for resting on the deck of the boat.

5. The enclosure system of claim 4 wherein applying tension to at least one of the plurality of straps that is exterior to the cover compresses at least a portion of the compressible material against the deck of the boat.

6. The enclosure system of claim 5 wherein the compressible material pressed against the deck of the boat forms a seal.

7. The enclosure system of claim 6 wherein the compressible material pressed against the deck of the boat forms a water and/or bug seal.

8. The enclosure system of claim 1 wherein the cover encloses a cockpit of the boat and a floor of the cockpit defines a floor for the enclosure system.

9. The enclosure system of claim 6, wherein the compressible material is a neoprene gasket.

10. The enclosure system of claim 1 wherein at least some of the plurality of straps extending exterior to the cover include a tension buckle adapted for increasing or reducing tension of said straps.

11. The enclosure system of claim 1 wherein said exterior fittings are c-clamps.

12. The enclosure system of claim 1 further including a plurality of interior poles.

13. The enclosure system of claim 1 wherein at least a portion of the base portion is wrapped in a water proof or water resistant material.

14. The enclosure system of claim 1 wherein the base portion is a skirt extending exterior to the cover.

15. The enclosure system of claim 1 wherein the base portion is formed from a water proof material or a water resistant material.

16. A method of assembling a tent covering system adapted for providing a seal along at least a portion of a cockpit of a boat, the method comprising the following steps:

a) providing a tent positionable on a deck at or near the cockpit, wherein the tent is sized to extend over the cockpit, the tent for forming an enclosure around an interior space, said tent having:

i) a plurality of wall portions and a base portion for resting on the deck of the boat;

ii) a plurality of straps attached to said tent;

iii) a plurality of fittings including one or more exterior fittings and one or more interior fittings, each of said plurality of fittings attachable to the boat and to a said strap;

iv) wherein at least some of the plurality of straps extend from the tent to said one or more exterior fittings on the boat exterior to the tent; and v) wherein at least some of the plurality of straps extend from the tent to a said interior fitting on the boat within the interior space; and b) applying tension to at least one of said plurality of straps attached to a said exterior fitting or a said interior fitting to compress at least a portion of the base portion against the deck.

17. The method of claim 16 wherein one or more tent pole housings are included on the base portion.

18. The method of claim 17 further comprising securing one or more tent poles to a tent pole housing.

* * * * *